US005474131A

United States Patent [19]

Jordan, Jr. et al.

[11] Patent Number: 5,474,131

[45] Date of Patent: Dec. 12, 1995

[54] METHOD FOR COMPLETING MULTI-LATERAL WELLS AND MAINTAINING SELECTIVE RE-ENTRY INTO LATERALS

[75] Inventors: Henry J. Jordan, Jr., Conroe; Robert J. McNair, The Woodlands; Alan B. Emerson; Brian S. Kennedy, both of Houston; Patrick J. Zimmerman, The Woodlands, all of Tex.

[73] Assignee: Baker Hughes Incorporated, Houston, Tex.

[21] Appl. No.: 188,998

[22] Filed: Jan. 26, 1994

Related U.S. Application Data

[63] Continuation-in-part of Ser. No. 76,341, Jun. 10, 1993, abandoned, which is a continuation-in-part of Ser. No. 926,451, Aug. 7, 1992, Pat. No. 5,311,936.

[51] Int. Cl.[6] ..... E21B 43/14

[52] U.S. Cl. ..... 166/313; 166/50; 166/384

[58] Field of Search ..... 166/313, 380, 166/50, 117.5, 117.6, 384; 175/61, 62

[56] References Cited

U.S. PATENT DOCUMENTS

| | | | |
|---|---|---|---|
| 2,397,070 | 3/1946 | Zublin . | |
| 2,457,920 | 11/1948 | Gilbert . | |
| 2,797,893 | 7/1957 | McCune et al. . | |
| 2,858,107 | 10/1958 | Colmerauer . | |
| 3,330,349 | 7/1967 | Owsley et al. . | |
| 4,396,075 | 8/1983 | Wood et al. | 166/50 X |
| 4,402,551 | 9/1983 | Wood et al. | 166/50 X |
| 4,415,205 | 11/1983 | Rehm et al. | 166/50 X |
| 4,436,165 | 3/1984 | Emery | 175/61 |
| 4,444,276 | 4/1984 | Peterson, Jr. | 175/61 |
| 4,515,213 | 5/1985 | Rosen et al. | 166/123 |
| 4,573,541 | 3/1986 | Josse et al. | 166/117.5 X |
| 4,807,704 | 2/1989 | Hsu et al. | 166/313 |
| 5,113,938 | 5/1992 | Clayton | 166/117.6 |
| 5,115,872 | 5/1992 | Brunet et al. | 175/61 |

OTHER PUBLICATIONS

Svend Aagne Andersen, John M. Conlin, Kjeld Fjeldgaard and Svend Aage Hanse, Exploiting Reservoirs With Horizontal Wells: The Maersk Experience, Schlumberger Oil Field Review–Schlumberger Technical Review, pp. 11–21.

Peter Betts, Curt Blount, Bill Broman, Brian Clark, Larry Hibbard, Alain Louis and Paul Oosthoek, Acquiring And Interpreting Logs In Horizontal Wells, Schlumberger Oil Field Review; Schlumberger Technical Review, pp. 34–51.

Jeff H. Littleton, Sohio Studies Extended–Reach Drilling For Prudhoe Bay, Oct. 1985, Petroleum Engineer, pp. 28, 32 and 34.

(Unknown), Horizontal Drilling Stays Hot, Apr. 1989, Petroleum Engineer International, pp. 24.

(List continued on next page.)

*Primary Examiner*—William P. Neuder
*Attorney, Agent, or Firm*—Fishman, Dionne & Cantor

[57] ABSTRACT

A method for completing multi-lateral wells and maintaining selective re-entry into laterals is presented. In accordance with the present invention, a first lateral well is drilled from a primary well bore and a string of external casing packers and a packer bore receptacle are run therein. Once the orientation of the packer bore receptacle is determined, an orientation anchor of a retrievable whipstock assembly is mounted thereto. Thereafter, a second lateral well may be drilled. Once the second lateral well is drilled, the whipstock assembly may be retrieved and replaced with a scoophead diverter assembly which also includes an orientation anchor for mating with the packer bore receptacle. At this time, a string of external casing packers may be run into the second lateral well through the scoophead diverter assembly. Finally, a selective reentry tool is run into the scoophead assembly. The selective re-entry tool includes a diversion flapper for selecting either the first or second lateral well bore. Selective re-entry is desirable for the purpose of performing well intervention techniques. The re-entry tool may be actuated by a device located on a coil tubing work string which may be operated from the surface.

54 Claims, 35 Drawing Sheets

OTHER PUBLICATIONS

Trevor Burgess and Patrick Van de Slijke, Horizontal Drilling Comes Of Age, Schlumberger Oil Field Review–Schlumber Technical Review, pp. 22–23.
(Unknown), Drilling Fluids For Horizontal Wells, Schlumberger Oil Field Review; Schlumberger Technical Review, pp. 8–10.
(Unknown), Reservoir Selection For Horizontal Wells, (Unknown), Western International, pp. 1–8.
(Unknown), Cementing Of Horizontal Wells, (Unknown), Western International, pp. 9–14.
(Unknown), Matriz Stimulation Of Horizontal Wells, (Unknown), Western International, pp. 15–21.
(Unknown), Fracturing Of Horizontal Wells, (Unknown) Western International, pp. 23–30.
(Unknown), Horizontal Well Case Histories, (Unknown), Western International, pp. 31–37.
J. P. Wilkinson, J. H. Smith, T. O. Stagg, and D. A. Walters, Horizontal Drilling Techniques At Prudhoe Bay, Alaska, 1980, Society of Petroleum Engineers, pp. 1–12.
G–F. Fuh, D. B. Deom and R. D. Turner, Wellbore Stability And Drilling Results From The First Horizontal Well In the Kotter Field Offshore The Netherlands, 1991, Society of Petroleum Engineers, pp. 101–109.
L. R. B. Hammons, W. C. Barnett, E. K. Fisher and D. H. Sellers, Stratigraphic Control And Formation Evaluation Of Horizontal Wells Using MWD, 1991, Society of Petroleum Engineers, pp. 25–38.
D. B. Gaudin and J. C. Beasley, A Comparison Of MWD And Wireline Steering Tool Guidance Systems In Horizontal Drilling, 1991, Society of Petroleum Engineers, pp. 7–18.
C. M. Matthews and L. J. Dunn, Drilling And Production Practices To Mitigate Sucker Rod/Tubing Wear–Related Failures In Directional Wells, 1991, Society of Petroleum Engineers, pp. 363–374.
D. Malekzadeh and D. Tiab, Interference Testing Of Horizontal Wells, 1991, Society of Petroleum Engineers, pp. 717–727.
S. Schellenberg, T. Rogers and L. Smith, Deviation Control With Steerable System Lowers Well Costs In Southern Oklahoma, 1991, Society of Petroleum Engineers, pp. 299–312.
L. Shale, Development Of Air Drilling Motor Holds Promise For Specialized Directional Drilling Applications, 1991, Society of Petroleum Engineers, pp. 275–286.
J. L. Hood, III, M. D. Mueller and M. G. Mims, The Uses Of Buoyancy In Completing High–Drag Horizontal Wellbores, 1991, Society of Petroleum Engineers, pp. 757–764.
D. R. Schroeter and H. W. Chan, Successful Application Of Drilling Technology Extends Directional Capability; Sep. 1989, SPE Drilling Engineer, pp. 230–236.
T. M. Gaynor, Downhole Control Of Deviation With Steerable Straight–Hole Turbodrills, Mar. 1988, SPE Drilling Engineer, pp. 50–56.
W. Dickinson, R. R. Anderson and D. W. Dickinson, The Ultrashort–Radius Radial System, Sep. 1989, SPE Drilling Engineer, pp. 247–254.
M. A. Wilson and F. L. Sabins, A Laboratory Investigation Of Cementing Horizontal Wells, Sep. 1988, SPE Drilling Engineer, pp. 275, 278 and 280.
H. J. Vrlellnk and A. M. Hippman, The Optimization Of Slant–Well Drilling In The Lindbergh Field, Dec. 1989, SPE Drilling Engineer, pp. 307–314.
P. Hardman, Beckingham 36 Horizontal Well, Mar. 1989, SPE Drilling Engineer, pp. 17–23.
D. B. Chritain, Planning And Operational Requirements For A Shallow–Objective, High–Angle Well In The Gulf Of Mexico, Sep. 1988, SPE Drilling Engineer, pp. 241–247.
T. J. Moo and M. W. Tweedy, Planning And Drilling Australia's First Medium–Radius Horizontal Wells, 1991, Society of Petroleum Engineers, pp. 629–640.
William J. Lang and Marion B. Jett, High Expectations For Horizontal Drilling Becoming Reality, Sep. 24, 1990, Oil & Gas Journal, pp. 70 72, 74, 76 and 79.
Ron Matson and Rod Bennett, Cementing Horizontal Holes Becoming More Common, Dec. 17, 1990, Oil & Gas Journal, pp. 40–45.
Lindsay Fraser, Effective Ways To Clean And Stabilize High–Angle Holes, Nov. 1990, Petroleum Engineer, pp. 30, 32, 34 and 35.
Michael M. Power, Roger Chapman and Robert O'Neal, Horizontal Well Sets Depth Record–Horizontal Drilling Below 14,600 Ft., Nov. 1990, Petroleum Engineer, pp. 36–38, 40 and 41.
A. Spreux, A. Louis and M. Rocca, Logging Horizontal Wells—Field Practice For Various Techniques, 1987, Society of Petroleum Engineers, pp. 1–14.
J. B. Weirich, T. E. Zaleski, Jr., and P. M. Mulcahy, Perforating The Horizontal Well: Designs And Techniques Prove Successful, 1987, Society of Petroleum Engineers, pp. 503–508.
R. H. Reiley, J. W. Black, T. O. Stagg, D. A. Walters and G. R. Atol, Cementing Of Liners In Horizontal And High–Angle Wells At Prudhoe Bay, Aslaska, 1987, Society of Petroleum Engineers, pp. 583–590.
M. B. Webster, G. E. Otott, Jr. and D. L. Rice, Cementing High–Angle Wells Using Cement–Expanded Formation Packers And/Or Casing Rotation, 1987, SPE/IADC, pp. 745–754.
D. W. Sherrard, B. W. Brice and D. G. MacDonald, Application Of Horizontal Wells At Prudhoe Bay, 1986, Society of Petroleum Engineers, pp. 1–16.
R. C. Wilson and D. N. Willis, Successful High Angle Drilling In The Statfjord Field, 1986, Society of Petroleum Engineers, pp. 1–13.
C. Zurdo, C. Georges and M. Martin, Mud And Cement For Horizontal Wells, 1986, Society of Petroleum Engineers, pp. 1–8.
A. A. Gavignet and I. J. Sobey, A Model For The Transport Of Cuttings In Highly Deviated Wells, 1986, Society of Petroleum Engineers, pp. 1–8.
C. J. Perry, Directional Drilling With PDC Bits In The Gulf Of Thailand, 1986, Society of Petroleum Engineers, pp. 1–9.
William P. Diamon and David C. Ovler, Drilling Long Horizontal Coalbed Methane Drainage Holes From A Directional Surface Borehole, 1990, Society of Petroleum Engineers, pp. 341–346.
Pat Herbet, Drilling With New–Generation Positive Displacement Motors, 1981, Society of Petroleum Engineers, pp. 1–5.
M. J. Landman and W. H. Goldthrope, Optimization Of Perforation Distribution For Horizontal Wells, 1991, Society of Petroleum Engineers, pp. 567–576.
U. Ahmed, Horizontal Well Completion Recommendations Through Optimized Formation Evaluation, 1991, Society of Petroleum Engineers, pp. 423–435.
R. J. Tailby, J. H. Yonker and J. L. Pearce, A New Technique For Servicing Horizontal Wells, 1991, Society of Petroleum Engineers, pp. 43–58.

J. Misselbrook, G. Wilde and G. Falk, The Development And Use Of A Coiled–Tubing Simulation For Horizontal Applications, 1991, Society of Petroleum Engineers, pp. 29–41.
P. E. Harness, M. D. Hansen, G. A. Terzian, S. H. Fowler, Jr., and F. J. Golino, An Overview Of Reeled–Tubing–Conveyed Production Logging Capabilities In California, 1990, Society of Petroleum Engineers, pp. 155–163.
J. Bryant, D. Watson, W. Wisniewski, R. Patterson and L. Smith, Applications And Limitations Of Horizontal Drilling In Oklahoma, 1991, Society of Petroleum Engineers, pp. 313–326.
Gary M. Briggs, How To Design A Medium–Radius Horizontal Well, Sep. 1989, Petroleum Engineer, pp. 26, 30–32, 36 and 37.
Dennis Dann and David Jetelina, New Logging Approach Detects Fractures In Horizontal Wells, Sep. 1990, Petroleum Engineer, pp. 30, 32, 33, 35 and 36.
Jay Dobson and T. C. Mondshine, Unique Completion Fluid Suits Horizontal Wells, Sep. 1990, Petroleum Engineer, pp. 42, 44, 46 and 48.
Sid B. Nice and W. H. Fertl, New Logging, Completion Techniques Boost Horizontal Well Productivity, Nov. 1990, Petroleum Engineer, pp. 20, 22–24, 26–29.
Bruce Woodlan and G. E. Powell, Casing Design In Directionally Drilled Wells, 1975, Society of Petroleum Engineers, pp. 1–11.
W. B. Bradley, C. E. Murphey, R. T. McLamore, and L. L. Dickson, Advantages Of Heavy Metal Collars In Directional Drilling And Deviation Control, May 1976, Society of Petroleum Engineers, pp. 521–530.
D. Bryant, T. Hudson and S. Hoover, The Use Of Low–Density Particles For Packing A Highly Deviated Well, Oct. 1990, Society of Petroleum Engineers, pp. 387–395.
Wade Dickinson, Michael J. Pesavento and R. Wayne Dickinson, Data Acquisition, Analysis, And Control While Drilling With Horizontal Water Jet Drilling Systems, 1990, Soecity of Petroleum Engineers, pp. 127–1–127–10.
A. Eddison and J. Symons, Downhole Adjustable Gauge Stabilizer Improves Drilling Efficiency In Directional Wells, 1990, Society of Petroleum Engineers, pp. 509–516.
S. H. Fowler, Jr. and C. W. Plesants, Operation And Utilization Of Hydraulic–Actuated Service Tools For Reeled Tubing, 1990, Society of Petroleum Engineers, pp. 631–640.
D. K. Trichel and M. P. Ohanlan, Unique Articulated Downhole Motor Holds Promising Future For Short Radius Horizontal Drilling, 1990, Society of Petroleum Engineers, pp. 137–149.
Y. Tsukano and M. Ueno, Development of Lightweight Steel Drillpipe With 165–KSI Yield Strength, 1990, Society of Petroleum Engineers, pp. 403–412.
O. Rivas, A. Newsky, M. Cadeno and P. Rivera, Sucker Rod Centralizer For Directional Wells, 1990, Society of Petroleum Engineers.
Fred L. Sebins, Problems In Cementing Horizontal Wells, Apr. 1990, JPT, pp 398–400.
J. D. Fultz, F. J. Pittard, F. D. Sawyer and W. R. Farmer, Slim–Hole Drilling In Harsh Environments, 1990, IADC/SPE, pp. 333–340.M. R. Islam and A. E. George, Sand Control In Horizontal Wells In Heavy Oil Reservoirs, 1989, Society of Petroleum Engineers, pp. 437–452.
S. B. Claytor, Jr., R. King and J. Speed, Steerable Systems Drilling: The Right Angle For Horizontal Drilling, 1989, Society of Petroleum Engineers, pp. 7–16.
C. W. White, Drilling And Completion Of A Horizontal Lower Spraberry Well Including Multiple Hydraulic Fracture Treatments, pp. 205–210.
R. L. Cook, J. W. Nicholson, M. G. Sheppard and W. Westlake, First Real Time Measurements Of Downhole Vibrations, Forces, and Pressures Used To Monitor Directional Drilling Operations, 1989, SPE/LADC, pp. 283–290.
L. Keelean, S. S. Harris and N. Petronio, Short Radius Drilling Technology Utilizing Mobile Service/Workover Rig, 1989, SPE/IADC, pp. 765–772.
R. Ehiers, L. Kracht and J. Witte, Case History Of Horizontal Wells Drilled With Navigation Technology In European Operations, 1989, SPE/IADC, pp. 315–324.
H. Karlsson, R. Cobbley and G. E. Jacques, New Developments In Short–, Medium–, and Long–Radius Lateral Drilling, 1989, SPE/IADC, pp. 725–736.
G. K. McKown, Drillstring Design Optimization For High–Angle Wells, 1989, SPE/IADC, pp. 275–282.
W. Dickinson, R. G. Knowll, R. Nordlund and W. Dickinson, Flexible Sand Barrier (FSB): A Novel Sand Control System, 1989, Society of Petroleum Engineers, pp. 419–424.
P. A. Goode and D. J. Wilkinson, Inflow Performance Of Partially Open Horizontal Wells, 1989, Society of Petroleum Engineers, pp. 309–320.
G. E. King, Perforating The Horizontal Well, Jul. 1989, Journal of Petroleum Technology, pp. 671–672.
J. P. Ashton, J. Lipuz, R. Leomons and J. Summerlin, Gravel Packing Horizontal And Highly Deviated Openhole Completions Using A Single–Screen Prepacked Liner In Offshore California Fields, 1989, Society of Petroleum Engineers, pp. 165–178.
R. E. Cooper and J. C. Troncose, An Overview Of Horizontal Well Completion Technology, 1988, Society of Petroleum Engineers, pp. 335–350.
R. E. Cooper, Coiled Tubing In Horizontal Wells, 1988, Society of Petroleum Engineers, pp. 323–334.
S. A. Andersen, S. A. Hansen and K. Fjeldgaard, Horizontal Drilling And Completion: Denmark, 1988, Society of Petroleum Engineers, pp. 155–165.
D. Kerr and K. Lesley, Mechanical Aspects Of Medium Radius Well Design, 1988, Society of Petroleum Engineers, pp. 719–726.
J. E. Fontenot, Successful High Angle Completions, Cementing, And Drilling's Impact, 1988, Society of Petroleum Engineers, pp. 831–842.
J. Lessi and A. Spreux, Completion Of Horizontal Drainholes, 1988, Society of Petroleum Engineers, pp. 209–218.
L. McDonald Schetky, Shape–Memory Alloys, Nov. 1979, Scientific American, pp. 1–10.
Raychem Corporation, "Tinel" Shape–Memory Alloys, 1989, Brochure of Raychem Corporation Metals Division, pp. 1–13.
U. Ahmed and S. Jacobsen, Schlumberger, Practical Aspects Of Horizontal Well Technology: A Perspective, 1990. Society of Petroleum Engineers, pp. 1–16.
A. Damgaard, S. D. Bangert, D. J. Murray, R. P. Rubbo and G. W. Stout, A Unique Method For Perforating, Facturing And Completing Horizontal Wells, 1989, Society of Petroleum Engineers, pp. 1–13.
D. Ackert et al, Looking Sideways For Oil, (Unknown), The Technical Review, pp. 22–31.
Dr. S. D. Joshi, Proper Completion Critical For Horizontal Wells, Jan. 1990, Joshi Technologies International, Inc., pp. 1–4.

Derry D. Sparlin, Raymond W. Hagen, Jr., Controlling Sand In A Horizontal Completion, Nov. 1988, World Oil, pp. 54–58.
E. Brown, R. Thomas and A. Milne, The Challenge Of Completing And Stimulating Horizontal Wells, (Unknown), Oilfield Review, pp. 54–63.
Sid B. Nice, Leading Edge Logging–Well Logging And Completion Technology For Horizontal Wellbores, Jan./Mar. 1991, Popular Horizontal, pp. 4–13.
Rainer Jurgens, Ron Bitto, Bruce Henderson, Cameron White and Gus Mullins, Horizontal Drilling And Completions: A Review Of Available Technology—Medium– And Long–Radius Horizontal Drilling, Mar. 1991, Petroleum Engineer International, pp. 32–37.
Rainer Jurgens, Ron Bitto, Bruce Henderson, Cameron White and Gus Mullins, Horizontal Drilling And Completions: A Review Of Available Technology— Short– And Medium–Radius Horizontal Drilling, Feb. 1991, Petroleum Engineer International, pp. 14–21.
M. F. Cooney, T. Rogers and R. N. Stephens, Case History Of An Opposed– Bore, Dual Horizontally Well In The Austin Chalk Formation Of South Texas, 1991, SPE/IADC, pp. 737–748.
Stepehn A. Graham, Charles E. Graham, II & Associates, Inc., Bruce Henderson and Greg Nazzal, Drilling A Dual–Bore Horizontal Well In The Austin Chalk: A Case History, (Unknown), The American Society of Mechanical Engineers, pp. 1–9.
Cameron White and Mark Hopmann, Controlling Flow In Horizontal Wells, Nov. 1991, Production '91, pp. 1–6.
T. K. Li, V. Chandella, and J. Brych, Lateral Drilling: A New Application Shows Promise, Jun. 1986, World Oil, pp. 68–71.
R. H. Reiley, J. W. Black, T. O. Stagg, D. A. Walters and G. R. Atol, Improving Liner Cementing In High–Angle/Horizontal Wells, Jul. 1988, World Oil, pp. 69, 71–74.
Ray H. Holifield and Bill Rehm, Recompletion By Horizontal Drilling Pays Off, Mar. 1989, World Oil, pp. 42, 43 and 50.
Denny Kerr, How To Drill A Smooth Medium–Radius Well, Mar. 1990, World Oil, pp. 46–47.
R. C. Haas and C. C. Stokley, Drilling And Completing A Horizontal Well In Fractured Carbonate, Oct. 1989, World Oil, pp. 39, 40, 42, 44 and 45.
Bernhard Prevedel, Case History: How One Operator Drilled Horizontally Through A A Salt Dome, Dec. 1985, World Oil, pp. 69, 73, 76 and 80.
Chris Zimmerman and Donny Winslow, How To Select The Right Tools For Stimulating Horizontal Wells, Nov. 1989, World Oil, pp. 53–56.
Mohamed Soliman, Bob Rose, Wadood El Rabaa and James L. Hunt, Planning Hydraulically Fractured Horizontal Completion, Sep. 1989, World Oil, pp. 54–56 and 58.
Robert D. Grace and Mike Pippin, Downhole Fires Furing Air Drilling: Causes And Cures, May 1989, World Oil, pp. 42–44.
H. Delafon, BHA Prediction Software Improves Directional Drilling, Apr. 1989, World Oil, pp. 51–56 and 60.
Haraldur Karlsson and Ron Bitto, Worldwide Experience Shows Horizontal Well Success, Mar. 1989, World Oil, pp. 51–54 and 56.
H. Delafon, BHA Prediction Software Improves Directional Drilling, Mar. 1989, World Oil, pp. 45–48 and 50.
Michael J. Economides, John D. McLennan, Ernest Brown and Jean–Claude Roegiers, Performance And Stimulation Of Horizontal Wells, Jul. 1989, World Oil, pp. 69–72, 76 and 77.
Jean–Francois Giannesini, Horizontal Drilling Is Becoming Commonplace: Here's How It's Done, Mar. 1989, World Oil, pp. 35–38 and 40.
William King, Selecting Bits For Extended Reach And Horizontal Wells, Apr. 1990, World Oil, pp. 53, 55, 57, 59 and 60.
Hanette Kuigh, Seismic And Horizontal Drilling Unlock Austin Chalk, Sep. 1990, World Oil, pp. 47, 48, 50, 52 and 54.
T. O. Stagg and R. H. Relley, Horizontal Well Completions In Alaska, Mar. 1990, World Oil, pp. 37–44.
Denny Kerr, Designing Tangent Sections For Medium–Radius Horizontal Wells, Mar. 1991, World Oil, pp. 45–47.
S. B. Nice and W. H. Fertl, Logging, Compleing Extended–Reach And Horizontal Wells, Mar. 1991, World Oil, pp. 49, 50, 52, 53, 55 and 56.
D. R. Holbert, New Interest In Drainhole Drilling Revives Technology, Mar. 1981, World Oil, pp. 57, 58, 61, 62, 64, 66, 70 and 72.
Larry E. Pendleton and A. Behrooz Ramesh, Bechtel Develops Innovative Method For Horizontal Drilling, May 27, 1985, Oil & Gas Journal, pp. 95–99.
Anthony W. Gorody, Tedsi Develops Horizontal Drilling Technology, Oct. 1, 1984, Oil & Gas Journal, pp. 118, 120, 125 and 126.
Les Shane, Downhole Motor Specifically Designed For Directional Air Drilling, Feb. 3, 1992, Oil & Gas Journal, pp. 45–49.
Douglas Gust, Horizontal Drilling Evolving From Art To Science, Jul. 24, 1989, Oil & Gas Journal, pp. 43–46 and 49–52.
Theodore E. Zaleksi, Jr., and Jefferson P. Ashton, Gravel Packing Feasible In Horizontal Well Completions, Jun. 11, 1990, Oil & Gas Journal, pp. 33–37.
Guntis Moritis, Horizontal Drilling Technology Keeps Advancing, Mar. 11, 1991, Oil & Gas Journal, pp. 49–54.
James A. Dech, David D. Hearn, Frank J. Schuh and Bob Lenhart, New Tools Allow Medium–Radius Horizontal Drilling, Jul. 14, 1986, Oil & Gas Journal, pp. 95–99.
Floyd Harvey, Fluid Program Built Around Hole Cleaning, Protecting Formation, Nov. 5, 1990, Oil & Gas Journal, pp. 37–41.
Guy Feneyrou, French Three–Leg Multidrain Well Improves Production, Oct. 1, 1984, Oil & Gas Journal, pp. 126–127.
Kevin T. Corbett and Rapier Dawson, Drillstring Design For Directional Wells, Apr. 30, 1984, Oil & Gas Journal, p. 61–66.
Glen Tolle and Thomas Dellinger, Mobil Identifies Extended–Reach–Drilling Advantages; Possibilities In North Sea, May 26, 1986, Oil & Gas Journal, pp. 78, 81–86.
Alain Spreux, Christain Georges and Jacques Cessi, Most Problems In Horizontal Completions Are Resolved, Jun. 13, 1988, Oil & Gas Journal, pp. 48–52.
Cameron White, Formation Characteristics Dictate Completion Design, Dec. 3, 1990, Oil & Gas Journal, pp. 58–62 and 64.
Warren Jones, Unusual Stresses Require Attention To Bit Selection, Oct. 22, 1990, Oil & Gas Journal, pp. 81–85.
Guntis Moritis, Horizontal Drilling Scores More Successes, Feb. 26, 1990, Oil & Gas Journal, pp. 53,54,58, 60–64.
Ron Matson and Rod Bennett, Cementing Horizontal Holes Becoming More Common, Dec. 17, 1990, Oil & Gas Journal, pp. 40–46.
Andrew Gallup, B. L. Wilson and Robert Marshall, ESP's Placed In Horizontal Lateral Increase Production, Jun. 18, 1990, Oil & Gas Journal, pp. 58–60, 62 and 63.
Carl W. Stan, Alternative Electronic Logging Technique Locates Fractures In Austin Chaulk Horizontal Well, Nov. 6, 1989, Oil & Gas Journal, pp. 42–45.
D. D. Cramer, Guides Exist For Fracture Treatment In Horizontal Wells, Mar. 27, 1989, Oil & Gas Journal, pp. 41, 44, 46, 48 and 49.
Stephen A. Graham and Greg Nazzal, Second Lateral In Horizontal Well Solves Water Problem, Mar. 18, 1991, Oil & Gas Journal, pp. 111–114.
Richard S. Carden, Air Drilling Has Some Pluses For Horizontal Wells, Apr. 8, 1991, Oil & Gas Journal, pp. 76–78.
Jiang Wu and Hans C. Juvkam–Wold, Drag And Torque Calculations For Horizontal Wells Simplified For Field Use, Apr. 29, 1991, Oil & Gas Journal, pp. 49–53 and 56.
Kenneth B. Gunn, Well Cored To 9,800 Ft In Paraguay, May 13, 1991, Oil & Gas Journal, pp. 51–55.
E. P. Deliac, J. P. Messines and B. A. Thierree, Mining Technique Finds Applications In Oil Exploration, May 6, 1991, Oil & Gas Journal, pp. 85–86, 88 and 90.
Siegfried K. Schueler, Horizontal Well Improves Recovery In Deep Sour Gas Field, Mar. 23, 1992, Oil & Gas Journal, pp. 93–94, 96 and 97.
Wade Dickinson, Eric Dickinson, Herman Dykstra and John W. Nees, Horizontal Radials Enhance Oil Production From A Thermal Project, May 4, 1992, Oil & Gas Journal, pp. 116, 118, 120, 122–124.
Dr. A. S. Picovi, Lic L. Guasaviono, Dr. A. Pozzo and Eng. J. A. Musmarra, Comparing Cost And Performance Of Horizontal Wells, Mar. 1991, World Oil, pp. 39, 40, 42–44.
Jim D. Fultz and Fred J. Pittard, Bottomhole System Works Completes Horizontal Wells, Mar. 1990, World Oil, pp. 48–50.
Jiang Wu, Pin Chen and Hans C. Juvkam–Wold, Casing Centralization— Centralization Of Casing In Horizontal Wells, Apr./Jun. 1991, Popular Horizontal, pp. 14–16, 18–21.
T. E. Zaleski, Jr., Sand–Control Alternatives For Horizontal Wells, May, 1991, JPT, pp. 509–511.
M. Y. Soliman, James L. Hunt and A. M. El Rabaa, Fracturing Aspects Of Horizontal Wells, Aug. 1990, JPT, pp. 966–973.
R. A. Skopec, M. M. Mann, D. Jeffers and S. P. Grier, Horizontal Core Acquisition And Orientation For Formation Evaluation, 1990, Society of Petroleum Engineers, pp. 153–166.
Giin–Fa Fuh, E. G. Dew, C. A. Ramsey and K. Collins, Borehole Stability Analysis For The Design Of First Horizontal Well Drilled In The U.K.'s Southern 'V' Fields, 1990, Society of Petroleum Engineers, pp. 31–42.
C. D. Pope and P. J. Handren, Completion Techniques For Horizontal Wells In The Pearsall Austin Chalk, 1990, Society of Petroleum Engineers, pp. 657–664.
F. R. Myal and K–H. Frohne, Slant–Hole Completion Test In The Piceance Basin, Colorado, 1991, Society of Petroleum Engineers, pp. 611–622.
R. C. Lead and F. J. Pittard, A Review Of Horizontal Methods And Drilling Technology, 1991, Society of Petroleum Engineers, pp. 575–584.
D. J. Hall, J. L. Walker, E. G. Schmelzl and T. B. Haene, Logging And Perforating Of Horizontal Wells: An Innovative Approach, 1991, Society of Petroleum Engineers, pp. 307–316.
T. P. Frick, M. J. Economides and Mining U. Leoben, Horizontal Well Damage Characterization And Removal, 1991, Society of Petroleum Engineers, pp. 429–438.
O. L. A. Santos, Important Aspects Of Well Control For Horizontally Drilling Including Deepwater Situations, 1991, SPE/IADC, pp. 785–796.
S. B. Claytor, K. J. Manning and D. L. Schmalzried, Drilling A Medium– Radius Horizontal Well With Aerated Drilling Fluid: A Case Study, 1991, SPE/IADC, pp. 759–773.
John F. Greenip, Jr., How To Design Casing Strings For Horizontal Wells, Dec. 1989, Petroleum Engineer, pp. 34–38.
Steven D. Moore, Meridian Oil Finds Success With Horizontal Wells, Nov. 1989, Petroleum Engineer, pp. 17–20 and 22.
Tony Beckett, Test Off Philippines Boosts Horizontal Drilling Technology, Nov. 1989, Petroleum Engineer, pp. 24–26.
G. Norel, C. Dubois and G. Georges, Test Bench Checks Cement In Horizontal Holes, Nov. 1988, Petroleum Engineer, pp. 54–59.
Christian Mariotti and Evelyne Kou, Elf Improves Horizontal Drilling At Rospo Mare, Aug. 1988, Petroleum Engineer, pp. 30, 32 and 35.
Staff Report, Getting To The Bottom With Slant–Hole Logging Tools, Feb. 1988, Petroleum Engineer, p. 32, 34 and 35.
G–F. Fuh and P. K. Loose, Horizontal Wellbore Stability For Openhole Completions, 1969, Society of Petroleum Engineers, pp. 155–164.

460

276
362
350
13C
530
564
566
342
380

METHOD FOR COMPLETING MULTI-LATERAL WELLS AND MAINTAINING SELECTIVE RE-ENTRY INTO LATERALS

CROSS-REFERENCE TO RELATED APPLICATIONS

This application is a continuation-in-part of U.S. application Ser. No. 08/076,341 filed Jun. 10, 1993, (now abandoned) which, in turn, is a continuation-in-part of U.S. application Ser. No. 07/926,451 filed Aug. 7, 1992 (now U.S. Pat. No. 5,311,936); and this application is related to the following applications which have been filed contemporaneously herewith:

(1) Application Ser. No. 08/186,781 entitled "Scoophead/Diverter Assembly for Completing Lateral Wellbores" invented by Henry Joe Jordan, Robert J. McNair, Alan B. Emerson and Brian S. Kennedy (attorney docket number 93-1522);

(2) Application Ser. No. 08/188,996 entitled "Multilateral Selective Re-entry Tool" invented by Henry Joe Jordan, Jr. and Alan B. Emerson (attorney docket number 93-1524);

(3) Application Ser. No. 08/188,380 entitled "Liner Tie Back Sleeve" invented by Brian S. Kennedy (attorney docket number 93-1518);

(4) Application Ser. No. 08/187,390 entitled "Parallel Seal Assembly" invented by Brian S. Kennedy and Henry Joe Jordan, Jr. (attorney docket number 93-1519);

(5) Application Ser. No. 08/188,381 entitled "Lateral Connector Receptacle" invented by Brian S. Kennedy, Patrick J. Zimmerman and Alan B. Emerson (attorney docket number 93-1521);

(6) Application Ser. No. 08,187,277 entitled "Scoophead Running Tool" invented by Brian S. Kennedy (attorney docket number 93-1520); and (7) Application Ser. No. 08/188,997 entitled "Wellbore Completion Using Measurement-While Drilling Techniques" invented by Henry Joe Jordan, Jr. and Robert J. McNair (attorney docket number 93-1523).

BACKGROUND OF THE INVENTION

This invention relates generally to the completion of wellbores. More particularly, this invention relates to new and improved methods and devices for completion of a branch wellbore extending laterally from a primary well which may be vertical, substantially vertical, inclined or even horizontal. This invention finds particular utility in the completion of multilateral wells, that is, downhole well environments where a plurality of discrete, spaced lateral wells extend from a common vertical wellbore.

Horizontal well drilling and production have been increasingly important to the oil industry in recent years. While horizontal wells have been known for many years, only relatively recently have such wells been determined to be a cost effective alternative (or at least companion) to conventional vertical well drilling. Although drilling a horizontal well costs substantially more than its vertical counterpart, a horizontal well frequently improves production by a factor of five, ten, or even twenty in naturally fractured reservoirs. Generally, projected productivity from a horizontal well must triple that of a vertical hole for horizontal drilling to be economical. This increased production minimizes the number of platforms, cutting investment and operational costs. Horizontal drilling makes reservoirs in urban areas, permafrost zones and deep offshore waters more accessible. Other applications for horizontal wells include periphery wells, thin reservoirs that would require too many vertical wells, and reservoirs with coning problems in which a horizontal well could be optimally distanced from the fluid contact.

Horizontal wells are typically classified into four categories depending on the turning radius:

1. An ultra short turning radius is 1–2 feet; build angle is 45–60 degrees per foot.

2. A short turning radius is 20–100 feet; build angle is 2–5 degrees per foot.

3. A medium turning radius is 300–1,000 feet; build angle is 6–20 degrees per 100 feet.

4. A long turning radius is 1,000–3,000 feet; build angle is 2–6 degrees per 100 feet.

Also, some horizontal wells contain additional wells extending laterally from the primary vertical wells. These additional lateral wells are sometimes referred to as drainholes and vertical wells containing more than one lateral well are referred to as multilateral wells. Multilateral wells are becoming increasingly important, both from the standpoint of new drilling operations and from the increasingly important standpoint of reworking existing wellbores including remedial and stimulation work.

As a result of the foregoing increased dependence on and importance of horizontal wells, horizontal well completion, and particularly multilateral well completion have been important concerns and have provided (and continue to provide) a host of difficult problems to overcome. Lateral completion, particularly at the juncture between the vertical and lateral wellbore is extremely important in order to avoid collapse of the well in unconsolidated or weakly consolidated formations. Thus, open hole completions are limited to competent rock formations; and even then open hole completion are inadequate since there is no control or ability to re-access (or re-enter the lateral) or to isolate production zones within the well. Coupled with this need to complete lateral wells is the growing desire to maintain the size of the wellbore in the lateral well as close as possible to the size of the primary vertical wellbore for ease of drilling and completion.

Conventionally, horizontal wells have been completed using either slotted liner completion, external casing packers (ECP's) or cementing techniques. The primary purpose of inserting a slotted liner in a horizontal well is to guard against hole collapse. Additionally, a liner provides a convenient path to insert various tools such as coiled tubing in a horizontal well. Three types of liners have been used namely (1) perforated liners, where holes are drilled in the liner, (2) slotted liners, where slots of various width and depth are milled along the line length, and (3) prepacked liners.

Slotted liners provide limited sand control through selection of hole sizes and slot width sizes. However, these liners are susceptible to plugging. In unconsolidated formations, wire wrapped slotted liners have been used to control sand production. Gravel packing may also be used for sand control in a horizontal well. The main disadvantage of a slotted liner is that effective well stimulation can be difficult because of the open annular space between the liner and the well. Similarly, selective production (e.g., zone isolation) is difficult.

Another option is a liner with partial isolations. External casing packers (ECPs) have been installed outside the slotted liner to divide a long horizontal well bore into several small sections (FIG. 1). This method provides limited zone isolation, which can be used for stimulation or production control along the well length. However, ECP's are also associated with certain drawbacks and deficiencies. For example, normal horizontal wells are not truly horizontal over their entire length, rather they have many bends and curves. In a hole with several bends it may be difficult to insert a liner with several external casing packers.

Finally, it is possible to cement and perforate medium and long radius wells as shown, for example, in U.S. Pat. No. 4,436,165.

While sealing the juncture between a vertical and lateral well is of importance in both horizontal and multilateral wells, re-entry and zone isolation is of particular importance and pose particularly difficult problems in multilateral wells completions. Re-entering lateral wells is necessary to perform completion work, additional drilling and/or remedial and stimulation work. Isolating a lateral well from other lateral branches is necessary to prevent migration of fluids and to comply with completion practices and regulations regarding the separate production of different production zones. Zonal isolation may also be needed if the borehole drifts in and out of the target reservoir because of insufficient geological knowledge or poor directional control; and because of pressure differentials in vertically displaced strata as will be discussed below.

When horizontal boreholes are drilled in naturally fractured reservoirs, zonal isolation is being seen as desirable. Initial pressure in naturally fractured formations may vary from one fracture to the next, as may the hydrocarbon gravity and likelihood of coning. Allowing them to produce together permits crossflow between fractures and a single fracture with early water breakthrough, which jeopardizes the entire well's production.

As mentioned above, initially horizontal wells were completed with uncemented slotted liner unless the formation was strong enough for an open hole completion. Both methods make it difficult to determine producing zones and, if problems develop, practically impossible to selectively treat the right zone. Today, zone isolation is achieved using either external casing packers on slotted or perforated liners or by conventional cementing and perforating.

The problem of lateral wellbore (and particularly multilateral wellbore) completion has been recognized for many years as reflected in the patent literature. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 2,397,070 similarly describes lateral wellbore completion using flexible casing together with a closure shield for closing off the lateral. In U.S. Pat. No. 2,858,107, a removable whipstock assembly provides a means for locating (e.g., re-entry) a lateral subsequent to completion thereof. U.S. Pat. No. 3,330,349 discloses a mandrel for guiding and completing multiple horizontal wells. U.S. Pat. Nos. 4,396,075; 4,415,205; 4,444,276 and 4,573,541 all relate generally to methods and devices for multilateral completions using a template or tube guide head. Other patents of general interest in the field of horizontal well completion include U.S. Pat. Nos. 2,452,920 and 4,402,551.

Notwithstanding the above-described attempts at obtaining cost effective and workable lateral well completions, there continues to be a need for new and improved methods and devices for providing such completions, particularly sealing between the juncture of vertical and lateral wells, the ability to re-enter lateral wells (particularly in multilateral systems) and achieving zone isolation between respective lateral wells in a multilateral well system.

SUMMARY OF THE INVENTION

The above-discussed and other drawbacks and deficiencies of the prior art are overcome or alleviated by the several methods and devices of the present invention for completion of lateral wells and more particularly the completion of multilateral wells. In accordance with prior application Ser. No. 07/926,451 filed Aug. 7, 1992, (now U.S. Pat. No. 5,311,936) assigned to the assignee, all of the contents of which are incorporated herein by reference, a plurality of methods and devices were provided for solving important and serious problems posed by lateral (and especially multilateral) completion including:

1. Methods and devices for sealing the junction between a vertical and lateral well.

2. Methods and devices for re-entering selected lateral well to perform completions work, additional drilling, or remedial and stimulation work.

3. Methods and devices for isolating a lateral well from other lateral branches in a multilateral well so as to prevent migration of fluids and to comply with good completion practices and regulations regarding the separate production of different production zones.

In accordance with the present invention, an improved method relating to the foregoing multilateral and related completion methods is presented. In particular, a method is presented for completing multi-lateral wells and maintaining selective re-entry into those multi-lateral wells. To accomplish this, a primary wellbore is drilled and cased. Thereafter, a first lateral well is drilled out of the bottom of the wellbore and a running tool directs a string of external casing packers, having sliding sleeves provided therebetween and a packer bore receptacle, therewithin (or in a preferred embodiment, a novel lateral connector receptacle is used in place of the packer bore receptacle). Next, a whipstock and anchor are mounted to the packer bore receptacle (or lateral connector receptacle) and, once aligned, a second lateral well is drilled away from the first lateral well. After retrieving the whipstock and anchor, a novel diverter and scoophead assembly is then run with preferably the same anchor alignment as the whipstock anchor to properly mate the diverter head with the second lateral well. At this time, a second string of external casing packers also having sliding sleeves may be run into the second lateral well. A selective re-entry tool with a novel parallel seal assembly below may then be run on a single production tubing string and tied back to the surface to a standard wellhead. In a preferred embodiment, the selective re-entry tool includes a diversion flapper which may be remotely shifted for selecting either the first or second lateral well bores for re-entry. The diversion flapper does not prohibit fluid flow from either lateral below.

In a preferred embodiment, the scoophead includes a pair of parallel offset bores, one of which communicates with the primary wellbore while the other communicates with the lateral wellbore. The bore leading to the lateral is provided with a novel liner tie-back sleeve. Thereafter, both bores are provided with a novel parallel seal assembly and this parallel seal assembly then is mated to either a selective re-entry tool or other production tubing.

It will be appreciated that the present method provides for the ability to enter any of the well bore completion strings for the purpose of conducting an activity such as acidizing, fracturing, washing, perforating and the like. The present invention allows an operator to select from the surface any lateral by use of a remotely controlled string or wireline methods and thereby convey the equipment into the chosen lateral.

In addition to the foregoing novel methods, the present invention includes a plurality of important and novel tools and assemblies for use in the described methods as well as other completion methods (multilateral or otherwise). For example, in accordance with the present invention, a novel lateral connector receptacle or LCR is provided which functions to (1) provide means for running a lower completion into the well; (2) provide means for orienting a retrievable whipstock assembly and/or scoophead/diverter assembly; and (3) provides means for attaching an upper completion to a lower completion. The LCR includes an upper section for housing a latch thread and smooth seal bore which respectively threadably attaches to, and mates with seals from, an orientation anchor. A central section of the LCR includes an orientation lug for mating with the orientation anchor and providing a fixed reference point to the retrievable whipstock and/or scoophead/diverter assembly; and a lower section of the LCR includes an inner mating (e.g., profiled) surface for attachment to an appropriate run-in tool. Preferably, the LCR includes three cylindrical, threadably mated subs (which respectively include the (1) latch thread and seal bore; (2) the orientation anchor alignment lug and (3) the running profiled connecting surfaces) and a fourth bottom sub. The LCR combines all of the aforementioned features providing a novel tool which allows for the ability to stack infinite laterals in a single well.

Another important tool assembly used is the method of lateral completion of the present invention is the aforementioned novel scoophead/diverter assembly which is installed at the juncture between the primary wellbore and the lateral branch and which allows the production tubing of each to be oriented and anchored. This scoophead/diverter assembly further provides dual seal bores for tying back to the surface with either a dual packer completion or a single tubing string completion utilizing a selective re-entry tool (SRT). The scoophead/diverter comprises a scoophead, a diverter sub, two struts as connecting members between the scoophead and diverter sub and a joint of tubing communicating between the scoophead and diverter sub. The scoophead has a large and small bore. The large bore is a receptacle for a tie back sleeve (described hereinafter) run on top of the lateral wellbore string, and the small bore is a seal bore to tie the primary wellbore back to surface. Below the scoophead, a joint of tubing is threaded to the small bore. The tubing passes through an angled smooth bore in the diverter sub which causes the tubing joint to deflect from the offset of the small bore of the scoophead back to the centerline of the scoophead, and thus the centerline of the borehole with which it is concentric. Taking the offset through the length of a tubing joint (typically 30 ft) allows for a gradual bend which will not restrict the passage of wireline or through tubing tools for lateral remedial and simulation work.

As mentioned, the scoophead and diverter sub are connected with two struts which rigidly fix the scoophead and diverter sub both axially and rotationally. Since the window length to the lateral wellbore entry varies depending on the hole size and build angle of the sidetrack, the distance between the scoophead and diverter sub is rendered adjustable by varying the length of the struts. This is important since for the system to function correctly, the scoophead and diverter must straddle the lateral sidetrack's exit window from the primary wellbore.

In accordance with an important feature of the scoophead, the profile on the top of the scoophead is configured so that it directs the production tubing for the lateral wellbore into the large bore of the scoophead and also orients the parallel seal assembly (described hereinafter) when tying back to the surface with a dual packer completion or a single tubing completion. The orientation is accomplished by combining a sloped profile with a slotted inclined surface around the small bore and a compound angled surface above the slot. When running the lateral wellbore tubing, if the nose first contacts the scoop it is directed into the large bore, and if it initially lands over the small borehole; it is prevented from entering due to the diameter of the nose being wider than the slot over the small borehole. Since the nose cannot pass the slot, it slides down the compound angle which also directs it to the large borehole. Similarly, when orienting the parallel seal assembly, the lateral wellbore seals, which are longer than the primary wellbore seals, first contact the scoophead, and are directed to the large borehole of the scoophead in exactly the same manner as described for the lateral wellbore tubing string. Once the lateral wellbore seals of the parallel seal assembly are directed into the correct borehole, the primary wellbore seals are limited in the amount of rotational misalignment they can have because the parallel seal assembly can only pivot around the lateral wellbore seal axis by the amount of diametric clearance between the major diameter of the parallel seal assembly and the inside diameter of the concentric main wellbore in which they are installed. The compound angle of the scoophead is configured such that its surface will contain this amount of rotational misalignment, and apply a force to the primary wellbore seals to guide them into their seal bore.

The aforementioned scoophead/diverter assembly functions to orient and anchor multiple tubing strings at the Y-juncture in an oil or gas well with multiple lateral wellbores. An important advantage of this arrangement is to provide communication to multiple reservoirs or tap different locations within the same reservoir and enable re-entry to these wellbores for remediation and stimulation. The large bore of the scoophead enables a secondary wellbore's production tubing (liner) to pass through until the top of the liner is in the scoophead. In accordance with an important feature of this invention, a novel liner tie-back sleeve is used to thread onto the top of the liner, and locate, latch and provide a seal receptacle to isolate the secondary wellbore's production fluids. The liner tie-back sleeve also includes a running profile for a suitable running tool. The liner tie-back sleeve comprises two cylindrical parts that, when assembled, provide a running tool profile for running the liner in the wellbore. The sleeve has a locating shoulder on the outer surface to indicate when the sleeve is located in the scoophead, and a locking groove for locking dogs from the scoophead to snap into, to provide resistance when pulling tension against the sleeve. Once the sleeve is in place and the running tool removed, an internal thread and seal bore is exposed for the parallel seal assembly (or other tool or production tubing) to plug into for isolating the secondary lateral wellbore. Providing the seal point between the parallel seal assembly and sleeve eliminates the need to effect a seal in the scoophead on the large bore side.

In order to effect a seal inside the scoophead, a novel offset parallel seal assembly with centralizer is utilized. This parallel seal assembly carries compressive loads on the primary well bore side, and has a shear out mechanism on the secondary wellbore side. This seal assembly also may constitute the connection between the scoophead and the selective re-entry tool (SRT). As described above, the SRT is the tool that ties the two separate tubing strings below it into a single production tubing string to surface or the next lateral. This parallel seal assembly has two seal assemblies parallel to one another with one seal assembly being larger diameter and longer than the other. The larger seal assembly seals into the seal bore of the tie back sleeve which is latched into the scoophead, and is attached to the top of the secondary wellbore's production tubing string. The smaller seal assembly seals in the small bore of the scoophead. The smaller assembly acts to isolate the primary wellbore. The larger seal assembly is longer than the smaller seal assembly to allow the larger seal assembly to enter the appropriate bore of the scoophead and align the overall assembly. The alignment is accomplished by trapping the larger seal assembly in its bore and trapping the centralizer in the wellbore. This positively limits the rotational mis-alignment available to the smaller seal assembly prior to stabbing into the scoophead. The parallel seal assembly automatically aligns with as much as 120° rotational misalignment. The centralizer preferably comprises two cylinders with two offset counter bores that bolt together. Once bolted together, the couplings located within the counter bores connect the seal assemblies to their respective tubing subs and are trapped in the counter bores. This limits the axial movement available to the centralizer. An important feature of the centralizer is that it elevates the seal assemblies off the wellbore wall during running and stab-in; and facilitates the automatic alignment feature of the parallel seal assembly and scoophead as a system.

As mentioned, a selective re-entry tool is run on the completion string to enable an operator to select the branch desired so as to enter such desired branch with a coil tubing workstring (or the like) and perform the appropriate operation (e.g., stimulation, fracture, cleanout, shifting, etc.). In a preferred embodiment, the selective re-entry tool includes an outer stationary sub and an inner longitudinally shiftable mandrel or sleeve. Preferably, this sleeve is connected to a rectangular box which is spaced from an exit sub having a pair of exit openings. A flapper is pivotally connected at the intersection between the exit opening. Laterally extending ears on opposed sides of the flapper are received in a respective pair of elongated, ramped guide slots formed on opposed lateral surfaces of the box. During operation, a known shifting tool will shift the inner sleeve upwardly or downwardly causing the box to similarly move (with respect to the outer sub). Longitudinal movement of the box will cause the ears in the flapper to move along the guide slots whereby the flapper will pivot between a first position which guides a coiled tubing through one of the exit openings to a second position which guides the coiled tubing through the other exit opening.

Preferably, a double ended collet is attached to a stationary sub and is supported on the inner sleeve. The collet includes an interlocking bump which mates with (e.g., snap-locks into) one of the two corresponding grooves on the inner sleeve. The grooves are positioned so as to correspond to the two desired positions of the flapper. The collet will only disengage from the inner sleeve when an appropriate snap-out force is exerted by the shifting tool such that the collet normally maintains the flapper in a fixed, locked position.

Preferably, the scoophead/diverter system is run into the wellbore using a novel scoophead running tool. This running tool allows circulation through its inside diameter, and has internal pressure integrity to test any seals below the running tool prior to releasing the scoophead. This run-in tool incudes a mounting head from which extends a running stump and a housing (or connecting mandrel). The running stump and housing are mutually parallel and are sized and configured to be respectively received in the large and small diameter bores in the scoophead. The scoophead running tool thus allows torque to be transmitted about the centerline of the scoophead assembly in spite of being attached into one of the offset bores. This torque transmission is accomplished by connecting the connecting mandrel between the running tool and scoophead at the same offset as the large bore of the scoophead. This transfer of torque is important in order to reliably manipulate the scoophead assembly with the running string.

The connecting mandrel of the running tool has an internal bypass sleeve that opens at a predetermined pressure that allows a tripping ball to be circulated down to its seat if the scoophead is to be run and anchored into a closed system. This is necessary when having to hydraulically manipulate other equipment (which mandates a closed system) downhole prior to installing the scoophead. Once the bypass sleeve is shifted to allow circulation, the circulation can only continue until the ball is seated. At that time, circulation ports are closed off from above, and the resultant increased tubing pressure will release the running tool.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES:

FIGS. 18-A and 18B are cross-sectional elevation views along the lines 18A—18A and 18B—18B, respectively of FIG. 18;

DESCRIPTION OF THE PREFERRED EMBODIMENT

In accordance with the present invention, various embodiments and methods and devices for completing lateral, branch or horizontal wells which extend from a single primary wellbore, and more particularly for completing multiple wells extending from a single generally vertical wellbore (multilaterals) are described. It will be appreciated that although the terms primary, vertical, deviated, horizontal, branch and lateral are used herein for convenience, those skilled in the art will recognize that the devices and methods with various embodiments of the present invention may be employed with respect to wells which extend in directions other than generally vertical or horizontal. For example, the primary wellbore may be vertical, inclined or even horizontal. Therefore, in general, the substantially vertical well will sometimes be referred to as the primary well and the wellbores which extend laterally or generally laterally from the primary wellbore may be referred to as the branch wellbores.

Figure 2A:
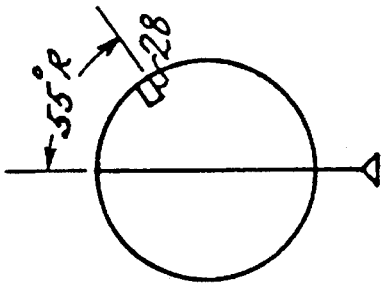
FIGS. 1–9B are sequential cross-sectional elevational views depicting a method for multilateral completion using a whipstock/packer assembly and a selective re-entry tool.
Figure 1:
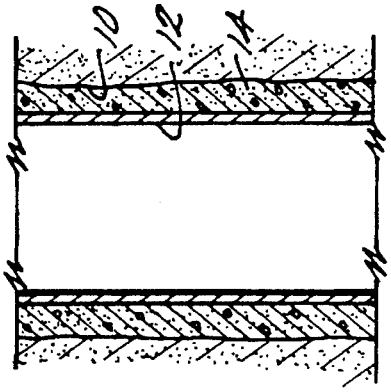
Figure 2:
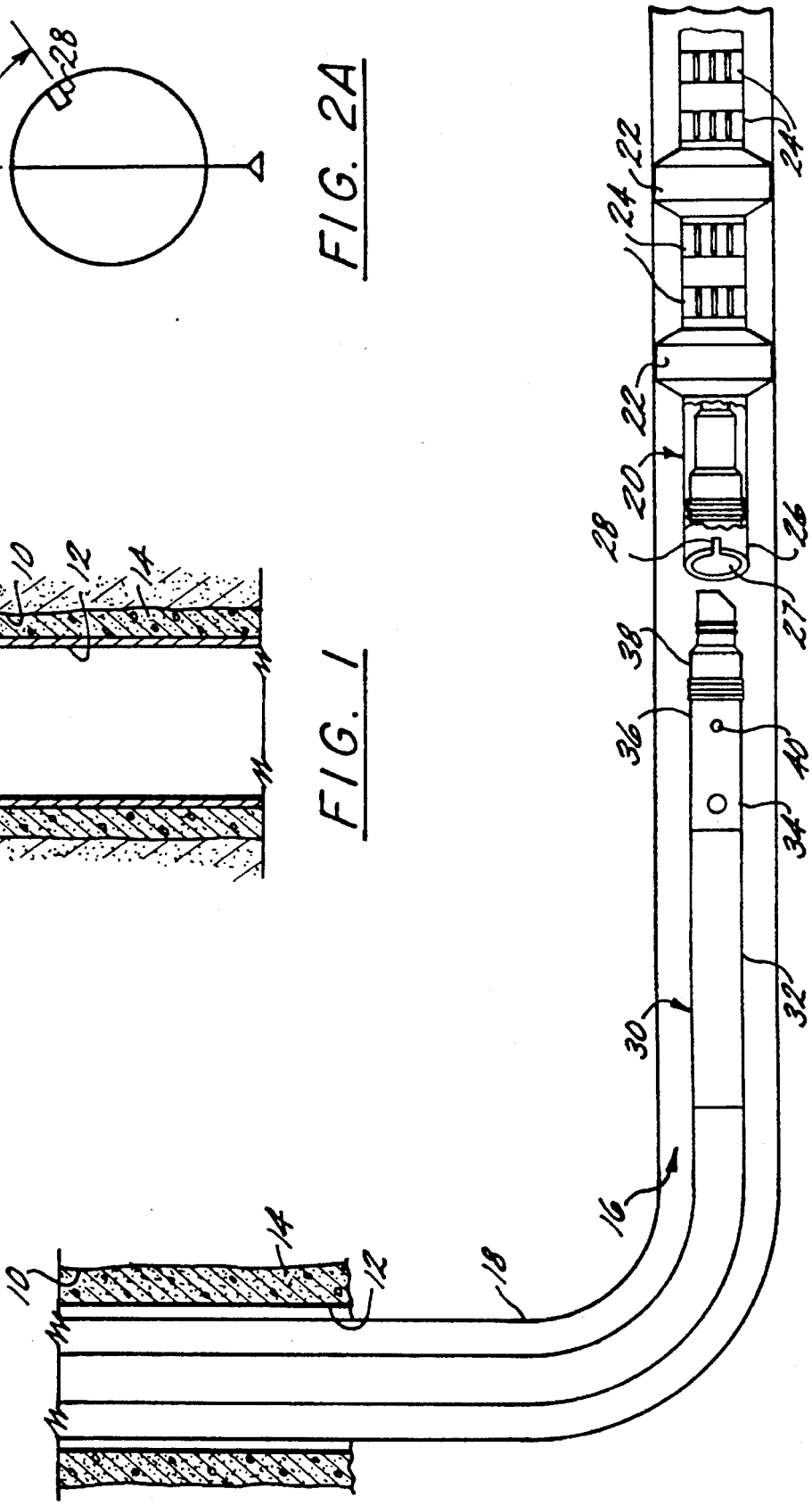

Referring now to FIG. 1, a vertical wellbore 10 has been drilled and a casing 12 has been inserted therein in a known manner using cement 14 to define a cemented well casing. As shown in FIGS. 2 and 2A, a first lateral well 16 is drilled and completed in a known manner using a liner 18 which, for example, attaches to the casing 12 by a suitable liner hanger (not shown).

A string 20 including one or more external casing packers 22 are run into the lateral well 16 through means of a running tool (not shown). It will be appreciated that any number of external casing packers 22 may be employed depending upon bore hole parameters. The external casing packers 22 are preferably those manufactured and sold by the assignee of the present invention. The external casing packers 22 are inflatable and function to, among other things, block fluid and gas migration.

Located on the string 20 and disposed between the external casing packers 22 are sliding sleeves 24 which are provided, it will be appreciated, for opening and closing communication with one or more producing zones.

String 20 also includes a packer bore receptacle 26 disposed uphole of the external casing packers 22 which is run within the lateral well 16 to a location at which it is desired to drill an additional well. The packer bore receptacle 26 is employed for, among other things, releasably engaging a variety of tools required for drilling additional lateral wells. The packer bore receptacle 26, is preferably manufactured and sold by the assignee of the present invention and includes a receiving portion 27 and a key slot 28. It will be appreciated that the key slot 28 functions as a receptacle for orienting and aligning e.g. a whipstock for ensuring proper directional drilling which will be discussed hereinafter. A preferred and structurally altered packer bore receptacle (also known as a lateral connector receptacle or LCR) is described in detail with reference to FIGS. 13, 14 and 15A–B. As will be described in detail hereinafter, the novel lateral connector receptacle acts as a mechanism for running in the lower completion, orienting the whipstock assembly and scoophead/diverter assembly and providing an interface between the lower and upper completions.

Figure 3:
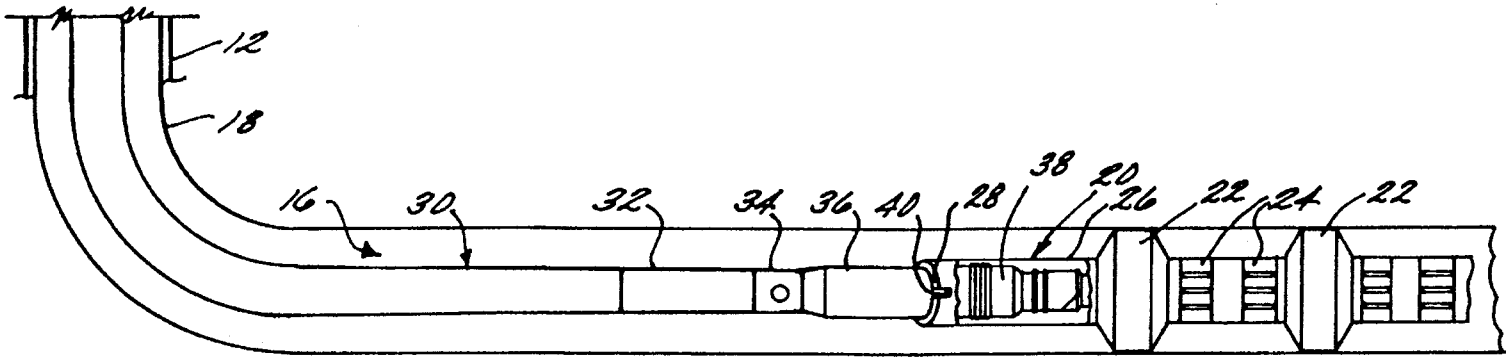

Next, a profile key sub 30 is run into the lateral well 16 to ascertain the orientation of the key slot 28. The profile key sub 30, it will be appreciated, includes a measurement-while-drilling apparatus 32, a circulating sub 34 and a dummy whipstock anchor 36. The dummy whipstock anchor 36 includes a male portion 38, sized to fit within the receiving portion 27 of the packer bore receptacle 26, and an anchor key 40, dimensioned to mate with the key slot 28. A preferred anchor 26 is depicted at 176 in FIG. 13 and will be described in detail hereinafter. As shown in FIG. 3, the male portion 38 is slid within receiving portion 27 and the anchor key 40 of the dummy whipstock anchor 36 is inserted into the key slot 28. The profile key sub 30 uses the measurement-while-drilling apparatus 32 for determining the radial direction of the key slot 28 (as best shown in FIG. 2A) and communicating that information to the surface.

Figure 4:
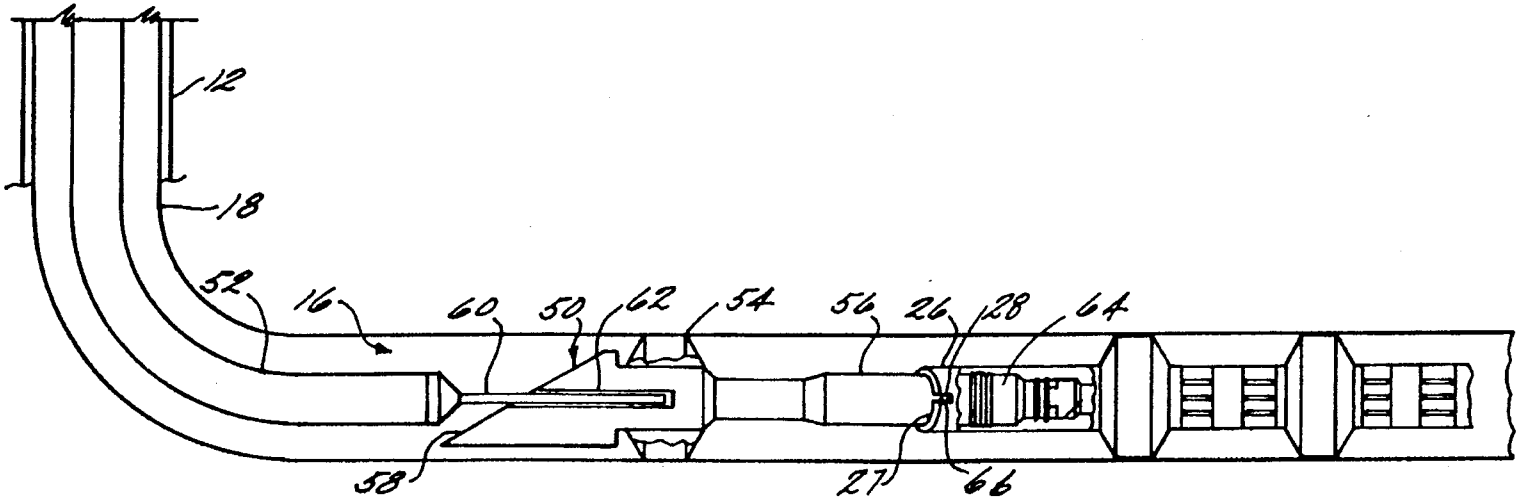

Turning now to FIG. 4, after the key slot 28 alignment profile is determined by the MWD technique, a retrievable whipstock assembly 50 is run into the lateral well 16 by a running tool 52. The whipstock assembly 50 preferably includes a production injection packer assembly 54, an anchor 56 (also known as inflatable anchor) and an angled outer surface 58. The production injection packer assembly 54, as is well known, may be inflated by a fluid for affixing the whipstock assembly 50 within the bore of the lateral well 16 once the anchor 56 is mated with the packer bore receptacle 26. The running tool 52 includes an elongated nose portion 60 which may be releasably latched to a slot 62 disposed through the outer surface 58 of the whipstock assembly 50. The anchor 56 includes a male portion 64 and an anchor key 66 which are also both dimensioned to engage the receiving portion 27 and key slot 28 of the packer bore receptacle 26. The outer surface 58 of the whipstock assembly 50 provides a surface angle to facilitate the drilling of an additional lateral well which will be described next. A preferred retrievable whipstock assembly is disclosed in U.S. patent application Ser. No. 08/186,267 filed Jan. 25, 1994, entitled "Retrievable Whipstock Packer Assembly" invented by Daniel E. Dinhoble (Attorney Docket No. 93-1441), which is assigned to the assignee hereof and incorporated herein by reference.

Figure 5:
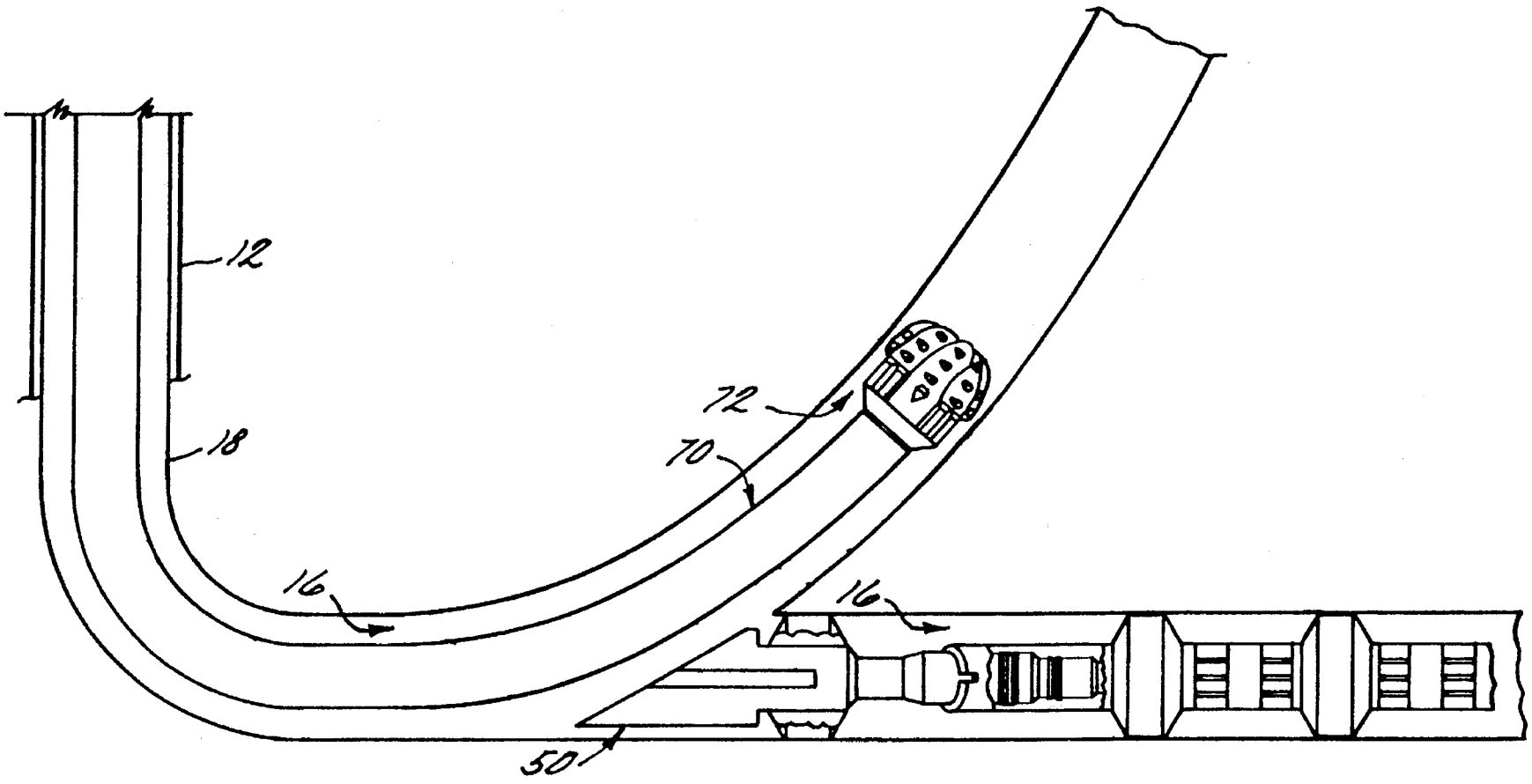

As depicted in FIG. 5, after the running tool 52 is released from the whipstock assembly 50, a window may be milled (not shown) in the bore of lateral well 16. Thereafter, a suitable and known drill 70, may be employed to bore a second lateral well 72 which communicates with the first lateral well 16.

Figure 6A:
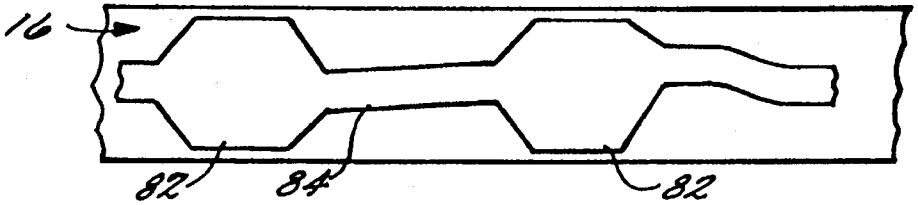
Figure 6:
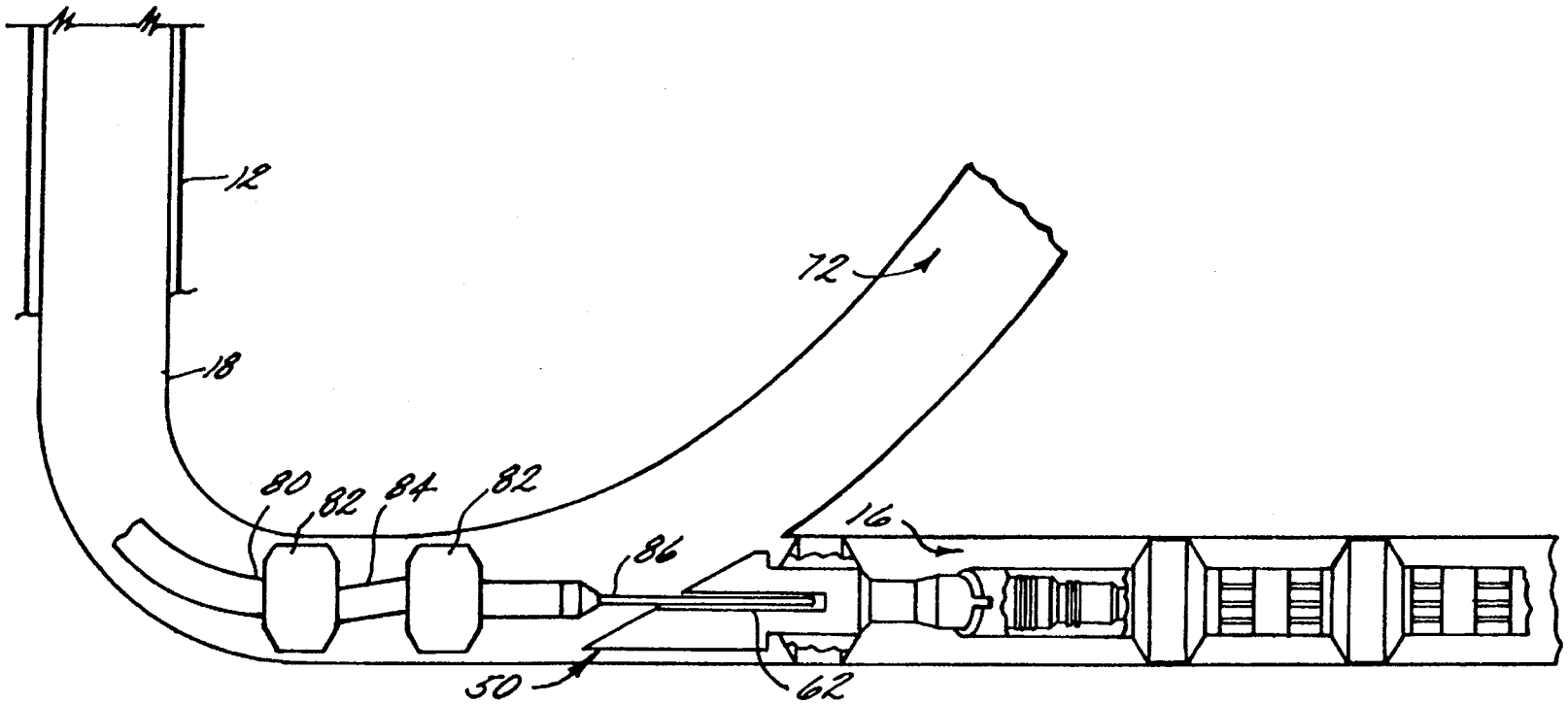

After drilling of the second lateral well 72 is complete, the drill 70 is removed as shown in FIG. 6 and a retrieving tool 80 is run down the primary well 10 and into the first lateral well 16. The retrieving tool 80 includes a pair of centralizers 82, which are interconnected by a connector 84, and an elongated nose portion 86 which is sized and shaped similarly to nose portion 60 of the running tool 52. The nose portion 86 is releasably latched to the slot 62 of the whipstock assembly 50 for the removal of same. The centralizers 82 are provided for centering the nose portion 86 within the well bore 16 for engagement with the whipstock assembly 50. Connector 84 is located between the centralizers 82 at an acute angle which compensates for the increased volume at the juncture of well bore 16 and well bore 72 (see FIG. 6A). The retrieving tool 80 is thereafter removed taking with it the whipstock assembly 50. It will be appreciated that a preferred retrieving tool is disclosed in aforementioned U.S. Ser. No. 081,86,267 filed Jan. 25, 1994.

Figure 7:
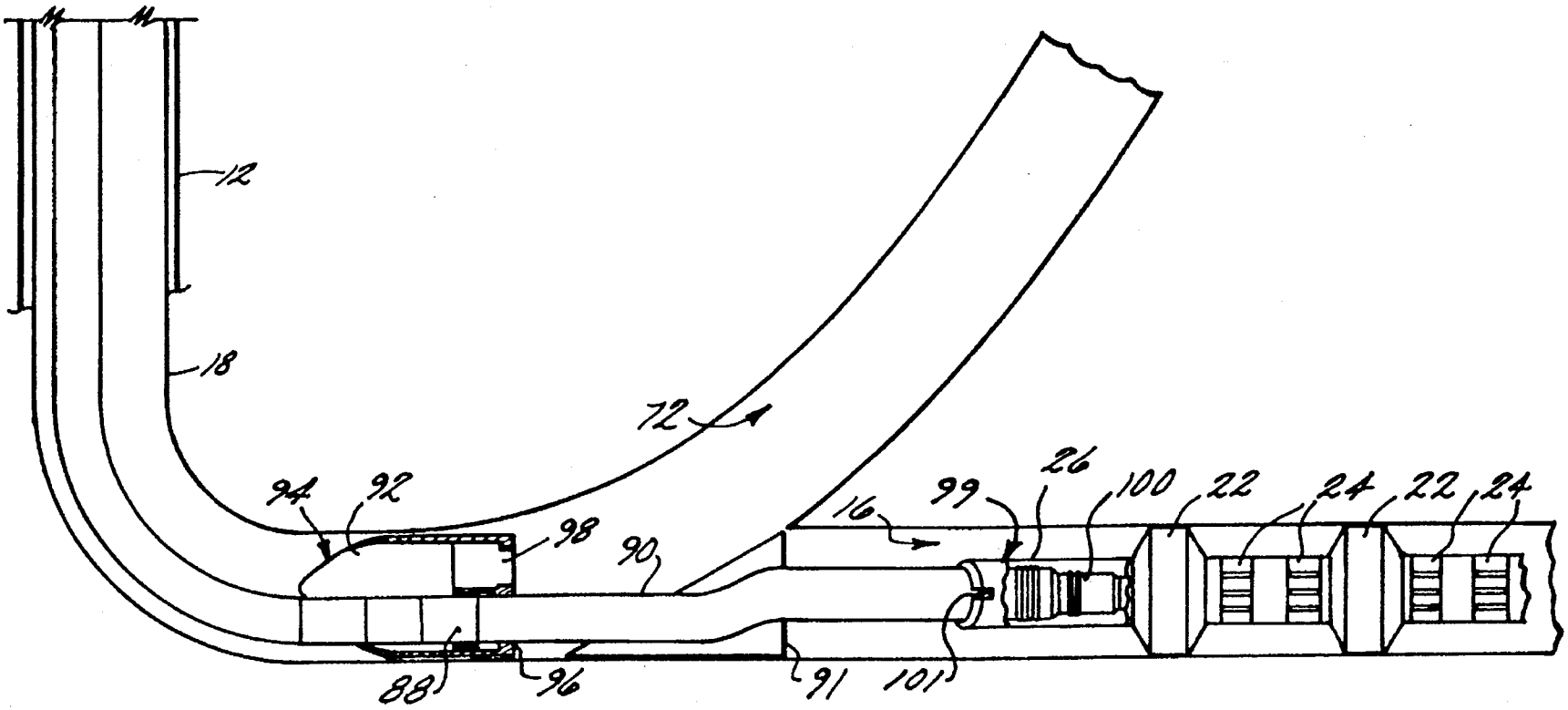

Next, referring to FIG. 7, a scoophead running tool 88 is run into the well bore 16. Connected to the scoophead running tool 88 is a tubular section 90 which is, in turn, mounted to a diverter 91 and scoophead assembly 92 (see also FIG. 9A). The scoophead assembly has an input opening 94, a first output opening 96 and a second output opening 98. Tubular section 90 includes an anchor 99 having a male portion 100 and a key 101 which mate with the packer bore receptacle 26 as previously described. The scoophead assembly 92 is oriented so that once the anchor 99 is mated with the packer bore assembly 26, the second output opening 98 is disposed in communication with the second lateral well 72. After placing the scoophead and diverter assembly 92 in the proper position, the running tool 88 may then be retrieved. A preferred scoophead/diverter assembly is shown and described in detail hereinafter with regard to FIGS. 16–20. A preferred running tool 88 is also described in detail hereinafter with regard to FIGS. 29–32.

Figure 8:
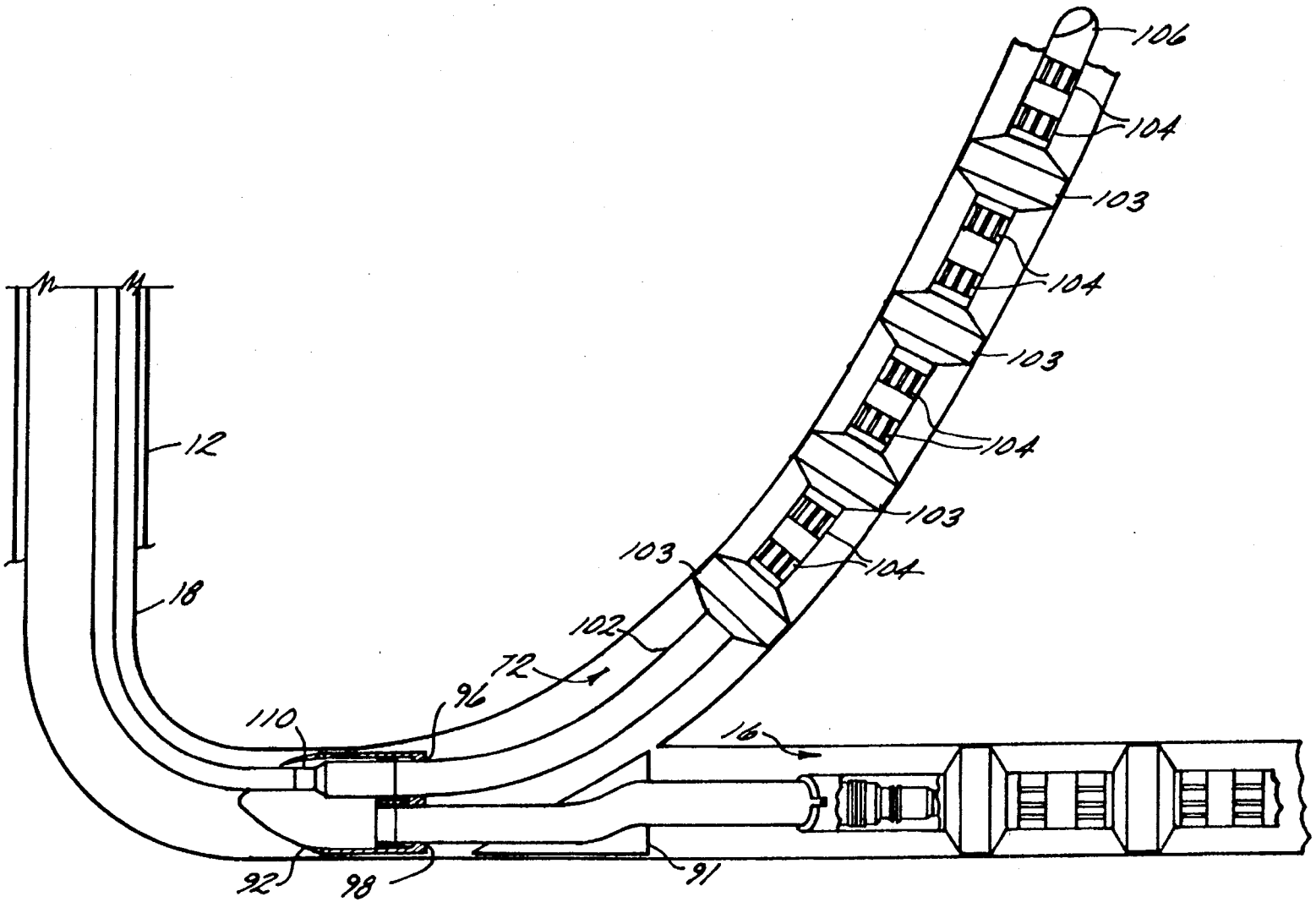

At this time, as illustrated in FIG. 8, a second string 102, including at least one external casing packer 103, at least a pair of sliding sleeves 104 and a tip end 106, may be run into the second lateral well 72. This is accomplished by running tool 110 which moves the second string 102 through the primary well bore 10 and then into the assembly 92. It will be appreciated that the tip end 106 is shaped to engage and deflect from the diverter 91 wherein the second string 110 will be forced into the second lateral well 72. Both the external casing packers 103 and the sliding sleeves 104 are preferably those which have been previously described. Once the second string 110 is in place within the second lateral well 72, the packers 103 are inflated, as previously described, and the running tool 110 is then removed.

Figures 9, 9A, 9B:
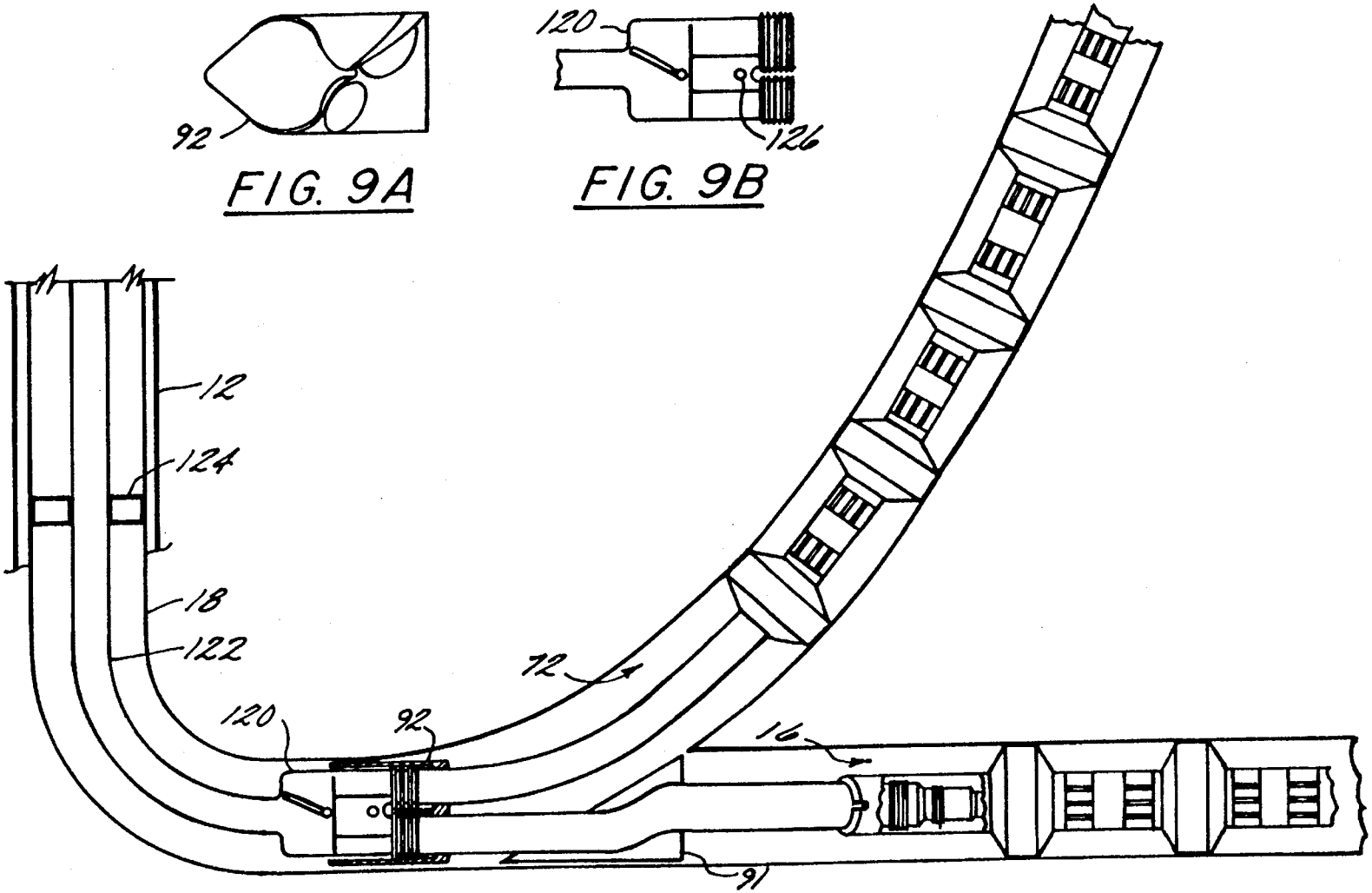

In accordance with an important feature of the present invention and referring to FIGS. 9 and 9B, a selective re-entry assembly 120 is mounted to the diverter and scoop assembly 92 and a single production tubing string 122 extends from the latter and is tied back to the surface to, for example, to a standard well-head (not shown). The production tubing string 122 includes a packer 124, the function of which, is known. The selective re-entry assembly 120 includes a locator key 126 for orientation with the scoophead assembly 92. The re-entry assembly 120 functions to either maintain access from the surface to the first lateral 16 or to permit access to the second lateral well 72.

Figure 11:
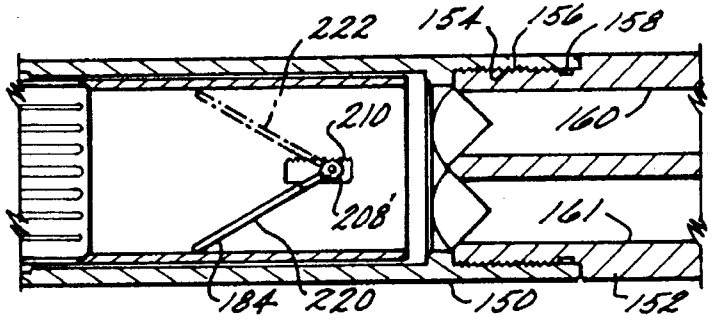
FIG. 11 is a top view, in cross-section, of the device of FIG. 10.
Figure 10:
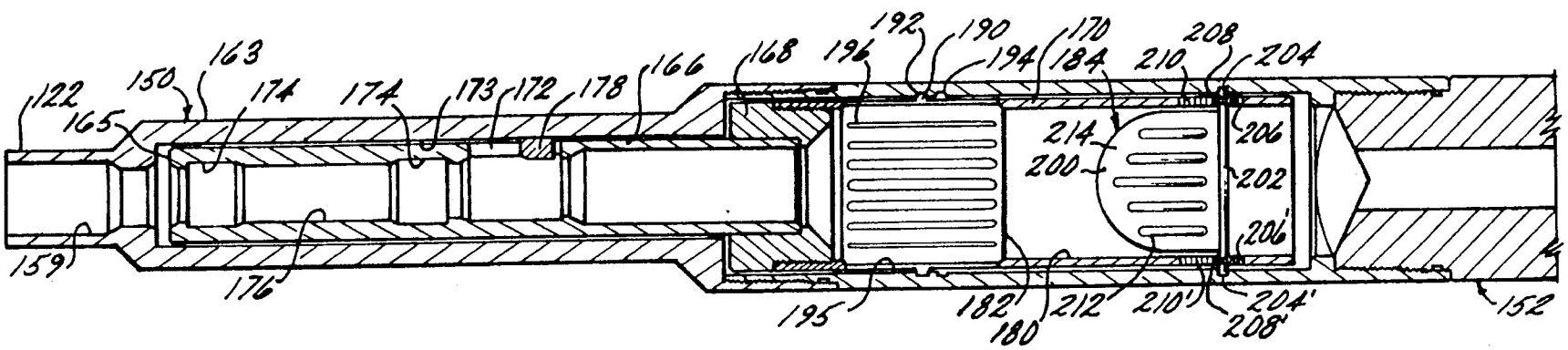
FIG. 10 is a side view, in cross-section, of a selective re-entry tool in accordance with a first embodiment of the present invention.

Referring now to FIGS. 10 and 11, a novel selective re-entry assembly 120 is provided which includes an input housing 150 which is connected to an output housing 152. The output housing 152 includes a male portion 154 having threads 156 and a seal 158 for mounting to the input housing 150. A pair of laterally spaced parallel bores 160 and 161 are disposed axially through the output housing 152. Bores 160 and 161 communicate with first output opening 96 and second output opening 98 of the diverter and scoophead assembly 92.

The input housing 150 includes an input bore 159 which is connected to the single production tubing string 122 by e.g. threads (not shown) and has a collar 163 defining a generally stepped shape. Disposed within collar 163 is a slidable tubular section 165 which comprises an uphole tubular slide 166, a coupling 168 and a downhole tubular slide 170. The uphole slide 166 may be formed of any suitable substance such as a steel alloy and includes an alignment slot 172, a pair of engagement grooves 174 and a central bore 176. The alignment slot 172 is shaped to receive a protrusion 178 which extends from the inner surface 173 of collar 163. It will be appreciated that the engagement grooves 174 function to receive keys (not shown) of an actuator (not shown) such as the HB-2 Shift Tool, manufactured by the assignee hereof, which may be mounted to the down hole end of a coil string, a standard threaded tubing section or the like.

Couple 168 is preferably threadably connected between the uphole slide 166 and the downhole slide 170 and is also preferably formed of steel.

The downhole slide 170 includes a central bore 180, a positioning collar 182 and a diversion flapper 184. Central bore 180 is of a substantially larger inner diameter than the inner diameter of central bore 176 of uphole slide 166 to provide for communication between input bore 159 and either of the bores 160 or 161 of the output housing 152. The positioning collar 182 is employed to facilitate a snaplockedly engaged, two position placement of the tubular section 165. A first position for providing communication between input bore 159 of the input housing 150 and bore 161 of the output housing 152 and a second position for communication with bore 160. To facilitate this two position feature, the positioning collar 182 is preferably generally thin in cross-section and formed of a resilient material, e.g. a steel alloy. The positioning collar 182 is also cylindrical in shape and includes an annular protrusion 190 which engages either of a pair of annular grooves 192 and 194 disposed on an inner surface 196 of collar 164. The annular protrusion 190 includes chamfered edges (not numbered) which function to provide the snaplock movement from one annular groove to the other during movement of the tubular section 165. Flow slots 196 are preferably also employed on positioning collar 182.

The diversion flapper 184 is preferably formed of a suitably strong material such as steel and is centrally mounted within bore 180. The diversion flapper 184 includes a plate 200 which extends radially from a pin 202. Each of the outer ends 204 and 204' of pin 202 extend through a pair of slots 206 and 206' in the downhole tubular slide 170 and are rotatably mounted to the collar 164. Pin 202 is disposed at a sufficient distance from bores 160 and 161 of the output housing 152. A pair of gears 208 and 208' are disposed on the pin 202 and engage teeth 210 and 210' disposed within slots 206 and 206'. Flow slots 212 are disposed through plate 200. In operation, the tubular section 165 is slid within input housing 150 as previously discussed causing gears 208 and 208' to rotate, which in turn causes plate 200 to move from, e.g., a position 220 to a position 222 thereby providing communication from bore 159 to either bore 160 or 161.

Figure 12:
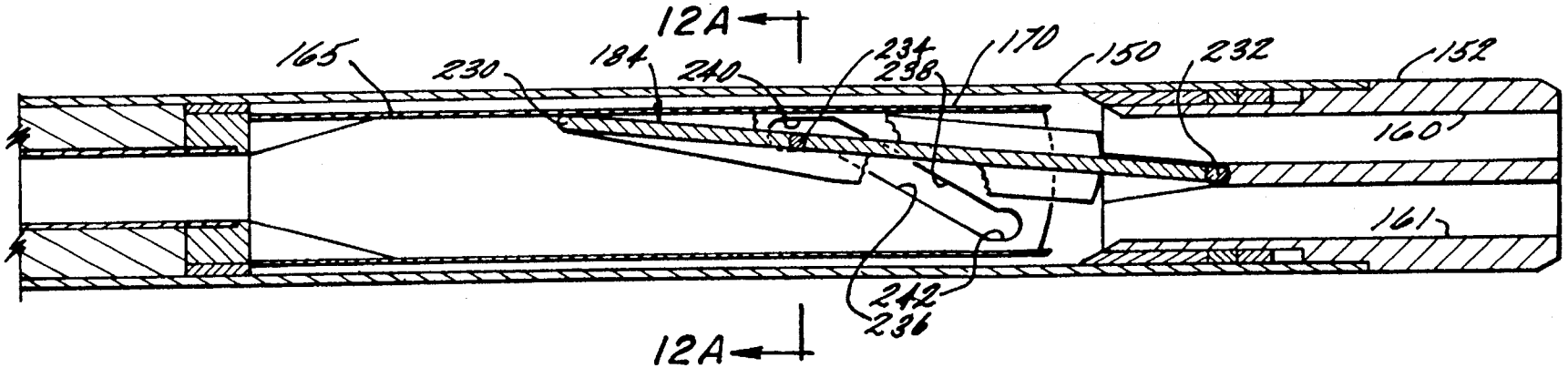
FIG. 12 is top view, in cross-section, of an embodiment of a diversion flapper in accordance with the present invention.
Figure 12A:
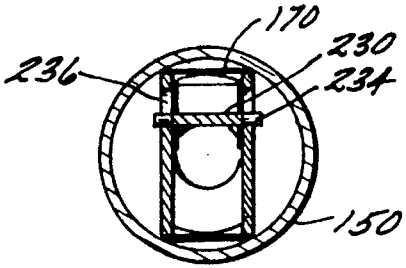
FIG. 12A is a cross-sectional elevation view along the line 12A—12A of FIG. 12.

FIGS. 12 and 12A depicts a preferred embodiment of the diversion flapper 184 in accordance with the present invention. In this embodiment, the diversion flapper 184 includes a plate 230 extending from a pin 232. The pin 232 is pivotably mounted to the output housing 152. A pair of lugs 234 extend outwardly form opposing lateral edges of the plate 230 through a pair of slots 236 disposed opposing sides of the downhole tubular slide 170. Each of the slots 236 include an angled portion 238 and two flat portions 240 and 242. Upon movement of the slidable tubular section 165, lugs 234 slide through slots 236 to rotate the plate 230 for providing selective communication with either bore 160 or 161 (FIG. 10).

It will be appreciated that an even more preferred embodiment of the selective re-entry tool is described in detail hereinafter with reference to FIGS. 25–28.

Preferably, the foregoing method of completing multilateral wells utilizes a variety of tools having preferred constructions which will now be discussed in detail. In some instances, these preferred constructions are slightly different than the constructions of the analogous tools in the foregoing method described above and in this regard, the methodology of the foregoing method is also slightly altered to use the preferred tool constructions. In particular, a detailed description will now be made for preferred constructions of a lateral connector receptacle, a scoophead assembly, a liner tie back tool, a parallel seal assembly, a scoophead running tool and a selective re-entry tool. In some instances, the following detailed description will make reference to FIGS. 13A–C which are cross-sectional assembly views showing the preferred constructions of each tool in an assembled unit downhole.

Turning now to FIGS. 13–15A–C, a preferred construction for a lateral connector receptacle (shown generally at 250 in FIG. 14) will now be described. It will be appreciated that LCR 250 is functionally similar to the packer bore receptacle 26; however, as will be discussed, LCR 250 has several important differences and advantageous improvements. LCR 250 has at least three primary functions including (1) providing a means for running the lower completion into the well; (2) providing a means for orienting the retrievable whipstock and scoophead assemblies; and (3) providing a means for attaching the upper completion to the lower completion. A secondary function of LCR 250 includes the ability to maintain the orientation between respective lateral completions in the event that such lateral completions are stacked within the wellbore of one well.

Figure 14:
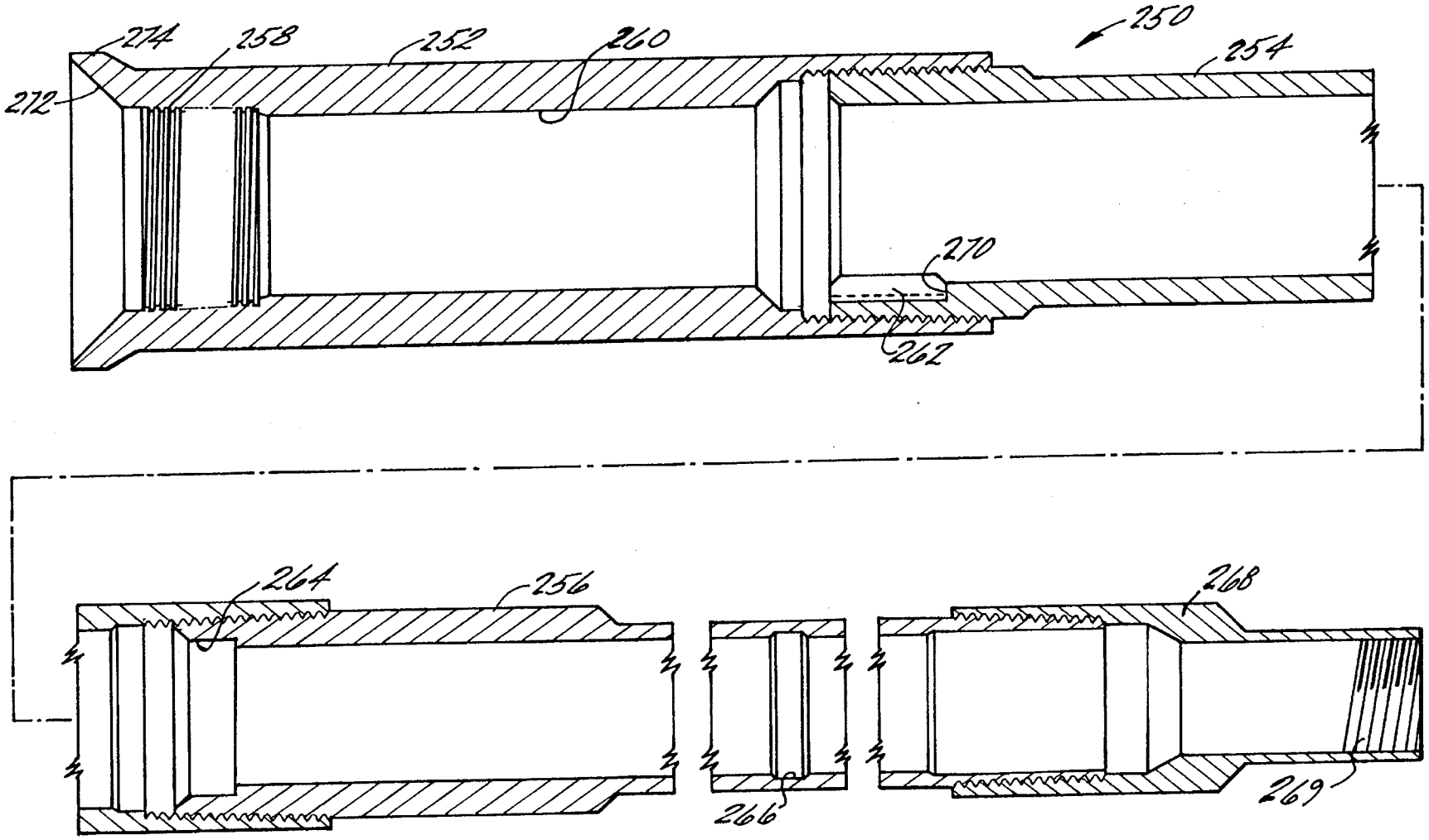
FIG. 14 is a cross-sectional elevation view of a lateral connector receptacle or LCR in accordance with the present invention.

Turning specifically to FIG. 14, LCR 250 includes three primary structural features (which may be arranged in any order). A first feature includes a profile for engaging a running tool, a second feature includes an orientation lug to orient either the whipstock assembly or scoophead/diverter assembly and a third structural feature includes a latched thread and seal bore to anchor and seal, respectively. A combination of these features into a single tool enables LCR 250 to provide a novel service and it allows for the ability to stack infinite laterals in a single well. With each lateral completed, LCR 250 is the connecting device for the diversion equipment (e.g., scoophead/diverter assembly) at the Y juncture of the lateral as discussed in the aforementioned method and as will be discussed in more detail below. While LCR 250 may comprise a single or one piece tool housing, from a manufacturing standpoint, LCR 250 preferably comprises three graduated (e.g., decreasing outer diameters) cylinders 252, 254 and 256 which are threaded together with premium connections. In a preferred embodiment, the interior diameters of cylinders 252 and 254 are substantially equal (e.g., 4.75 inches) while the interior diameter of cylinder 256 is smaller (e.g., 3.675 inches). Upper cylinder 252 has an internal threaded entry 258 for receiving an anchor latch as will be discussed hereinafter. Downstream from threaded section 258 is a smooth seal bore surface 260 for receiving seals on the anchor latch. Top cylinder 252 also has an integral guide ring 272 to ease entry to the seal bore during stab-in, and an upset outer diameter to keep the LCR 250 centralized in the wellbore.

Threaded to top cylinder 252 is the orientation sub 254. Sub 254 has an orienting lug 262 extending outwardly and radially into the inner diameter of orientation sub 254. Orientation lug 262 is approximately rectangular in cross-section and, as will be discussed hereinafter, mates with a slot in the anchor latch. Lug 262 is mounted in a milled slot 270 set in a counter bore of the premium end thread. This allows a non-pressure containing weldment for the lug that does not interfere with the effectiveness of the premium connection. Downhole from orientation sub 254 and threaded thereto is connecting sub 256. Connecting sub 256 includes a pair of spaced profiles 264 and 266 which are sized and positioned to mate with an appropriate running tool which is preferably the HR liner running tool manufactured and sold by Baker Oil Tools and shown generally at 372 in FIG. 22. Preferably, a bottom sub 268 is threadably attached to the lower most end of connecting sub 256. Bottom sub 268 includes internal threading 269 for connecting the LCR 250 to the lower completion (such as shown at 22 and 24 in FIG. 2). Bottom sub has a smaller overall inner and outer diameter than the preceding subs, the inner diameter preferably being 2.992 inches. As is clear from the foregoing, preferably the several cylinders 252, 254 and 256 are oriented such that the running tool profile 264, 266 is in the bottom of the tool while the orienting lug is in the middle and the latch thread and seal bore is in the top of the tool.

Figures 13A, 13B:
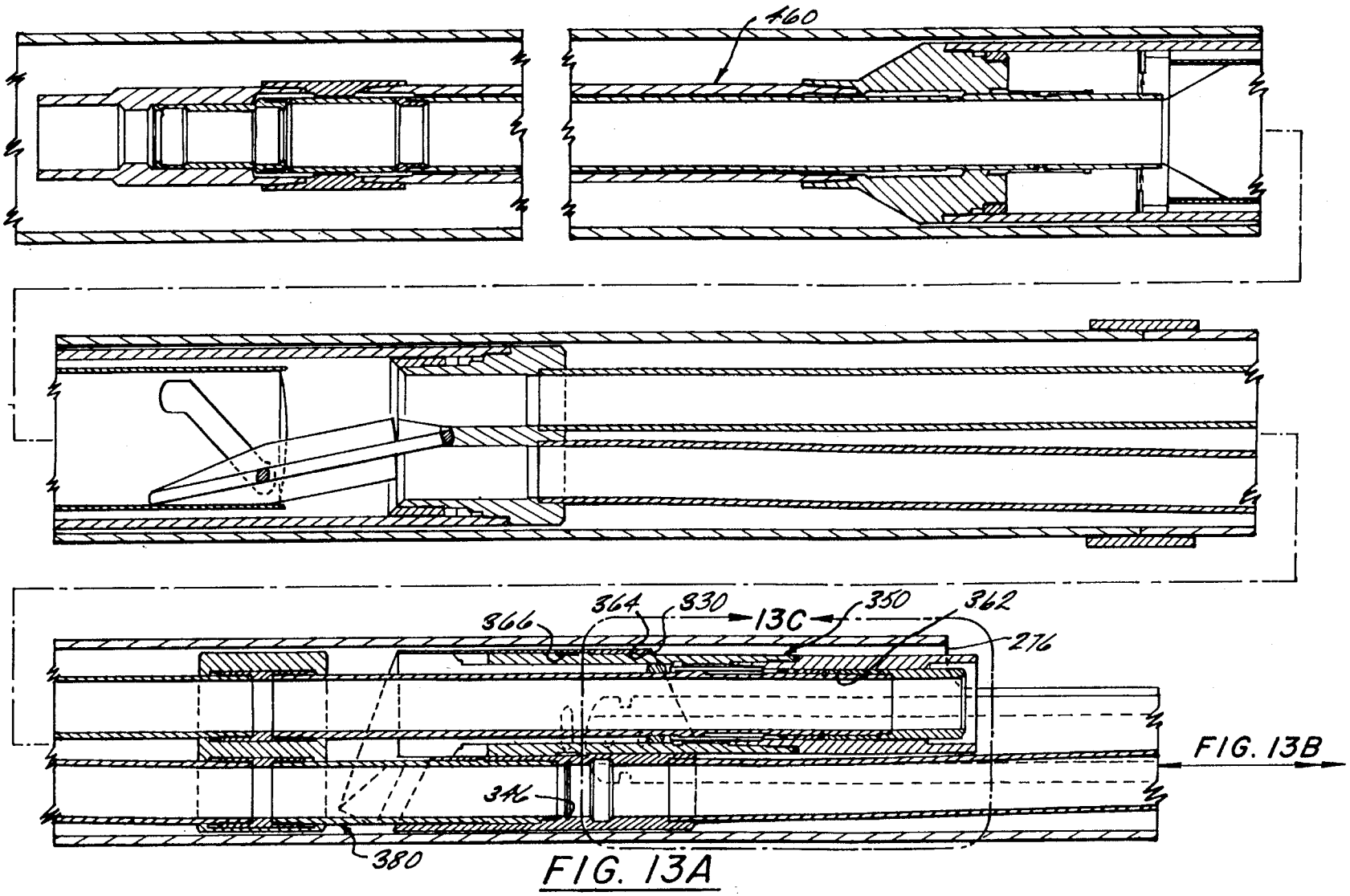
FIGS. 13A and 13B are cross-sectional elevation views of a downhole completion assembly for completing multilateral wells in accordance with a preferred embodiment of the present invention.
Figure 15A:
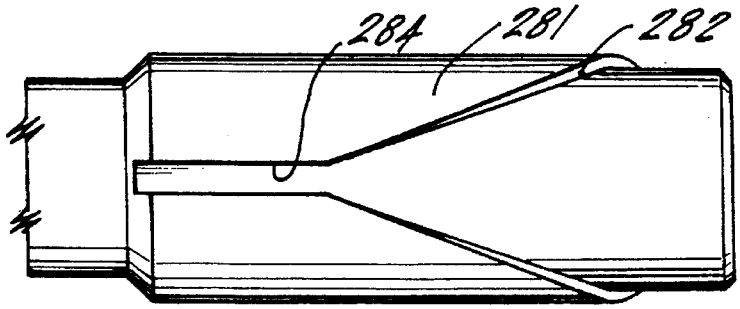
FIGS. 15A, B and C are respective top, side and bottom views of a portion of the orienting anchor sub.
Figure 15B:
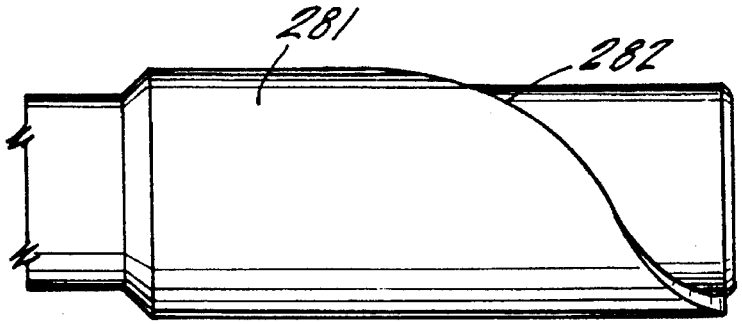
Figure 15C:
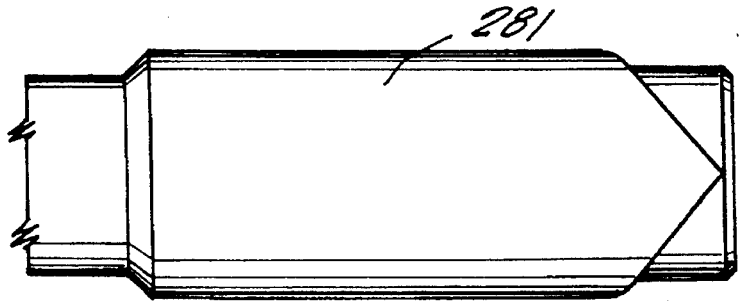
Figure 16:
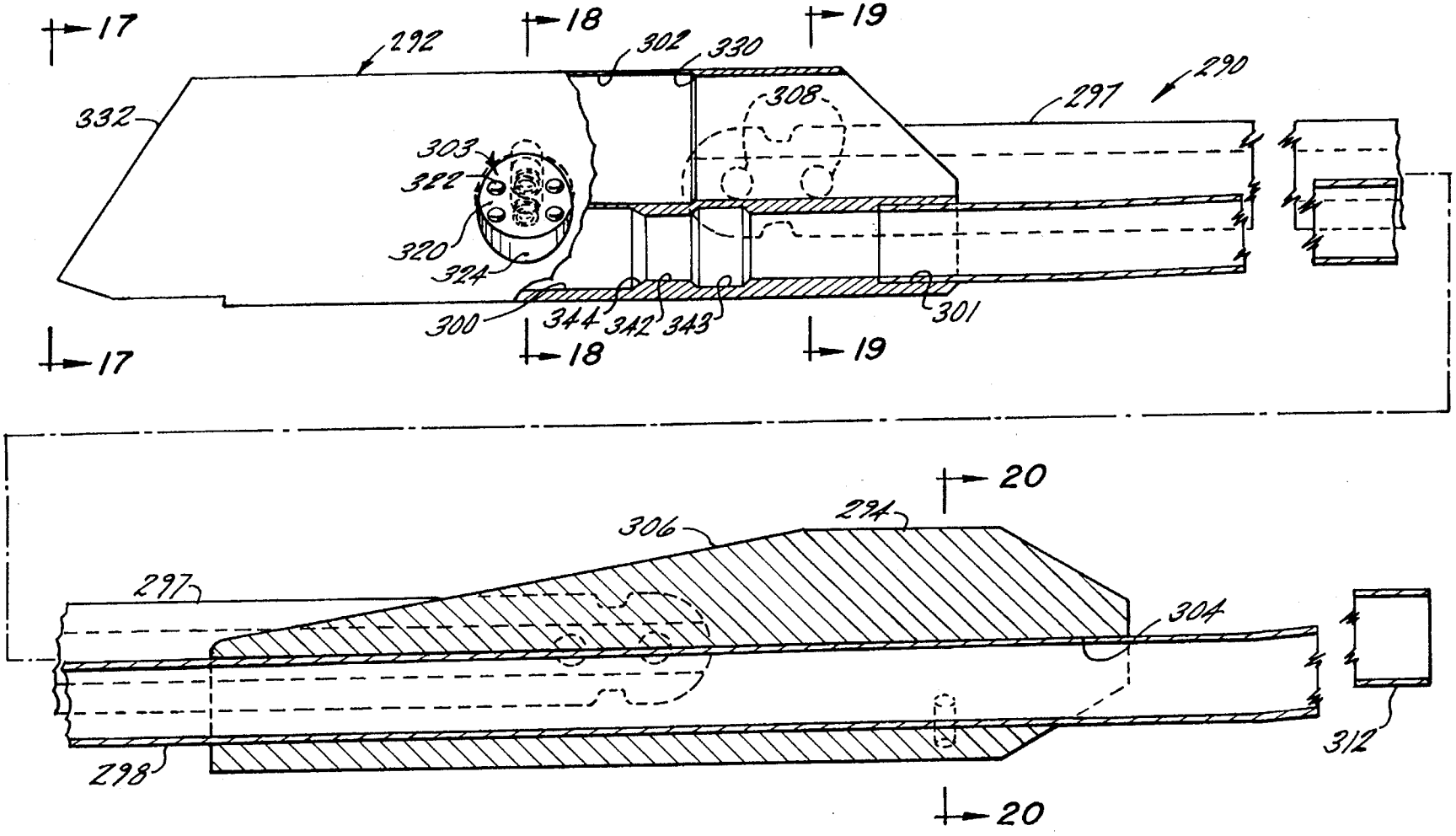
FIG. 16 is a side elevation view of a scoophead/diverter assembly in accordance with the present invention.
Figure 19:
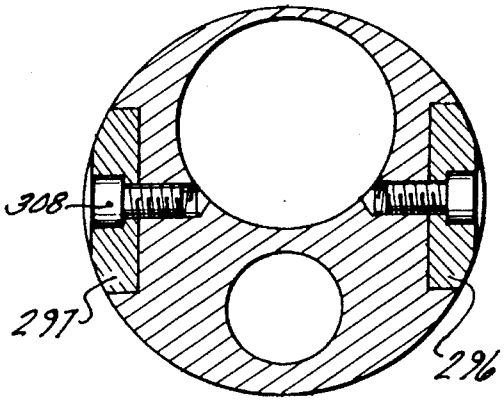
FIGS. 18–20 are cross-sectional elevation views along the lines 18—18, 19—19 and 20—20, respectively of FIG. 16.

Turning now to FIG. 13B and 15A–C, LCR 250 is shown attached to orientation anchor 276. It will be appreciated that orientation anchor 276 is the preferred construction for the dummy whipstock anchor 36 shown in FIGS. 2 and 3. In FIG. 13B, seals 278 from anchor 276 are shown in sealing engagement with seal bore 260 of LCR 250. Orientation anchor 276 includes a centralizer anchoring device 279 from which extends an outer housing 280. Outer housing 280 supports the seals 278 and houses the splined mandrel 281 as shown in FIGS. 15A–C. The splined mandrel has a V-shaped section which progressively diverges towards an apex from which a longitudinal slot 284 extends.

Orientation anchor 276 is attached either to the retrievable whipstock assembly or to the scoophead/diverter assembly as discussed above and mates with LCR 250. In FIG. 13B, the scoophead/diverter assembly is shown having orientation anchor 276 attached thereto and being mated to LCR 250. It will be appreciated that when orientation anchor 276 is stabbed into the borehole, V-shaped surface 282 on spline mandrel 281 will eventually contact orientation lug 262 which will ride along the progressively diverging V-shaped walls until it engages with and enters slot 284. When orientation lug 262 reaches the end of slot 284, then it is clear at the surface that either the retrievable whipstock assembly or the scoophead/diverter assembly has been appropriately positioned and oriented within the borehole. LCR 250 thus acts as a fixed reference point for use with both the whipstock and the scoophead systems and acts to orient and precisely locate all of the completion system and specifically a second lateral completed above the first lateral. It will be appreciated that in a single secondary lateral open hole completion, there would be a requirement for two LCR's. A first LCR would be run at the top of the primary wellbore completion for the scoophead and diverter assembly to orient and seal into while the second LCR would be run above the selective re-entry tool to seal into with the final production tubing to the surface. In a cased hole completion, only one LCR is required, as the whipstock packer assembly would provide the orientation for the whipstock and scoophead/diverter assembly.

Turning now to FIGS. 16–20, a preferred embodiment for a scoophead/diverter assembly will now be described. The scoophead/diverter assembly is shown generally at 290 and includes a scoophead 292, a diverter sub 294, a pair of connecting struts 296 and 297 which interconnect scoophead 292 to diverter sub 294 and a length of production tubing 298 which communicates between scoophead 292 and diverter sub 294. Scoophead 292 preferably comprises a single piece of machined metal (steel) having spaced longitudinal bores 300, 302 of different diameters. Larger bore 302 is a receptacle for a liner tie back sleeve 350 shown in FIGS. 13A–B and eventually communicates to the top of the lateral wellbore string. The smaller bore 300 is a seal bore to tie the primary wellbore back to the surface. Below scoophead 292, a joint of tubing 298 is threaded to small bore 300 preferably with a premium connection 301. Tubing 198 passes through angled smooth bore 304 of diverter sub 294 which causes the tubing joint 298 to deflect from the offset of the small bore of scoophead 292 back to the center line of the scoophead; and thus the center line of the borehole with which it is concentric. It will be appreciated that taking the offset through the length of a tubing joint 298 (typically 30 feet) allows for a gradual bend which will not restrict the passage of wireline or through tubing tools for later remedial and stimulation work.

Diverter sub 294 also preferably comprises a single piece of machined metal (steel) and along with the axial bore 304 includes an angled diverting surface 306 for diverting the lateral wellbore string into the lateral wellbore as will be discussed hereinafter. As mentioned, scoophead 292 and diverter sub 294 are interconnected by a pair of parallel, spaced struts 296, 297 which are bolted by bolts 308 to scoophead 292 and diverter sub 294 so as to rigidly fix the scoophead and diverter sub both axially and rotationally. By not requiring the diverter sub 294 to be a pressure containing member or a link in the production tubing string, premium connections may be maintained from the scoophead 292 down to the anchoring point of the scoophead and diverter sub assembly. Since the window length (a window being shown at 310 in FIG. 13) to the lateral wellbore entry varies depending on the hole size and build angle of the lateral, the distance between scoophead 292 and diverter sub 294 may be made adjustable by varying the lengths of struts 296, 297. This is an important feature of the present invention since for correct functioning, scoophead 292 and diverter 292 must straddle the lateral exit window from the primary wellbore.

Figure 20:
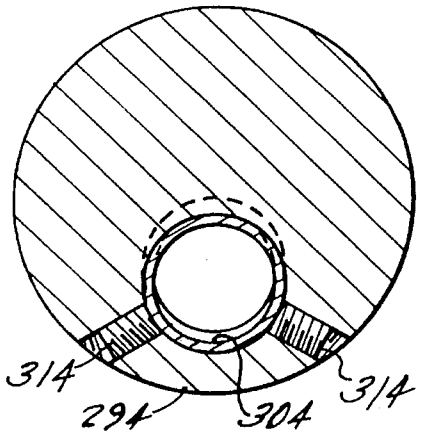

The terminal end 312 of production tubing 298 is coupled to orientation anchor 276 for orientation, positioning and attachment to LCR 250 as shown in FIG. 13B. As will be discussed hereinafter with regard to FIGS. 29–33, a novel scoophead/diverter assembly running tool 510 is used to stab-in assembly 290 into LCR 250. It will be appreciated that production tubing 298 is maintained in rigid contact with diverter sub 294 via a pair of screws 314 as best shown in FIG. 20.

Figure 18:
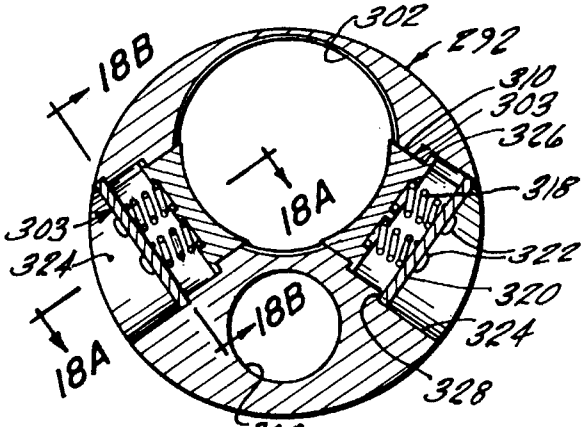
Figure 18B:
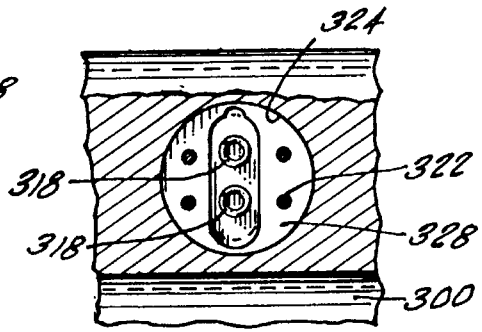
Figure 17:
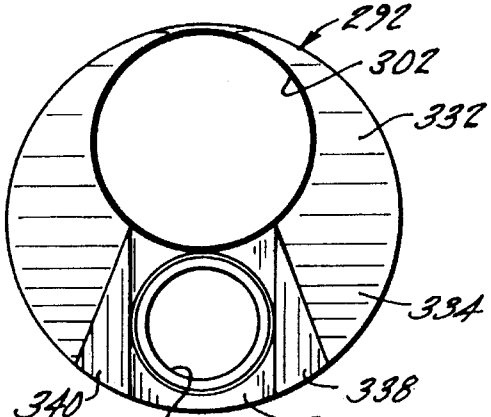
FIG. 17 is a left end view of the scoophead/diverter assembly of FIG. 16.
Figure 18A:
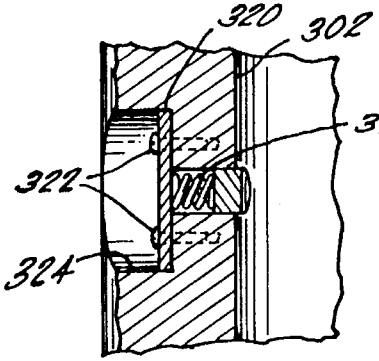
Figure 21:
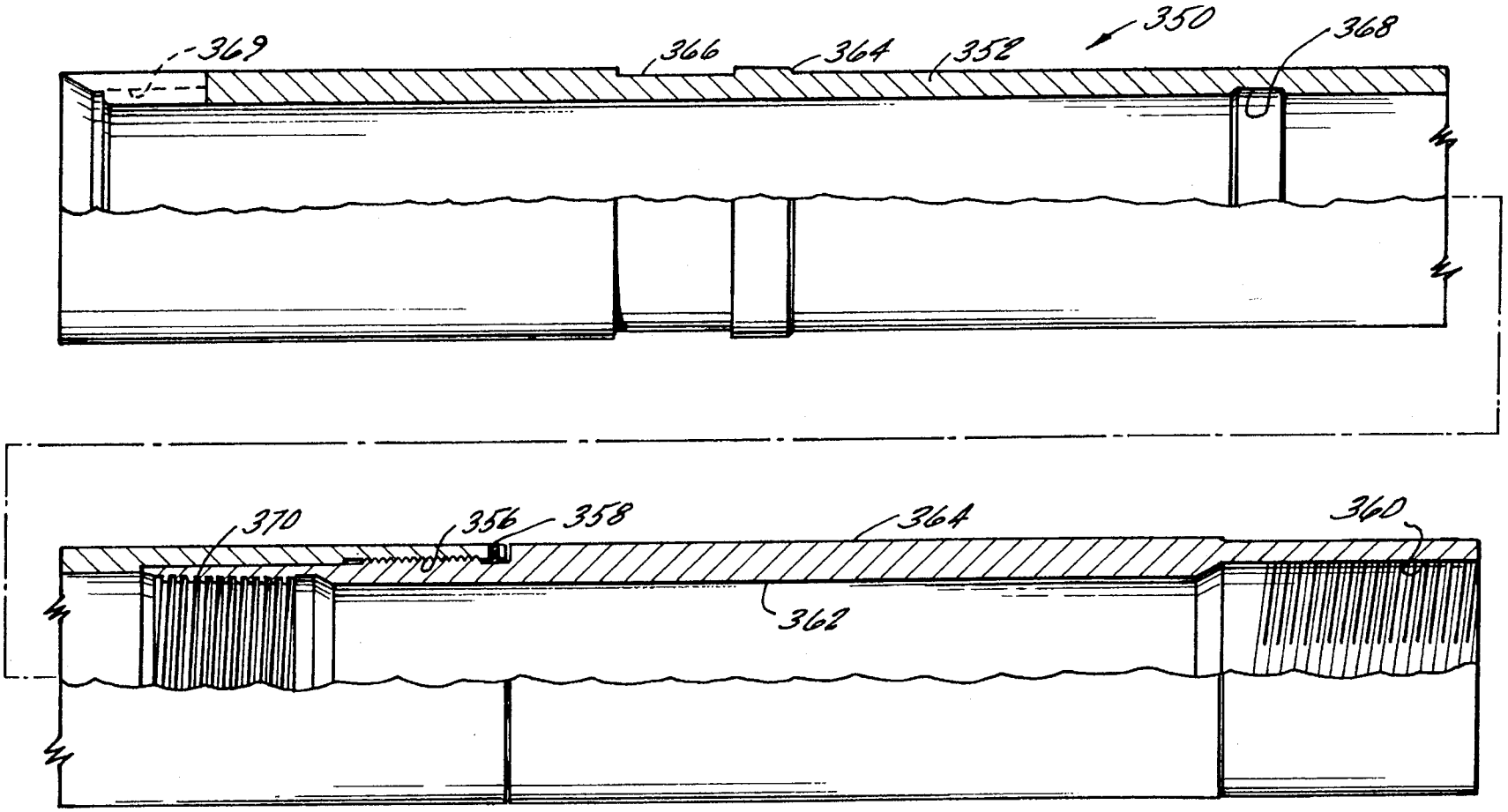
FIG. 21 is a cross-sectional elevation view of a liner tie back sleeve in accordance with the present invention.

As will be discussed hereinafter with respect to the liner tie back 350 of FIG. 21, such liner tie back is locked within larger diameter bore 302 via a pair of mating spring actuated dogs 303 within scoophead 292 and which are best shown in FIG. 18. The lock mechanism for the liner tie back sleeve comprises the pair of circumferentially spaced actuate dogs 303 which are normally urged into bore 302 by a spring 318 mounted to a cover plate 320 via a pair of screws 322. Each dog 303 is mounted in an opening 324 which extends radially from bore 302. Opening 324 includes three successive counter bores of differing and increasing diameter. Dog 303 includes an outer ring 326 which is supported by the shoulder of the first smaller diameter counter bore and plate 320 is supported on shoulder 328 at the intersection between the second and third counter bores. In addition to the spring actuated dogs 303, the larger diameter bore 302 of scoophead 292 includes a locating shoulder 330 for mating with a complimentary surface on the liner tie back of FIG. 21. The interaction of both the spring actuated dogs 303 and the shoulder 330 with the liner tie back 350 of FIG. 21 will be discussed hereinafter.

The profiled surface 332 at the top (or end) of scoophead 292 constitutes an important feature of the present invention as it is configured so as to direct the production tubing for the lateral wellbore into the large bore 302 and also orients the parallel seal assembly 380 (to be discussed hereinafter with regard to FIGS. 23 and 24) when tying back to the surface with a dual packer completion or a single tubing completion. In a single tubing completion utilizing a selective re-entry tool, it is necessary to orient the parallel seal assembly so that the operator knows which wellbore is being entered by the position of the selective re-entry tool. This orientation is accomplished by combining a surface 334 which slopes downwardly towards and surrounds the larger bore 302 with (1) a slotted inclined surface 336 extending from large bore 302 and surrounding small bore 300 and (2) a compound angled surface 338, 340 descending down from either side of slotted surface 336. When running the lateral wellbore tubing such as will be described hereinafter with regard to the parallel seal assembly, if the nose of the lateral wellbore tubing first contacts sloped surface 332, it is directed into large bore 302. However, if the nose of tubing initially lands over the small borehole 300, it is prevented from entering due to the diameter of the tubing nose being wider than the slotted surface 336 over the small borehole 300. Since the tubing nose cannot pass the slot 336, it slides down the compound angle which also directs it to the large borehole 302. Similarly, when orienting the parallel seal assembly, the lateral wellbore seals which are longer than the primary wellbore seals, first contact scoophead surface 332 and are then directed to the large borehole of the scoophead in exactly the same manner as described for the lateral wellbore tubing. Once the lateral wellbore seals are directed into the correct borehole, the primary wellbore seals are limited in the amount of rotational misalignment they can have because the parallel seal assembly can only pivot about the lateral wellbore seal axis by the amount of diametric clearance between the major diameter of the parallel seal assembly and the inside diameter of the concentric main wellbore in which they are installed. The compound angled surfaces 338, 340 are configured such that these surfaces will contain this amount of rotational misalignment, and apply a force to the primary wellbore seals to guide them into their respective seal bore. The final positioning of the parallel seal assembly in scoophead 292 will be discussed with regard to FIG. 13 subsequent to a detailed description of the parallel seal assembly as set forth hereinafter.

Figure 13B:
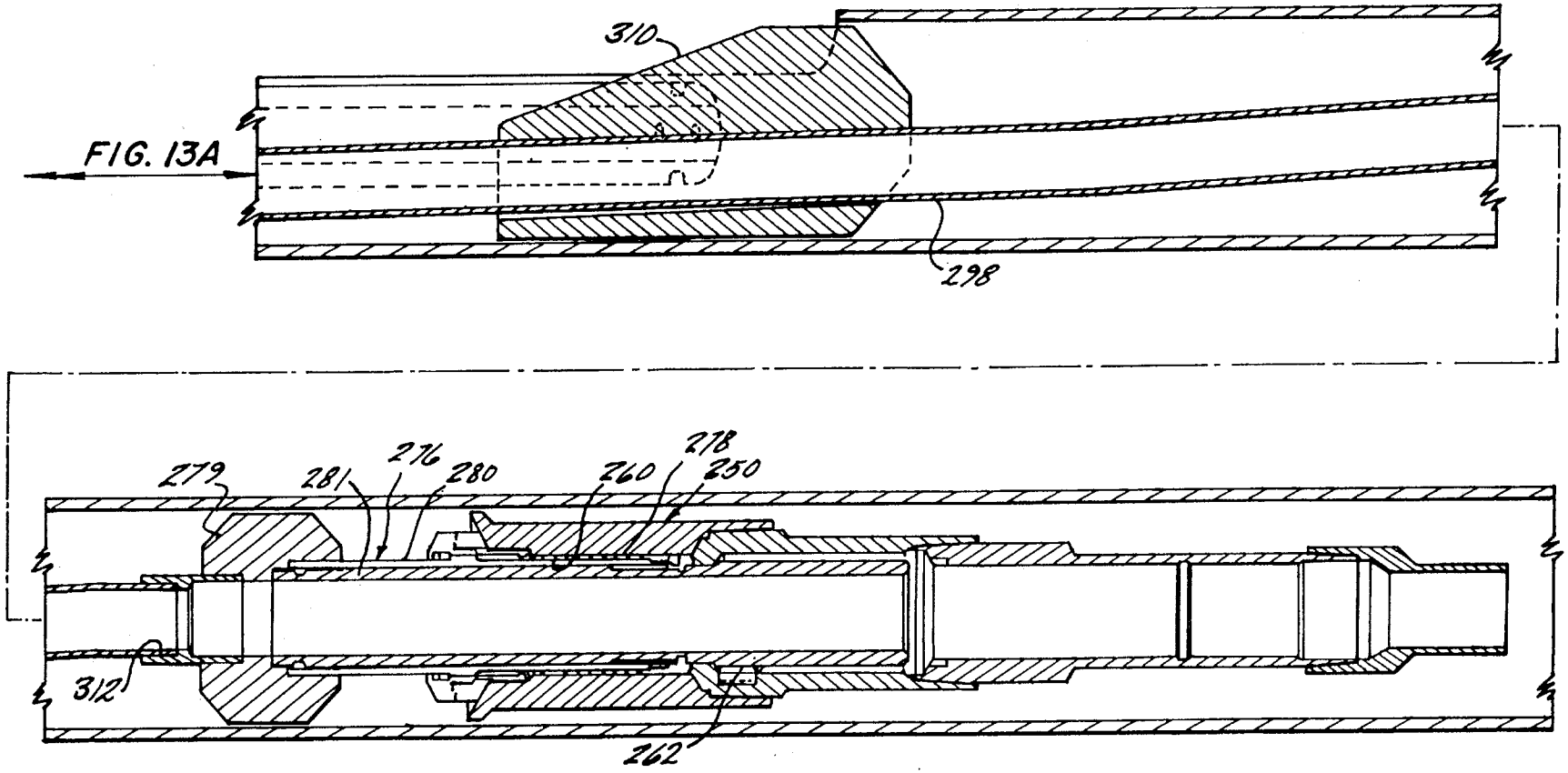

The inside diameter of smaller seal bore 300 includes an appropriately profiled recessed surface 343 for mating with scoophead running tool 510 discussed with regard to FIGS. 29–33 hereinafter. In addition, it will be appreciated that adjacent raised profile 342 includes a forward or uphole shoulder 344 which acts as locating stop to the completion tubing or parallel seal assembly (as shown in FIG. 13).

As discussed, scoophead 290 acts to orient and anchor multiple tubing strings at the Y-juncture in an oil or gas well with multiple or lateral wellbores. An advantage of the scoophead and related assemblies is to provide communication to multiple reservoirs or tap different locations within the same reservoir, and enable re-entry to these wellbores for remediation and stimulation. The large bore 302 of scoophead 290 functions to enable a secondary wellbore's production tubing or liner to pass through until the top of the liner is in the scoophead as was shown in FIG. 8 in connection with liner 202 positioned in the lateral wellbore shown therein. Referring to FIG. 13 and 21, a liner tie-back sleeve is shown at 350 which functions to thread onto the top of liner 202 and thereafter locate, latch and provide a seal receptacle to isolate the secondary wellbore's production fluids. In addition, liner tie-back sleeve 350 also includes a running profile for attachment to a suitable running tool as will be discussed in connection with FIG. 22.

Liner tie-back sleeve 350 is a cylindrical tool, and for ease of manufacturing is comprised of two cylindrical parts including an upper cylindrical tool portion 352 and a lower cylindrical tool portion 354. Parts 352 and 354 are threadably interconnected at threading 356. The parts are further connected via a series of set screws 358. Lower cylindrical part 354 terminates at a threaded opening 360 which is intended to threadably attach to lateral completion liner 202. The remaining longitudinal and interior length of lower part 354 comprises a smooth seal bore surface 362 for connecting either to production tooling or to the parallel seal assembly 380 as will be discussed hereinafter. It will be appreciated that in FIG. 13A and C, the parallel seal assembly 380 is shown in sealing relationship to seal bore 362 of sleeve 350. In addition, the upper portion of lower part 354 includes internal threading 370 (preferably left-handed tapered, square latching thread) for attachment to an appropriate mating surface on the parallel seal bore assembly as will be discussed hereinafter.

Upper cylindrical part 352 of sleeve 350 includes a downwardly inclined shoulder 364 located on the exterior of part 352 about midway the length of part 352. Shoulder 364 acts as a locating means on the outer surface of sleeve 350 to stop and position sleeve 350 along annular complimentary groove 330 of scoophead 290 as best shown in FIG. 13A. Adjacent to, and upstream from, locating shoulder 364 is a locking groove 366 for interior locking with the spring actuated locking dogs 302 associated with scoophead 292. The locating shoulder 364 on the outer surface of part 352 indicates when the sleeve is located in scoophead 292 and the locking groove 366 snap interlocks with the locking dogs from the scoophead to provide resistance when pulling tension against the sleeve 350. This resistance must be greater than the required shear out force of the parallel seal assembly. The interior of upper part 352 includes spaced, preselected profiles 368 and 369 for attachment to a suitable running tool.

Figure 22:
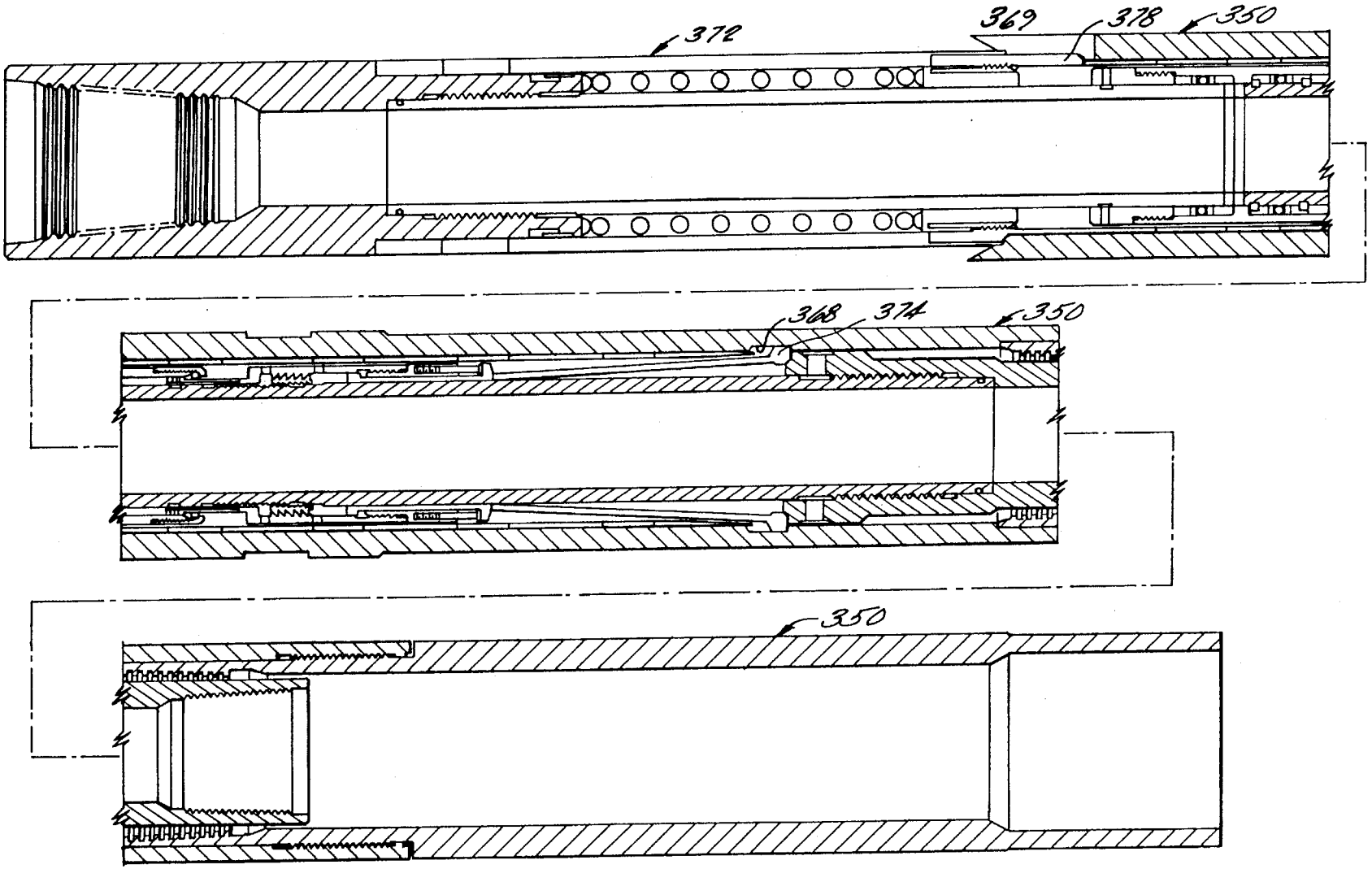
FIG. 22 is a cross-sectional elevation view of the liner tie back sleeve of FIG. 21 connected to a running tool.

Turning now to FIG. 22, a portion of the liner tie-back sleeve 350 is shown attached to a suitable running tool. In this case, the running tool is an HR running tool 372 which is a commercially available running tool manufactured by Baker Oil Tools of Houston, Texas. HR running tool 372 operates in a known manner wherein the running tool is engaged and/or disengaged to the interior of liner 350 at the respective profiles 368 and 369 via a pair of disengageable gripping devices 374, 378. It will be appreciated that during use, a secondary or lateral wellbore producing tubing such as shown at 202 in FIG. 8 is threadably attached to threading 360 of tie back sleeve 350. Next, running tool 372 is attached to profiles 368, 369 and the liner tie back sleeve 350 lateral wellbore production tubing 202 assembly is stabbed-in downhole such that the production tubing and tie back liner sleeves are positioned into larger bore 302 until shoulder 364 on liner sleeve 350 abuts annular shoulder 330 and the dogs 303 from scoophead 290 are locked to the locking groove 366. Once sleeve 350 is in place and the running tool 372 is removed, the latch threading 370 and seal bore 362 are exposed for the parallel seal assembly to plug into for isolating the secondary lateral wellbore. It will be appreciated that by providing the seal point between the parallel seal assembly and the sleeve 350, there is an elimination of the need to effect a seal in the scoophead on the larger bore side thereof. Of course, in an alternative method of use, rather than a parallel seal assembly being locked into sleeve 350, other production tubing or other tools may similarly be locked into liner tie back sleeve 350 in a manner similar to the parallel seal assembly as shown in FIG. 13A.

Figure 24:
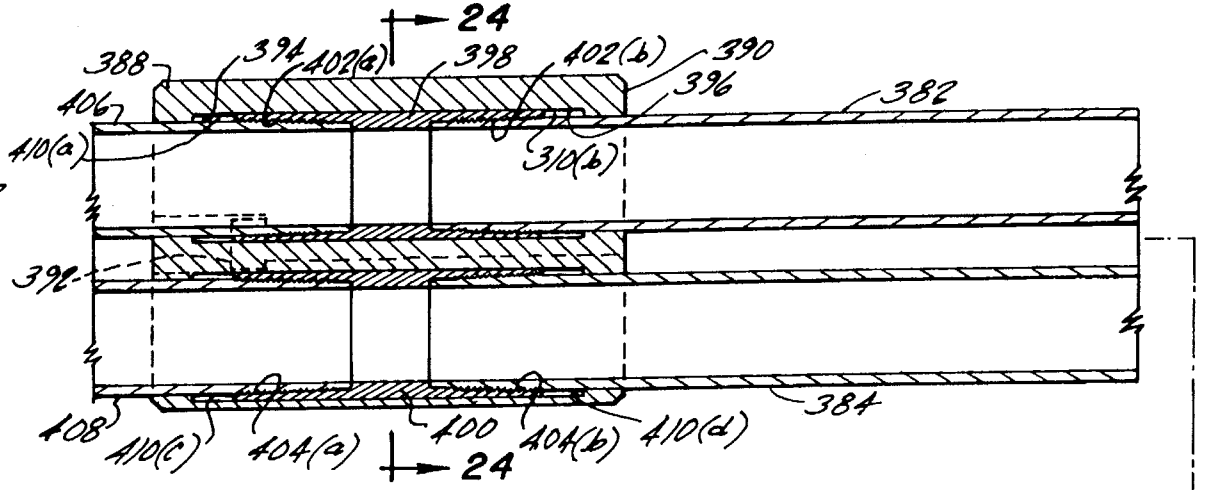
FIG. 24 is a cross-sectional elevation view along the line 24—24 of FIG. 23.
Figure 24:
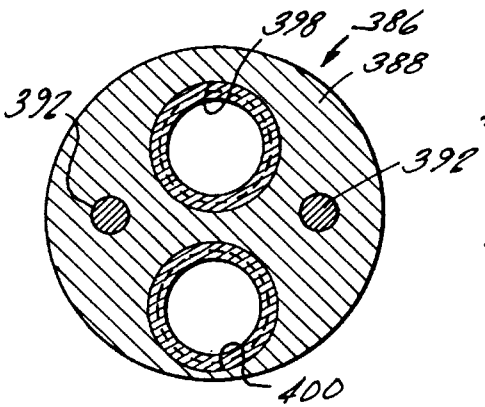
Figure 23:
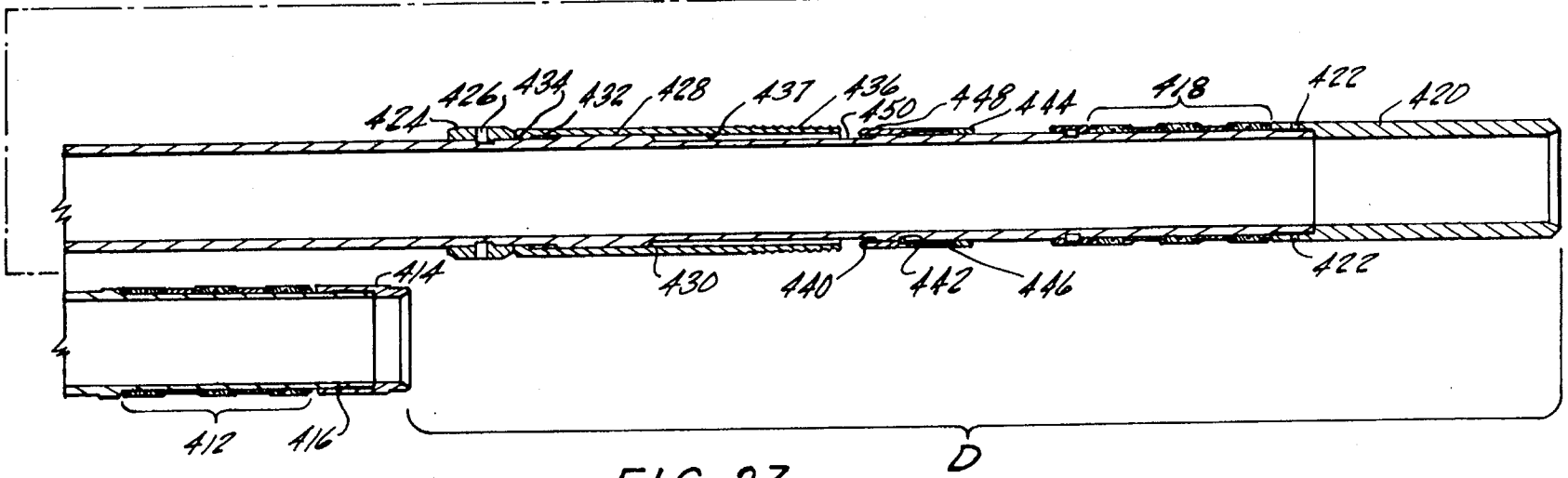
FIG. 23 is a cross-sectional elevation view of the parallel seal assembly in accordane with the present invention.

Referring now to FIGS. 23 and 24 (as well as FIG. 13A), a parallel seal assembly shown generally at 380 will now be discussed. It will be appreciated that parallel seal assembly may function to seal the inside (bores 300 and 302) of scoophead 292. The parallel seal assembly 380 includes a pair of parallel, offset tubing seals 382 and 384 which are each connected to a centralizer 386. As will be discussed hereinafter, the parallel seal assembly 380 carries compressive loads on the primary wellbore side and has a shear out mechanism on the secondary wellbore side. An important feature of the parallel seal assembly is that it acts as the connection between the scoophead 292 and either production tubing or more preferably, a selective re-entry tool of the type shown at 220 in FIG. 9 or at 460 in FIGS. 13 and 25–26.

Centralizer 386 comprises two axially aligned cylinders 388, 390 which are bolted together by a pair of bolts 392. The two cylinders 388, 390 each include two offset counter bores which respectively mate to define a pair of parallel cylindrical bores or openings 394, 396. Each parallel cylindrical bore 394, 396 includes a box coupling shown respectively at 398 and 400. Opposed ends of each box coupling 398, 400 are threaded as shown respectively at 402*a–b*, 304*a–b*. The upper threading 402*a*, 444*a* threadably attaches to tubing joints 406, 408, which in turn are connected either to a dual packer or to a selective re-entry tool 460 (as shown at FIG. 13A). The lower threading 402*b*, 404*b* is threadably connected to the parallel tubing/seal assemblies 382, 384, respectively. Once the split housing 386 is bolted together, the couplings 398 and 400 connecting the seal assemblies 382, 384 to their respective tubing subs 406, 408, are trapped within the counter bores of the centralizer housing 386. This limits the axial movement available to centralizer 386.

Preferably, there is an additional space 410*a–d* on either end of couplings 398, 400 within the counter bore so as to accommodate slightly different length tubings 406, 408. The purpose of centralizer 386 is to elevate the seal assemblies 382, 384 off the wellbore wall during stab-in and to facilitate the automatic alignment feature of the parallel seal assembly and scoophead system as will be discussed hereinafter.

Seal assembly 382 has a longer length than seal assembly 384 and is in a mutually parallel relationship to seal assembly 384. Shorter seal assembly 384 comprises a length of tubing which terminates at a seal which is preferably a known bonded seal shown at 412. Such bonded seals include elastomer bonded to metal rings for durability. Also in a preferred embodiment, a bottom sub 414 is threadably attached to the terminal end of tube 384 and is locked therein using a plurality of set screws 416.

Longer seal assembly 382 also includes a sealing mechanism along an exterior length thereof which is shown at 418 and again preferably comprises a known bonded seal. In a preferred embodiment, a bottom sub 420 is threadably attached at the terminal end of tubing 382 and is further locked therein using a plurality of set screws 422. It will be appreciated that seal 418 on larger seal assembly 382 is adapted for sealing engagement to the inner diameter seal bore 362 of tie back sleeve 350 (after tie back sleeve 350 has been latched into scoophead 292). Thus, tube 382 sealingly engages and communicates with the secondary (lateral) wellbore production tubing string. Of course, the seal 412 on smaller tubing assembly 384 seals into the small diameter bore 300 of scoophead 292 and thus provides sealing engagement to any production tubing or other completion tubing downhole from scoophead 292. The smaller seal assembly 384 thus acts to isolate the primary wellbore from the secondary or lateral wellbore.

Longer seal assembly 382 includes as an important feature thereof, a locking and shear out mechanism for attachment to the latching thread 370 on liner tie back sleeve 350. This locking mechanism includes a locating ring 424 pinned to tubing 382 by a plurality of pins 426. Downstream from locating ring 424 is a collet latch 428 which rests on a raised support 430 extending upwardly from tubing 382 such that the terminal end 436 of collet latch 428 is spaced from tubing 382 as shown at 437. In addition, the raised support 430 also provides a space 432 between the base 444 of collet latch 428 which abuts locating ring 424. The terminal portion 436 of collet latch 428 defines a plurality of cantilever beams having a serrated edge 438 thereon. Preferably, the serrated edge has a back angle of about 5° and a front angle of about 45°. Cantilever beam 436 will deflect inwardly when seal assembly 382 is inserted into the interior of liner tie back sleeve 350 and serrated edges 438 will interlock in a ratcheting manner to locking thread 370 as best shown in the enlarged view of FIG. 13C. Further downstream from collet latch 428 and spaced therefrom is a shear block 440 which captures a shear ring 442. Shear block 440 and shear ring 442 are attached to the exterior of seal assembly 382 using a shear block retainer 444 and a plurality of set screws 446. Shear block 440 extends outwardly from a shoulder 448 on tubing 382 so as to define a space 450 between shear block 440 and collet latch 428. The length of space 450 should be smaller than the length of space 432 for collet latch 428 to load up on the shoulder of shear ring 442 during insertion of seal assembly 382 and the interlocking attachment between latched surface 438 and latch thread 370 of the liner tie back sleeve. Locating ring 424 provides resistance during stab-in so as to maintain the respective spacing 432 and 450. As best shown in FIG. 13A and C, when fully stabbed in, cantilever 436 will be urged downwardly into abutting contact with shear block 440 such that longer parallel seal 382 will be in locking engagement with liner sleeve 350. Subsequently, when it is desired to retrieve parallel seal assembly 380 from downhole, tension applied to the centralizer 386 will eventually shear ring 442 at a predetermined shear value. When sheared, shear block 448 will be released and will move axially downward over the outer surface of tubing 382. This will result in cantilever 436 being allowed to freely deflect inwardly and ratchet out of its interlocking contact with latch thread 370. As a result, the parallel seal assembly 380 will be removed from liner sleeve 350 as well as the scoophead 292.

The distance D between the terminal end of seal assembly 382 and the terminal end of seal 384 may be functionally important as it allows the larger seal assembly 382 to enter the desired larger bore 302 of scoophead 292 and thereby align the assembly. In a preferred embodiment, the distance D is about three feet. This alignment is accomplished by trapping the larger seal assembly 382 in bore 302 and trapping the centralizer 386 within the wellbore. This positively limits the rotational misalignment available to the smaller seal assembly 384 prior to stabbing into scoophead 292. The parallel seal assembly thus automatically aligns with as much as 120° rotational misalignment. It will be appreciated that the counter bores in the split housing 388 of the centralizer are preferably offset (e.g. not symmetrical) so as to match the offset bore arrangement in scoophead 292. In addition, since the selective re-entry tool will have a different offset centerline than the scoophead, centralizer 386 and the associated tubing sub arrangement is configured to allow enough deflection in the tubing subs to adapt the selective re-entry tool to the scoophead.

While the selective re-entry tool depicted in FIGS. 10–12 is well suited for its intended purposes, in a preferred embodiment, a functionally equivalent yet structurally improved selective re-entry tool is utilized. This improved tool is shown generally at 460 in FIG. 13, 25 and 26 and is comprised of a flapper 462, a pair of rails 464 on either side of flapper 462, a rectangular box 466, a fixed cylinder 468, an exiting sub 470, a double ended collet 472, an attachment sleeve 474 and an alignment sub 476. Flapper 464 comprises a plate of the type depicted in the FIGS. 10–12 embodiment and includes two sets of ears extending laterally therefrom. A first set of ears 478 are pivotally attached to alignment sub 476 and held in position via attachment sleeve 474. Ears 478 are positioned at the lower or downhole end of flapper 464. At aborn midway along the longitudinal length of flapper 464 is the second set of ears 480. Ears 480 are the manipulation ears that allow the shifting of the selective re-entry tool along groove 488 which is provided in rectangular box 466. Rectangular box 466 is mounted on an inner mandrel 482 which is tied to the box but has the ability to move longitudinally within tool 460 with respect to the exiting sub 470. Inner mandrel 482 is moved inside of collet 472. The upstream end of inner mandrel 482 is connected to profiled sections 486, 487 for engagement to a known shifting tool.

Rectangular box 466 has at least two functions. First, box 466 guides the coiled tubing workstring (or like device) through a small section so that it does not bind up or tend to coil back. Box 466 also includes the aforementioned pair of symmetrical, laterally disposed guide slots 488 that are used to manipulate the flapper from one side of the tool to the other side. Each guide slot 488 includes an upper groove and a lower groove which are interconnected by a sloped groove to form an elongated ramp. As mentioned, flapper 462 has two rails 464 that are mounted perpendicularly to the flapper.

Figures 27, 28:
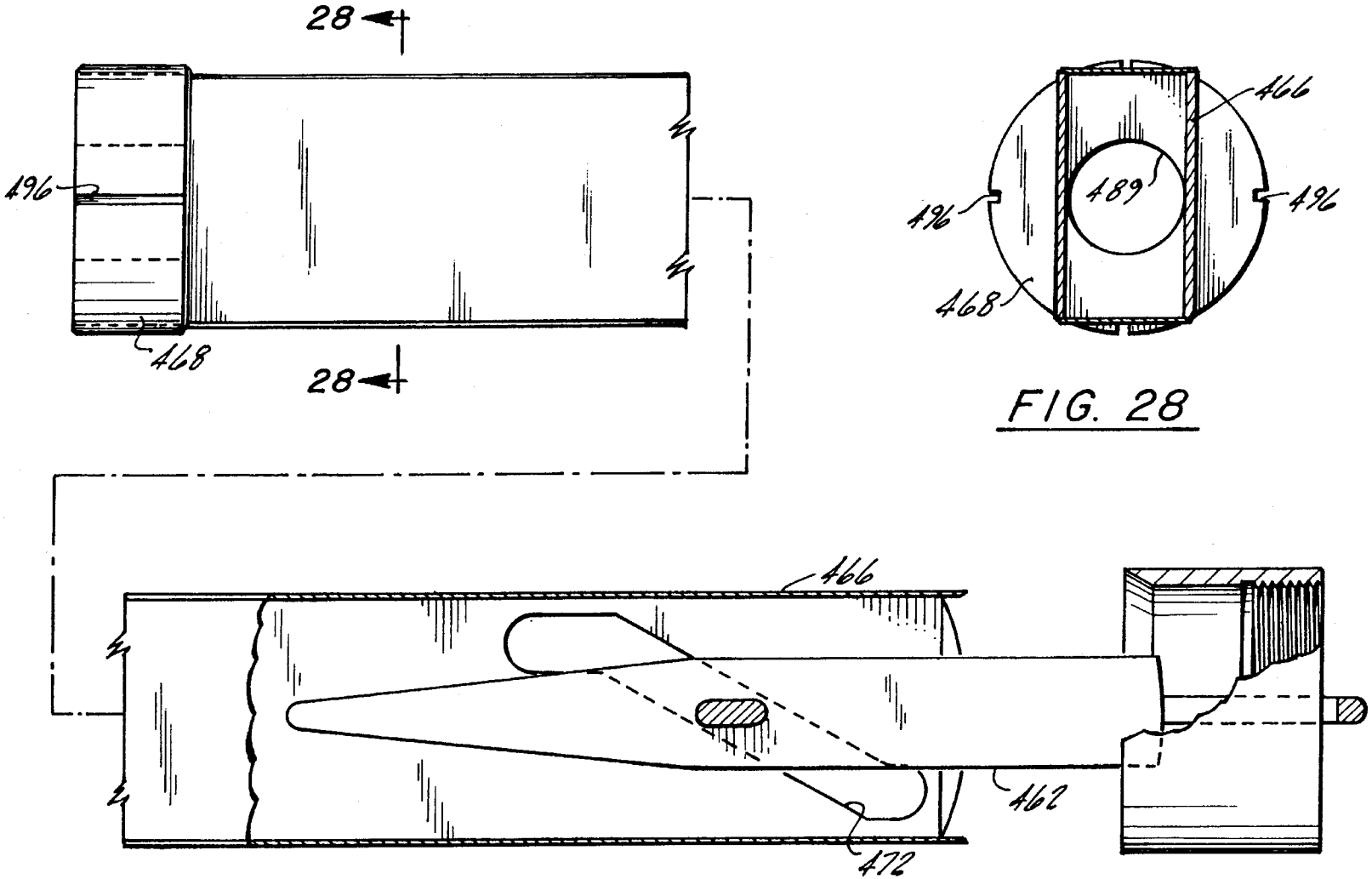
FIG. 27 is a side elevation view, partly in cross-section, depicting the flapper sub-assembly used in the selective re-entry tool of FIGS. 25 and 26.
FIGS. 28 is a cross-sectional elevation view along the line 28—28 of FIG. 27.

These rails also serve two functions. First, the rails help guide the coiled tubing out of the box and into the alignment sub 474. Another important function of the rails is that they take part of the impact load of the coiled tubing by supporting the flapper in its proper positions. Box 466 is connected to exiting sub 470. Exiting sub 470 allows the coiled tubing to exit out of a small bore 490 or 492 (as well as return therefrom) without getting stuck. As best shown in FIGS. 27 and 28, box 466 is mounted using mandrel 482 to cylindrical sub 468. Sub 468 includes longitudinal bypass slots 496 as shown in FIG. 28.

Figure 25:
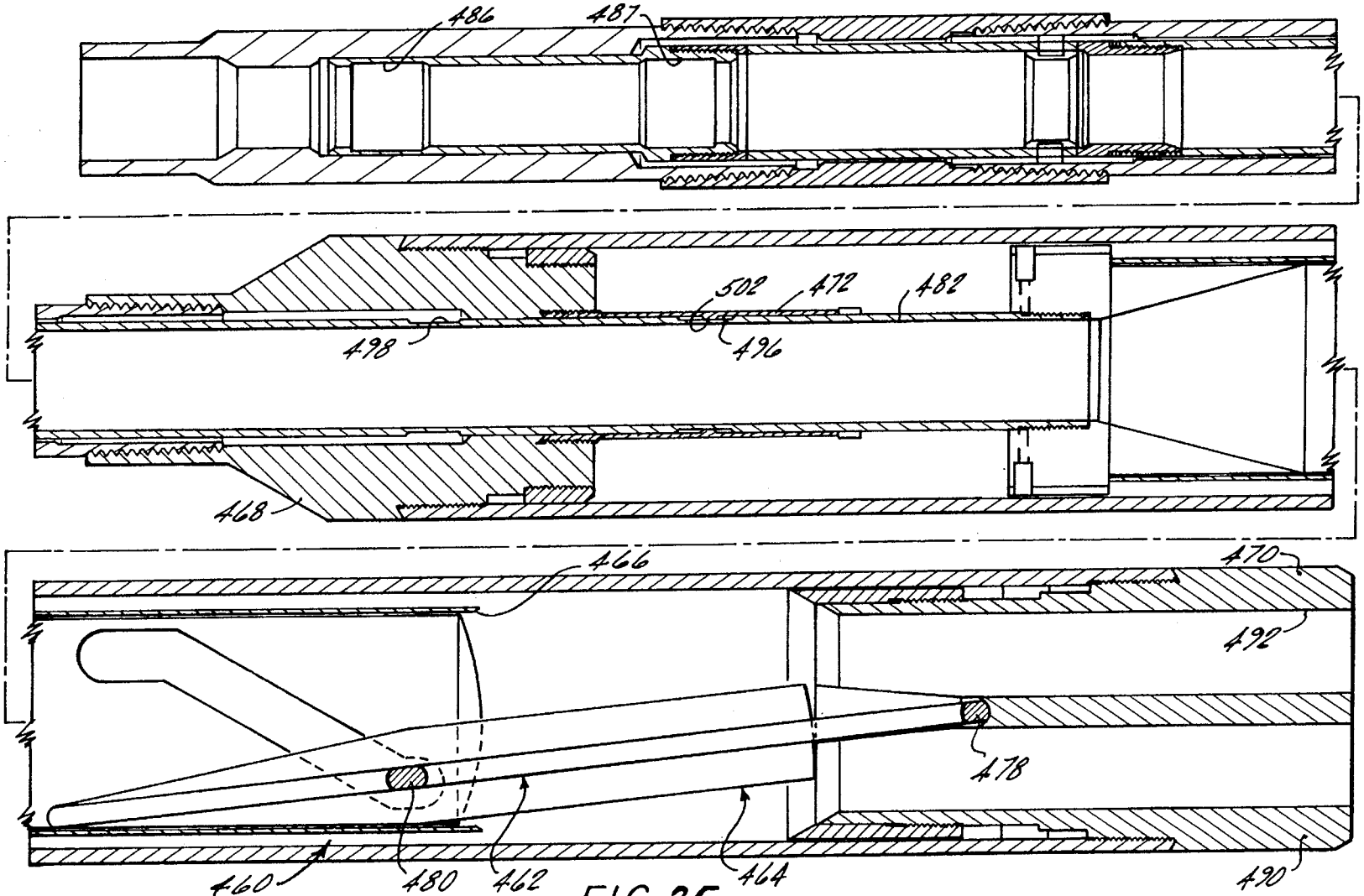
FIGS. 25 and 26 are cross-sectional elevation views of a preferred embodiment of the selective re-entry tool in accordance with the present invention shown with the flapper valve disposed in respective primary and lateral wellbore positions.

A coiled tubing workstring (or other like device) may be positioned directly over one of the bores in the scoophead (or any other device located downhole of the selective re-entry tool) by deflecting off of flapper 462 which is oriented to either opening 490 or 492 depending upon the position of the internal sleeve or mandrel 482 which is positioned in the upper portion of the selective re-entry tool. Flapper 462 is driven by the angled slots 488 located in box 466. Whenever box 466 is in the uphole position as shown in FIG. 25, flapper 462 lays to one side of the selective re-entry tool thus diverting the coiled tubing to enter the hole 492 on the opposite side. By moving the internal mandrel or sleeve downhole, flapper 462 is caused to flap to the other side of the tool thus allowing the coiled tubing to be diverted to the other hole 490. Box 466 is moved upwardly or downwardly by engaging a standard hydraulically actuated shifting tool such as the HB-2 available from Baker Oil Tool into the shifting sleeve profile 486, 487 located in the upper portion of the tool. An upstroke or downstroke is then applied depending upon the desired position of the flapper. In order to go from "up" the flapper position shown in FIG. 25 to the "down" flapper position shown in FIG. 26, a downstroke is made on the shifting tool which causes the internal mandrel 482 to move downwardly through the tool with respect to the exit sub 470, which in turn causes box 466 to move downwardly. As box 466 is moved downwardly, ears 480 will be urged and driven upwardly along the sloped ramp of guide grooves 488 from the position shown in FIG. 25 to the upper position shown in FIG. 26. As ears 480 are driven in this manner, flapper 462 will pivot along the pivot point defined by ears 478 into the position shown in FIG. 26.

Figure 26:
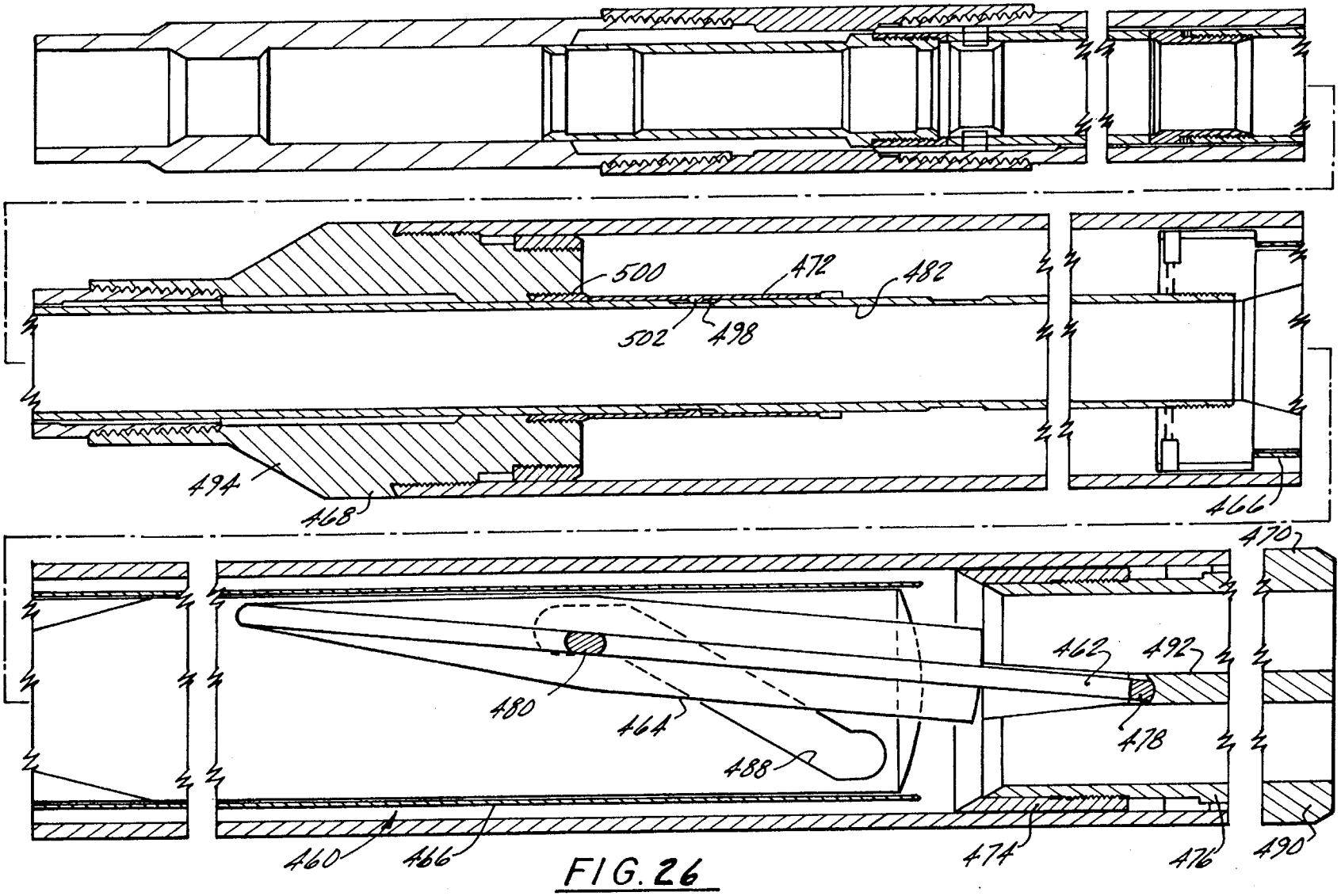

In accordance with an important feature of this invention, a double ended collet 472 is provided which selectively engages either a groove 496 (as shown in FIG. 25) or a groove 498 (as shown in FIG. 26) on inner mandrel 482. Double ended collet 472 is threadably connected to stationary sub 468 by threading 500. Collet 472 remains stationary with respect to the movement of inner mandrel 482. However, it will be appreciated that in order for inner mandrel 482 to move in any direction, a collet snap-out force must be overcome in order to urge the interlocking rib or bump 502 from the collet out of the groove 496 or 498. Thus, it is this collet snap-out force which must be overcome in order to allow the box to change positions. It will be appreciated that the collet may be easily interchanged for various snap-out forces by simply removing collet 472 and threadably replacing it with a different collet. Thus, in moving from the FIG. 25 to the FIG. 26 positions, interlocking rib 502 has snapped out and away from groove 496 allowing inner mandrel to move downwardly whereupon rib 502 from collet 472 engages receiving groove 498 thereby locking the mandrel in the position shown in FIG. 26.

Selective re-entry tool 460 is thus operated in the following manner: (1) the hydraulic shifting tool is run to depth on a coiled tubing workstring having an appropriate shifting tool thereon; (2) the shifting tool hydraulically engages the profiles 486, 487 in the top of the selective re-entry tool; (3) a shifting load is then applied by the shifting tool sufficient to overcome the collet snap-out force and the inner moving sleeve or mandrel 482 is then shifted in the desired direction (either up or down); (4) the shifting tool is then disengaged from the selective re-entry tool; and (5) a coiled tubing or similar workstring is run through the selective re-entry tool whereby the flapper 462 diverts the tubing string into a selected opening 490 and/or 492 which of course is mated to a selected downhole conduit or other working tool such as the scoophead 292 discussed hereinabove.

Referring now to FIGS. 29–32, a novel running tool for use with the scoophead/diverter assembly is shown generally at 510. Running tool 510 includes a mounting head 512 attached to a running stump 514 and a housing 516. It will be appreciated that running stump and housing 516 are mutually parallel and are dimensioned and configured so as to be received in the offset bores 300, 302 in scoophead 292. Mounting head 512 includes an axially elongated neck 518 having an internal box thread 520. Neck 518 diverges outwardly along a skirt portion 522 to a lower head section 524 having a larger diameter relative to neck 518, the diameter approximately matching the diameter of scoophead 292. The interior of mounting head 512 incudes an axial opening 526 in neck 518 which then slopes downwardly to define an angled bore 528 which exits lower stump 524 to define an axial offset exit bore 530. Lower stump 524 also includes a longitudinal flow opening 532 which runs from shoulder 522 to an exit opening 534. It will be appreciated that exit opening 530 has a smaller diameter than exit opening 534 with exit opening 530 being dimensionally configured to receive housing 516 and exit opening 534 being dimensionally configured to receive larger diameter running stump 514.

Figure 30:
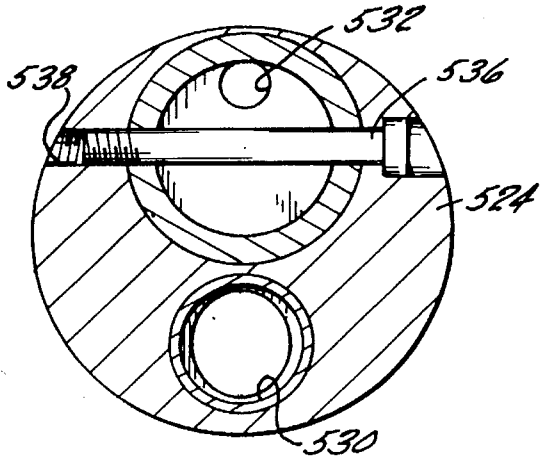
FIGS. 30, 31 and 32 are cross-sectional elevation views along the lines 30—30, 31—31 and 32—32, respectively of FIG. 29.

Running stump 514 comprises a cylindrical tube which is received by output bore 534 and is removably bolted to lower mounting head 524 by a bolt 536 received in a transversely oriented threaded passage 538 as best shown in FIG. 30. Running stump 514 also includes an opening 540 for the purpose of fluid bypass on circulation during running. It will be appreciated that flow opening 532 communicates with the interior of exit bore 534 and hence with the interior of running stump 514 so that fluid may pass from shoulder 522 through flow opening 532 and thence through running stump 514 into larger diameter bore 302 of scoophead 292.

Figure 31:
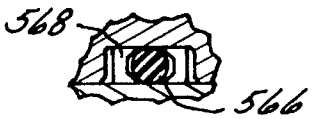
Figure 32:
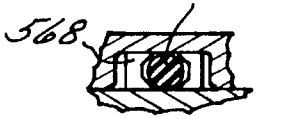

Housing 516 includes an inner mandrel 542 which is movable with respect to housing (or connecting mandrel) 516 and which is sealed to connecting mandrel 516 by a plurality of O-ring seals 544. Connecting mandrel 516 also includes O-ring seals 546 about the outer periphery thereof for sealing engagement with the small diameter bore 300 of scoophead 292. Connecting mandrel 516 further includes at a lower end thereof a pair of openings 548, each of which receives a dog 550, 552. As will be discussed hereinafter, each dog 550, 552 is captured either between a raised surface 554 on inner mandrel 542 or a recessed surface 556 also on mandrel 542 and located adjacent to the raised surface 554. Directly upstream from recessed surface 556 between inner mandrel 542 and connecting mandrel 516 is a shear ring 558 which, unless subjected to a preselected shear force, precludes movement between the respective inner and connecting mandrels. Inner mandrel 542 also includes a plurality of spaced ports 560 for eliminating any fluid lock problems during operation of the running tool. The upstream portion of inner mandrel 542 includes a pump open or bypass sleeve 562 which is attached to inner mandrel 542 by a plurality of shear screws 564. As best shown in FIGS. 31 and 32, bypass sleeve 562 is sealed to inner mandrel 542 by a pair of spaced O-ring assemblies, each of which includes an O-ring 566 and an O-ring backup 568. Sandwiched between sleeve 562 and outer mandrel 516 is a bypass port 570 through inner mandrel 542. Spaced from bypass port 542 downstream thereof is another bypass port 572 which communicates with a shallow recess 574 on the interior surface of outer mandrel 516. Sleeve 562 also includes a fluid port 576 for transferring fluid to the spacing between sleeve 562 and inner mandrel 542. The lowermost portion of sleeve 562 terminates at a cylinder 578 which is capable of riding along a bearing surface 580 on inner mandrel 542 until end 578 encounters shoulder 582.

Figure 29:
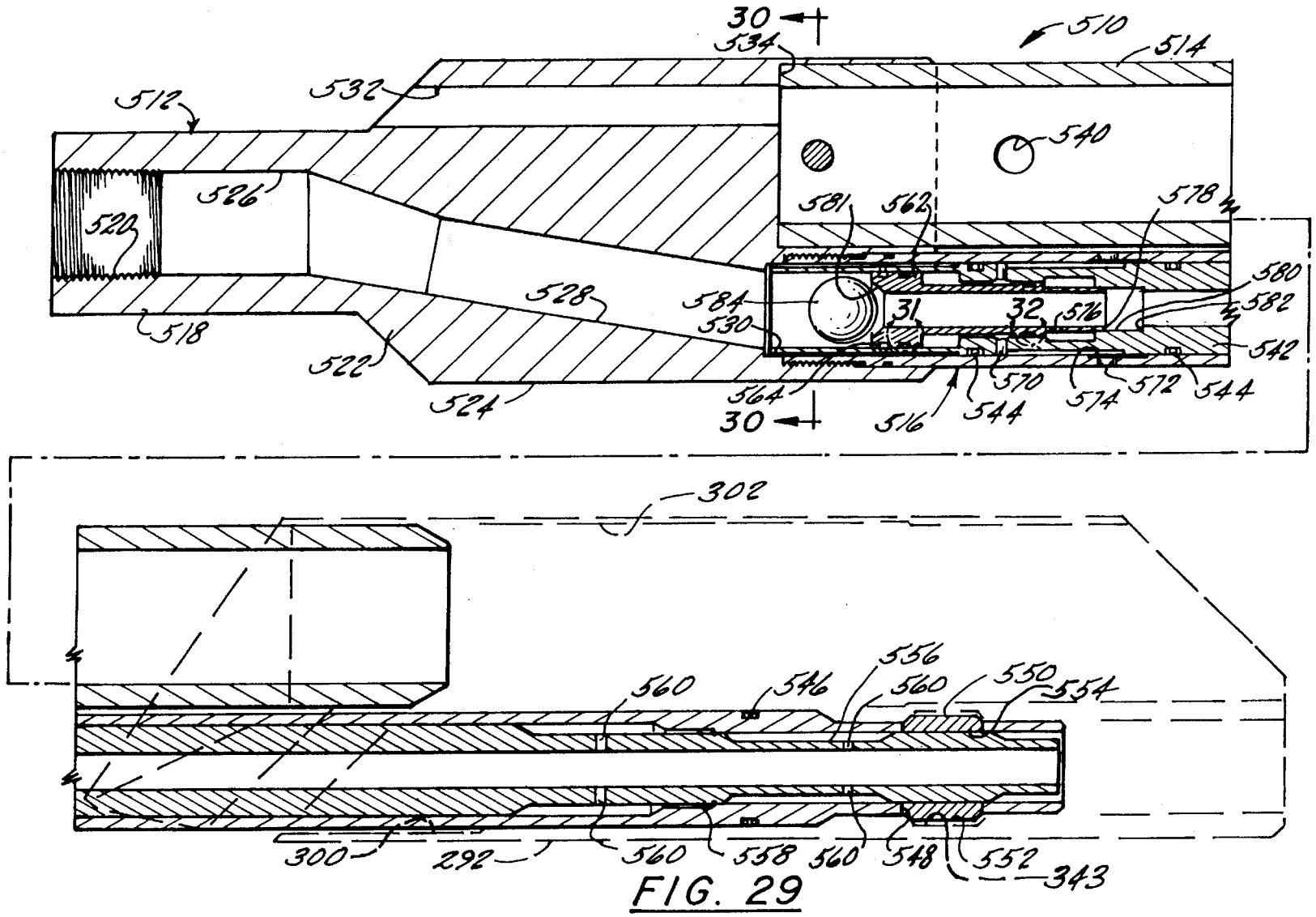
FIGS. 29 and 29A are cross-sectional elevation views of a scoophead/diverter assembly running tool in accordance with the present invention.
Figure 29A:
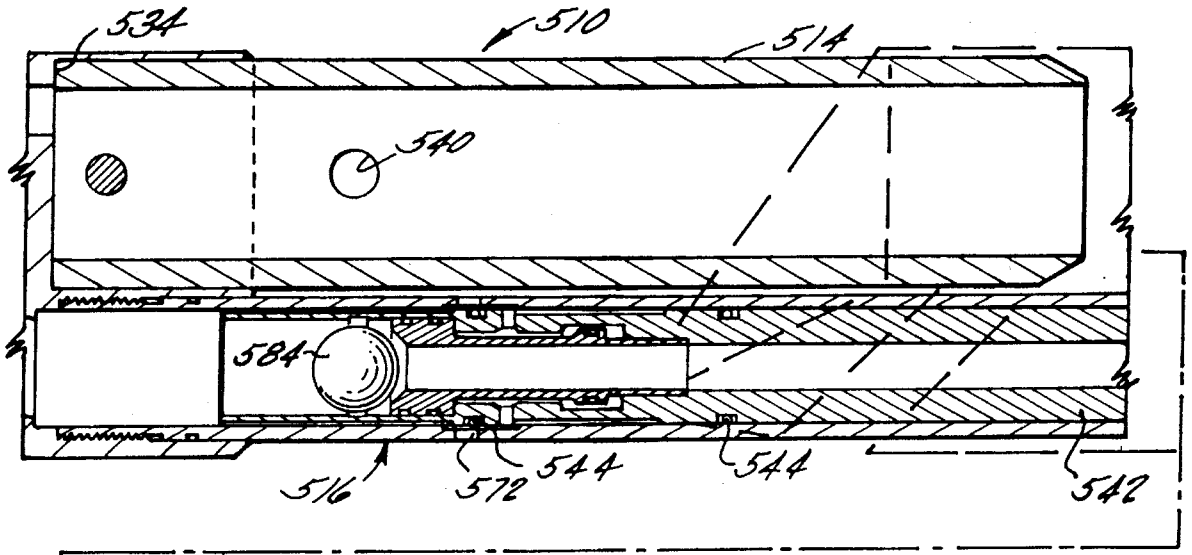
Figure 29A:
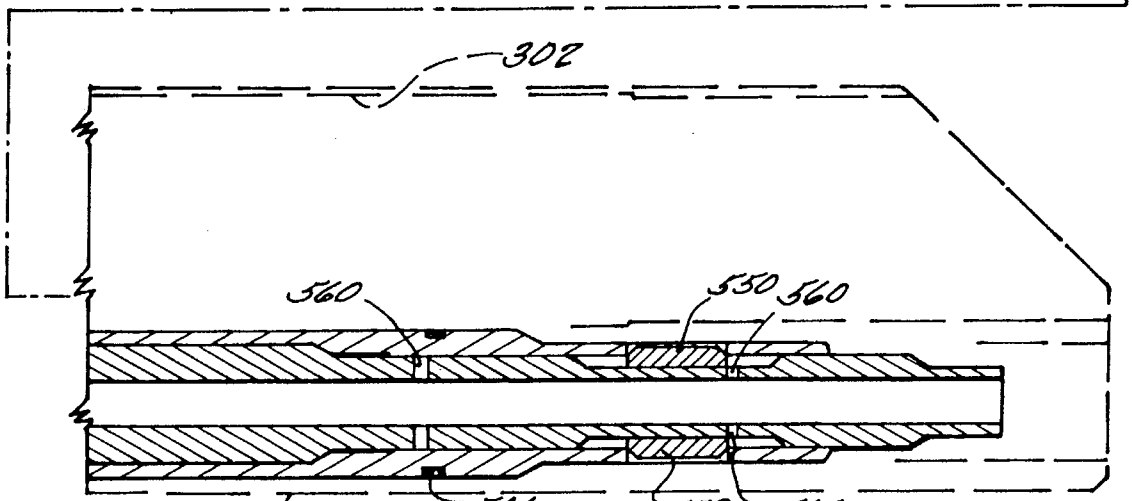
Figure 33:
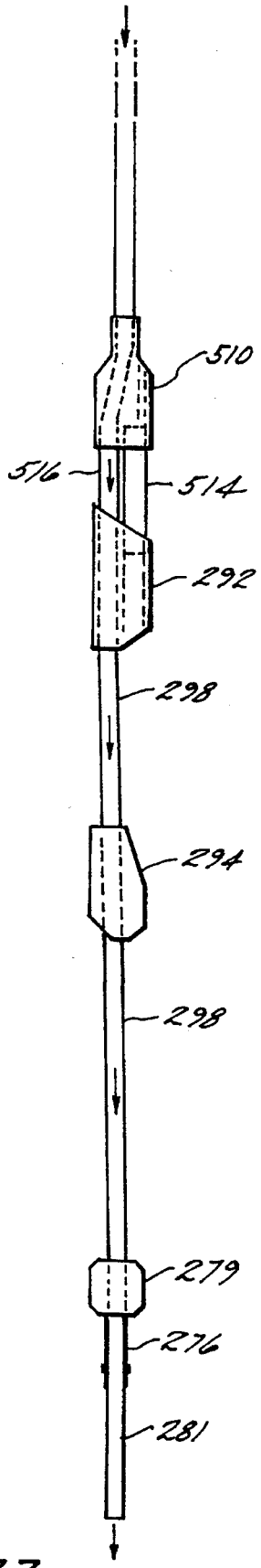
FIG. 33 is a schematic elevation view depicting the scoophead running tool of FIG. 29 running in a completion assembly in accordance with the present invention.

The scoophead/diverter assembly running tool 510 is operated as follows: First, tool 510 is attached to scoophead 292 in a manner shown in FIG. 29 whereby dogs 550, 552 are locked into mating recesses 343 and small diameter bore 300 of scoophead 292. The complete sub assembly which is run downhole using running tool 510 is depicted in FIG. 33. This is accomplished by initially placing the dogs 550, 552 into the windows 548 of housing 516 and then inserting the inner mandrel 542 into the housing 516 until the raised surfaces 554 engage dogs 550, 552 and urge the dogs into mating recesses 343. At the same time, running stump 514 is positioned in the larger diameter bore 302 of scoophead 292 and the running stump is bolted to the mounting head 512. It will be appreciated that scoophead 292 will be connected to the diverter as well as to the lower production tubing 298 and orientation anchor 276. Fluid is circulated while running the running tool downhole (see FIG. 29A). Once landed, the seals 278 on the orientation anchor (which have been positioned in, for example, LCR 250) are tested by continuing to circulate and test the pressure. Once the orientation anchor has been stabbed, the system is now "closed". At this point, pressure continues to build whereupon, at a preselected pressure build-up, the increasing pressure shears the shear screws 564 causing bypass sleeve 566 to be urged downwardly along recess 582 until ends 578 of bypass sleeve 562 are retained by shoulder 582 thereby opening the by-pass valve (see FIG. 29A). When by-pass sleeve 562 opens, fluid will again be able to flow (that is, the system reverts to a "open system") whereby fluid within the inner mandrel 542 is allowed to flow through port 576 to the space between bypass sleeve 562 and inner mandrel 542 and then through port 570 through depression 574 and finally out through port 572.

When it is confirmed that the assembly is properly seated and oriented in the casing, that is, that the orientation anchor is properly oriented and sealed in LCR 250, running tool 510 is removed from scoophead 292. This is accomplished by circulating a ball 589 through axial opening 520 and opening 528 until the ball is seated against an angled ball seat 586 on bypass sleeve 562. Bypass sleeve 562 will then apply a force (caused by circulating fluid exerting a force against the seated ball) to shoulder 582 urging the entire inner mandrel 542 downwardly whereby shear ring 558 will be sheared such that the recess 556 on inner mandrel 542 will be disposed across from dogs 550, 552. At this point, the dogs will retract into recess 556 and out from recess 343 of scoophead 292 thereby allowing running tool 510 to be lifted from the scoophead and withdrawn from the hole (see FIG. 29A).

The scoophead running tool of the present invention has many important features and advantages. For example, the scoophead running tool 510 allows torque to be transmitted along the centerline of the scoophead assembly in spite of being attached to one of the offset bores. This torque transition is accomplished by connecting housing 516 between the running tool and the scoophead at the same offset as the large bore of the scoophead. This transfer of torque is important so as to reliably manipulate the scoophead assembly together with the running stream. Another important feature of the running tool of the present invention is that if the locking dogs 550, 552 (which carry the load during run-in) are not engaged properly into the scoophead profile, the running tool cannot be completely assembled. This is because the inner mandrel 542 will not move under the locking dogs unless they are aligned with their groove 343 and unless the inner mandrel is under the locking dogs, the mounting head of the running tool will not thread onto housing 516.

Figure 13C:
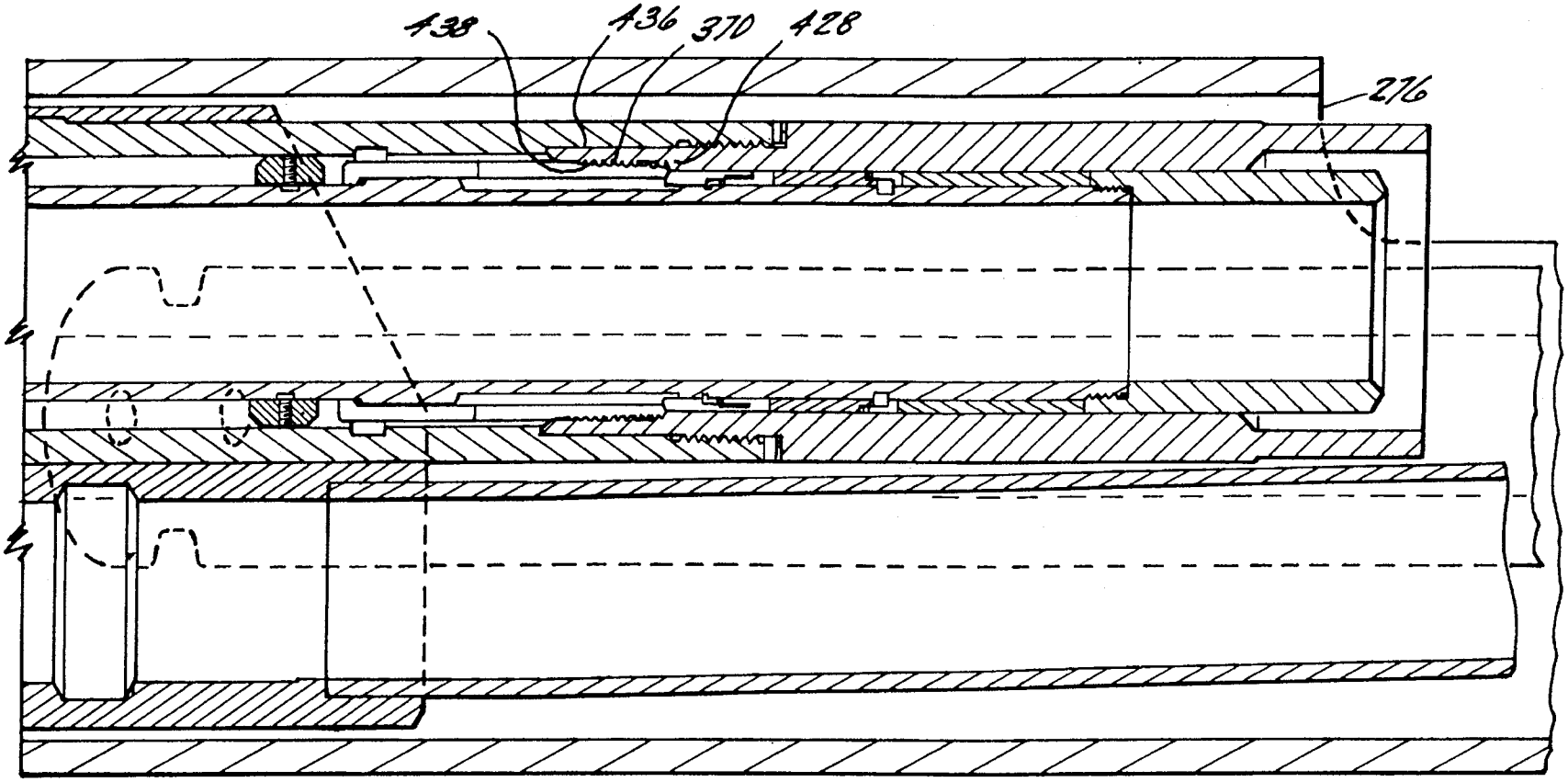
FIG. 13C is an enlarged cross-sectional view of a portion of the downhole completion assembly depicted in FIG. 13A.
Figure 34A:
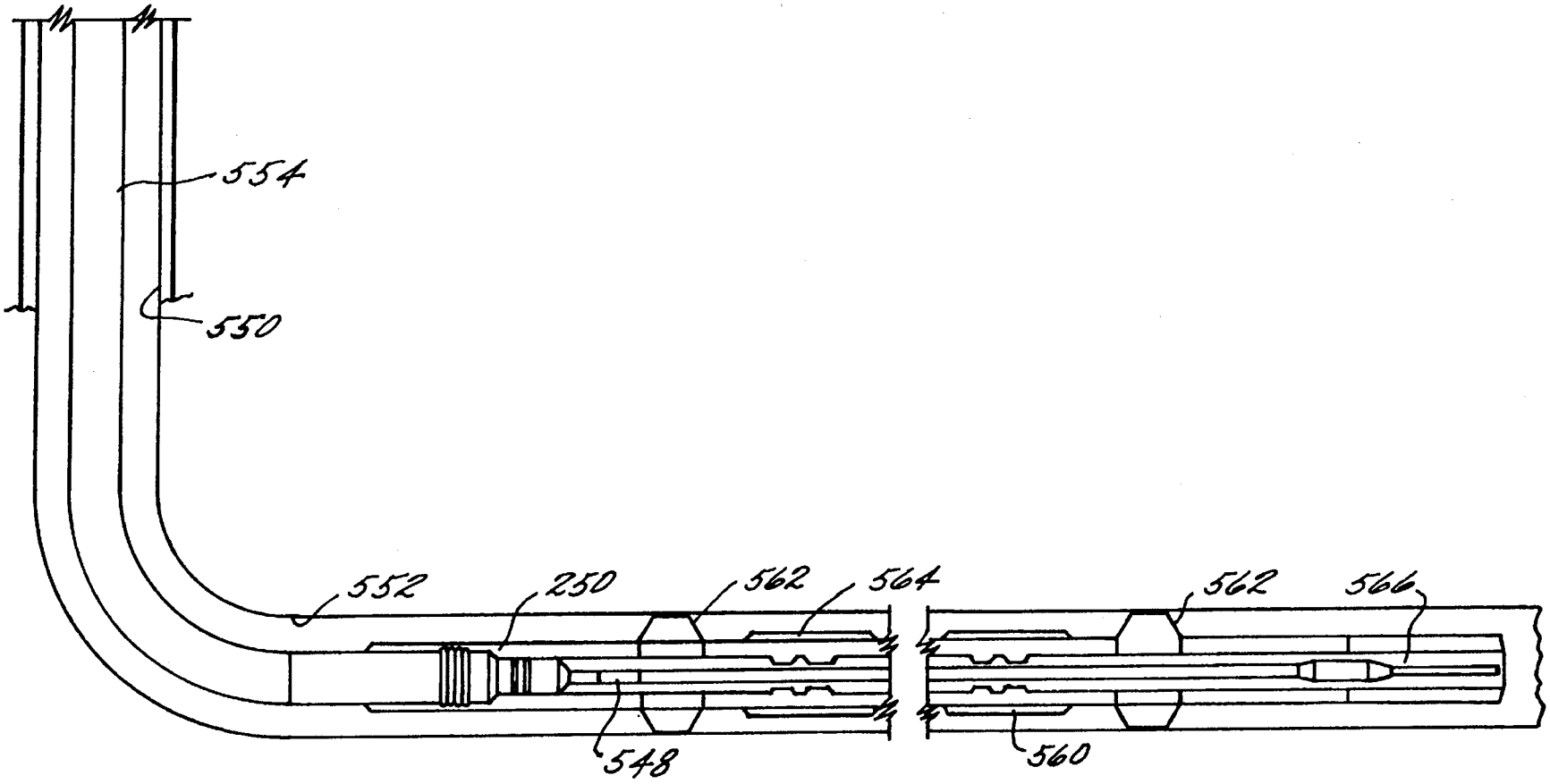
FIGS. 34A–J are sequential diagrammatic views depicting a preferred method of completing multilateral wellbores in accordance with the present invention.
Figure 34B:
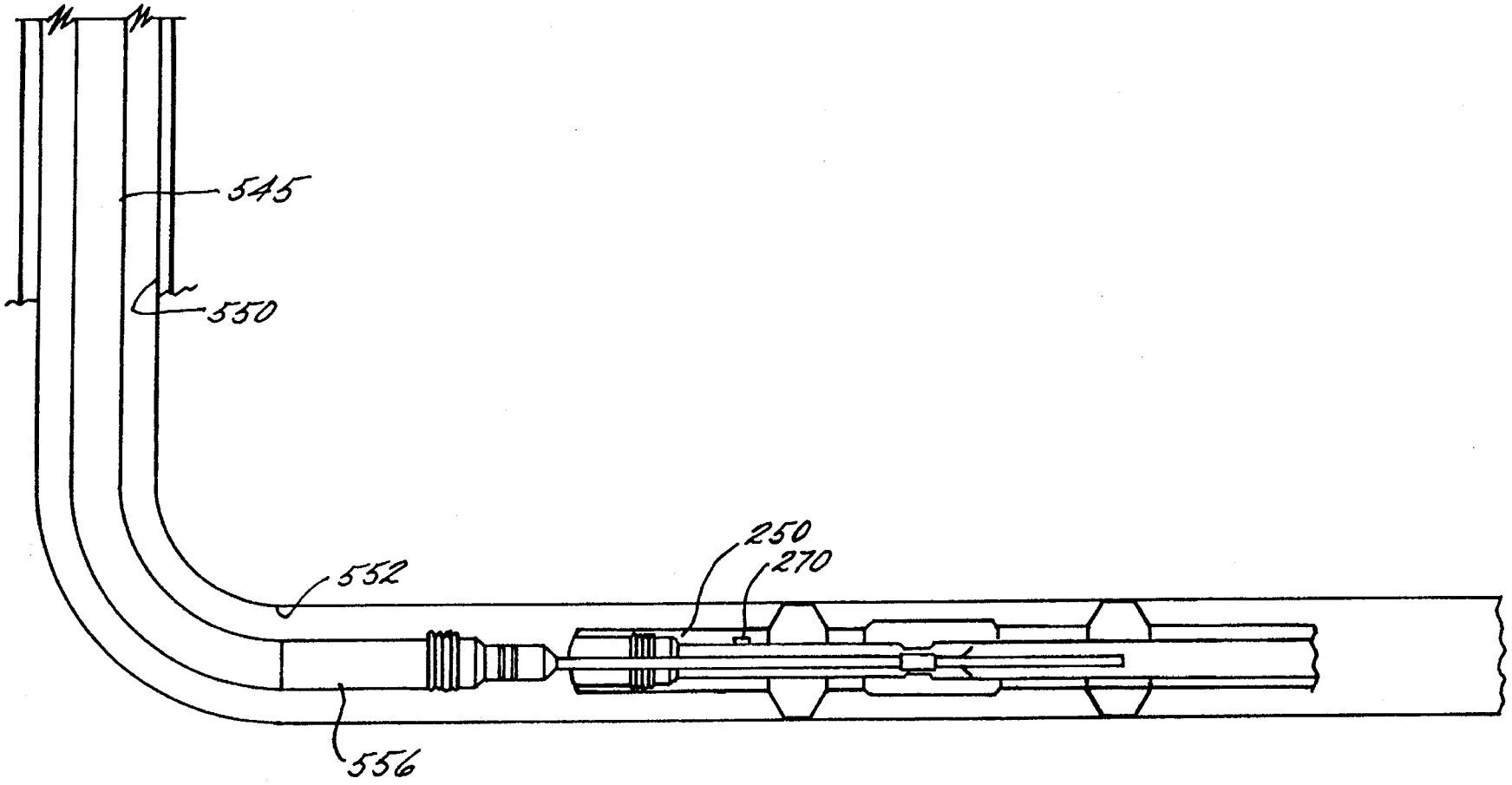

The aforementioned preferred embodiments of the several multilateral completion tools, components and assemblies set forth in FIGS. 13A–C are used in a downhole method for borehole completion which is quite similar to the method described with reference to FIGS. 1–9. Since there are some minor modifications to the overall method however (most of which have been discussed above), the following discussion with reference to FIGS. 34A–J provides a clear and concise description of the preferred method for multilateral completion in accordance with the present invention. Referring first to FIG. 34A, a cased borehole is shown at 550 which terminates at an open hole 552. A drillpipe 554 has been stabbed down the cased borehole 550 into the open hole 552. Drillpipe 554 terminates at a known running tool such as the aforementioned HR running tool 556. Attached to running tool 556 in a manner described in detail above is lateral connector receptacle (LCR) 250 and threadably attached to LCR 250 on the downstream side thereof is a completion string consisting of known elements including a workstring bumper sub 558, a plurality of sliding sleeves 560, spaced ECP's 562, a workstring stinger 564 and a snap-in/out indicating collet with seals 566. In FIG. 34B, running tool 556 has been removed from LCR 250 and the lower completion has been set in a known manner.

Figure 34C:
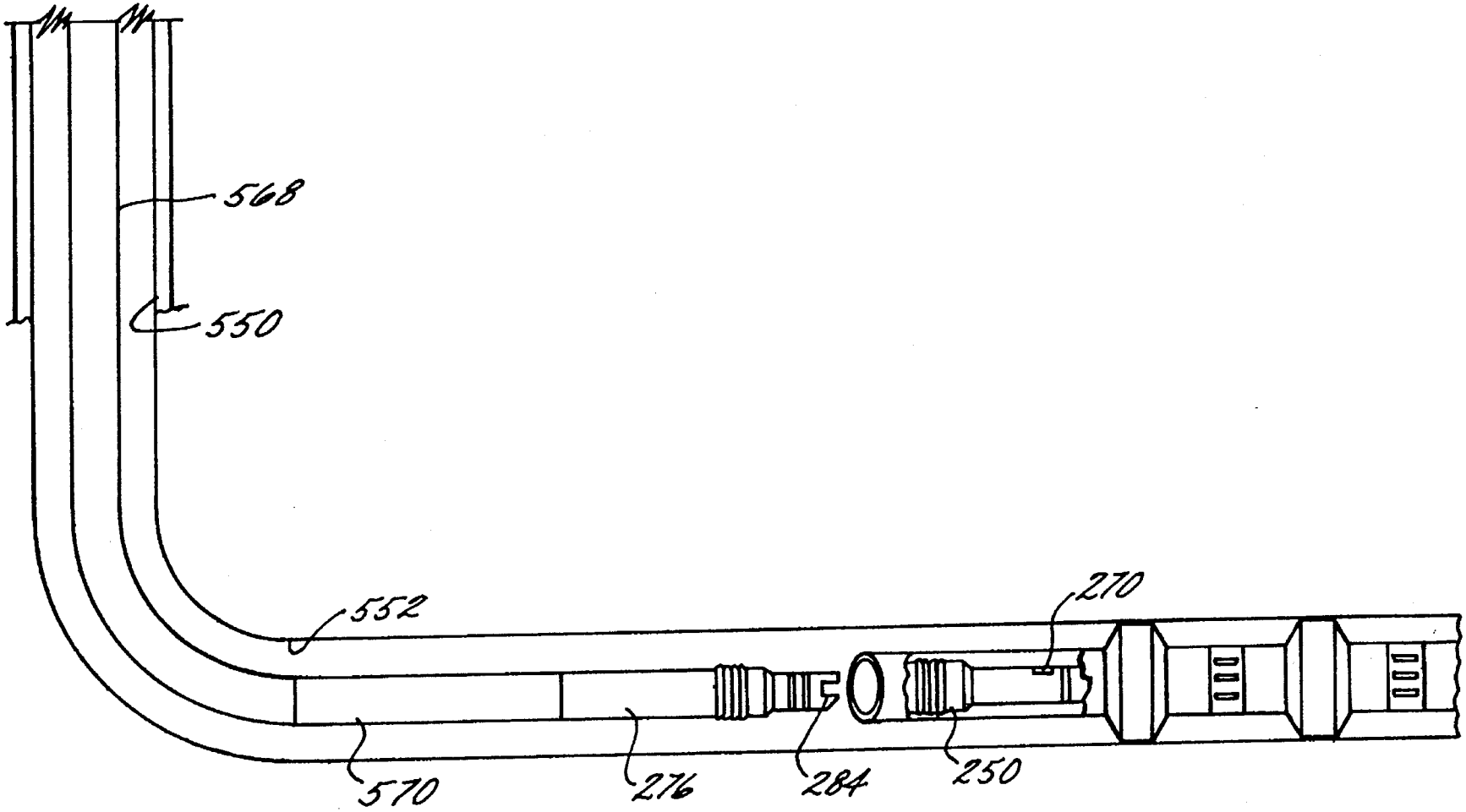
Figure 34D:
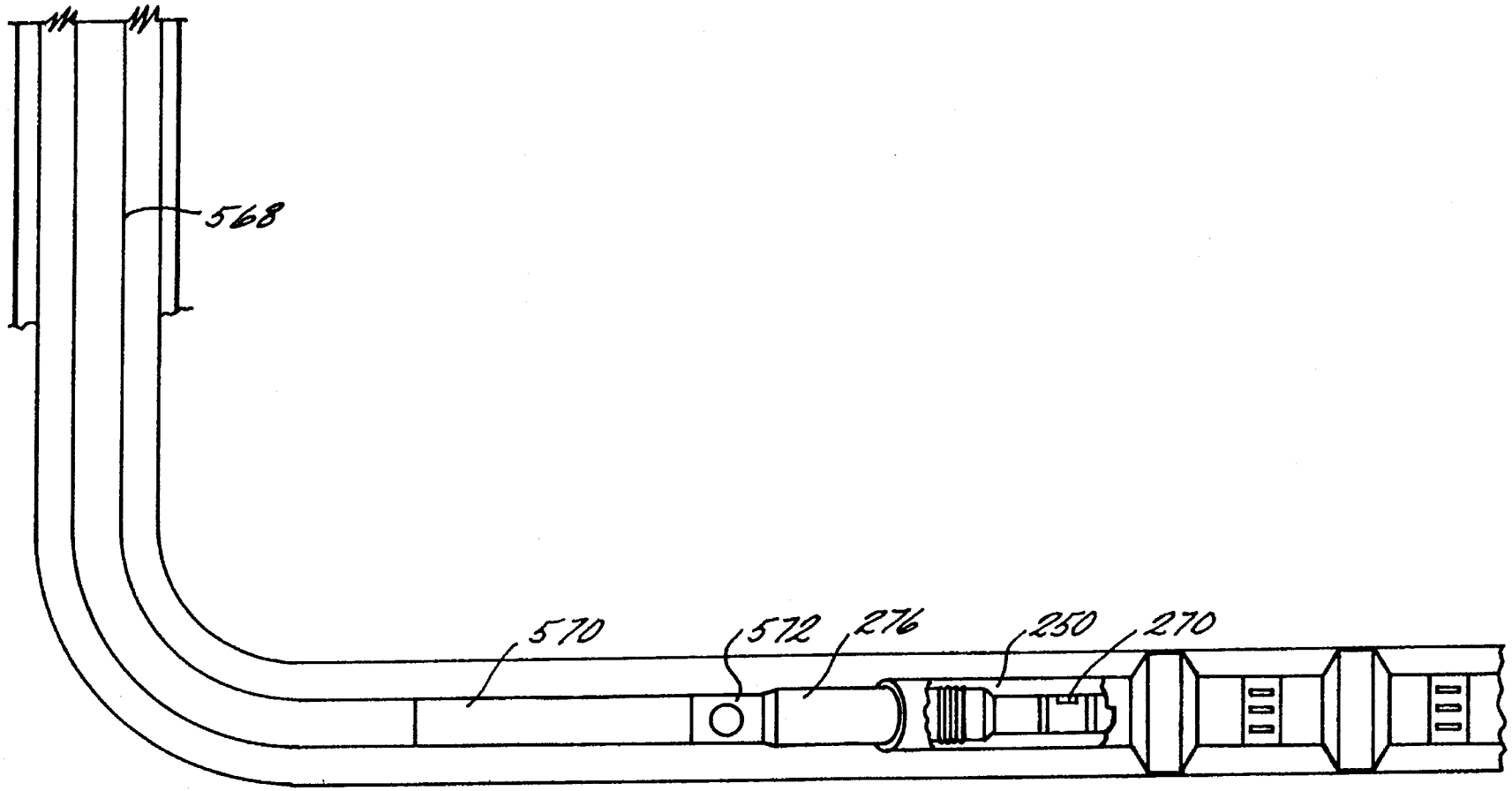

Next, in FIG. 34C, the HR running tool and attached drillpipe 554 has been removed and a new drillpipe 568 has been stabbed in through cased borehole 550 into open hole 552. Drillpipe 568 includes an MWD sub 570 which is attached to orientation whipstock anchor 276. Orientation whipstock anchor 276 is then stabbed into LCR 250 such that slot 284 on anchor 276 is engaged by lug 270 as described in detail above resulting in the orientation whipstock anchor 276 and LCR 250 being mateably engaged. At this point, the MWD sub determines the radial orientation of the orientation whipstock anchor 276 and this information is sent to the surface in a known manner. This final engagement is shown in FIG. 34D as is shown the circulating sub 572 which is used to circulate fluid through the drillpipe and thereby provide a flow path for pulsed signals sent from a mud pulser in the MWD sub which contained the encoded information regarding orientation (which has been acquired by the MWD sub).

Figure 34E:
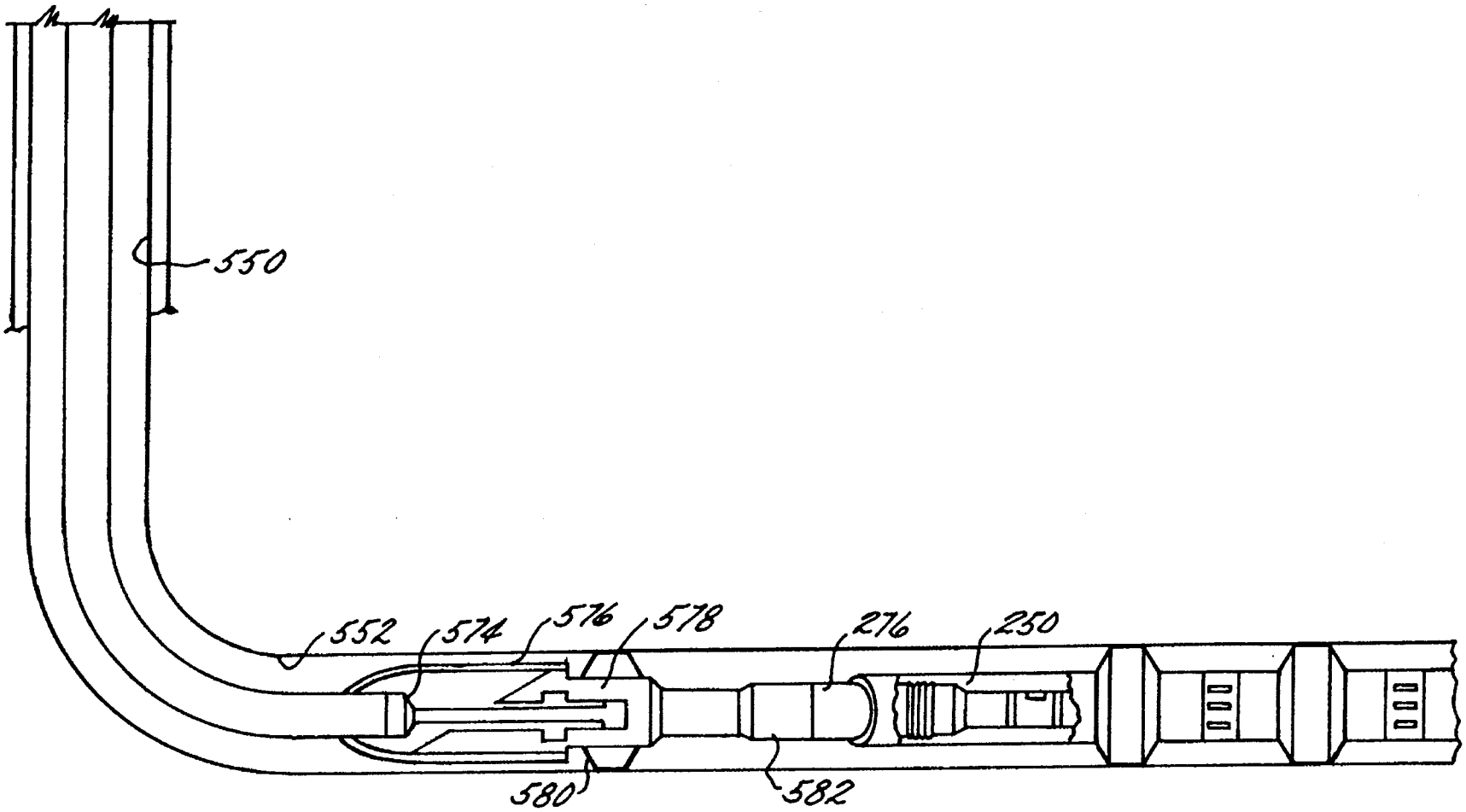
Figure 34F:
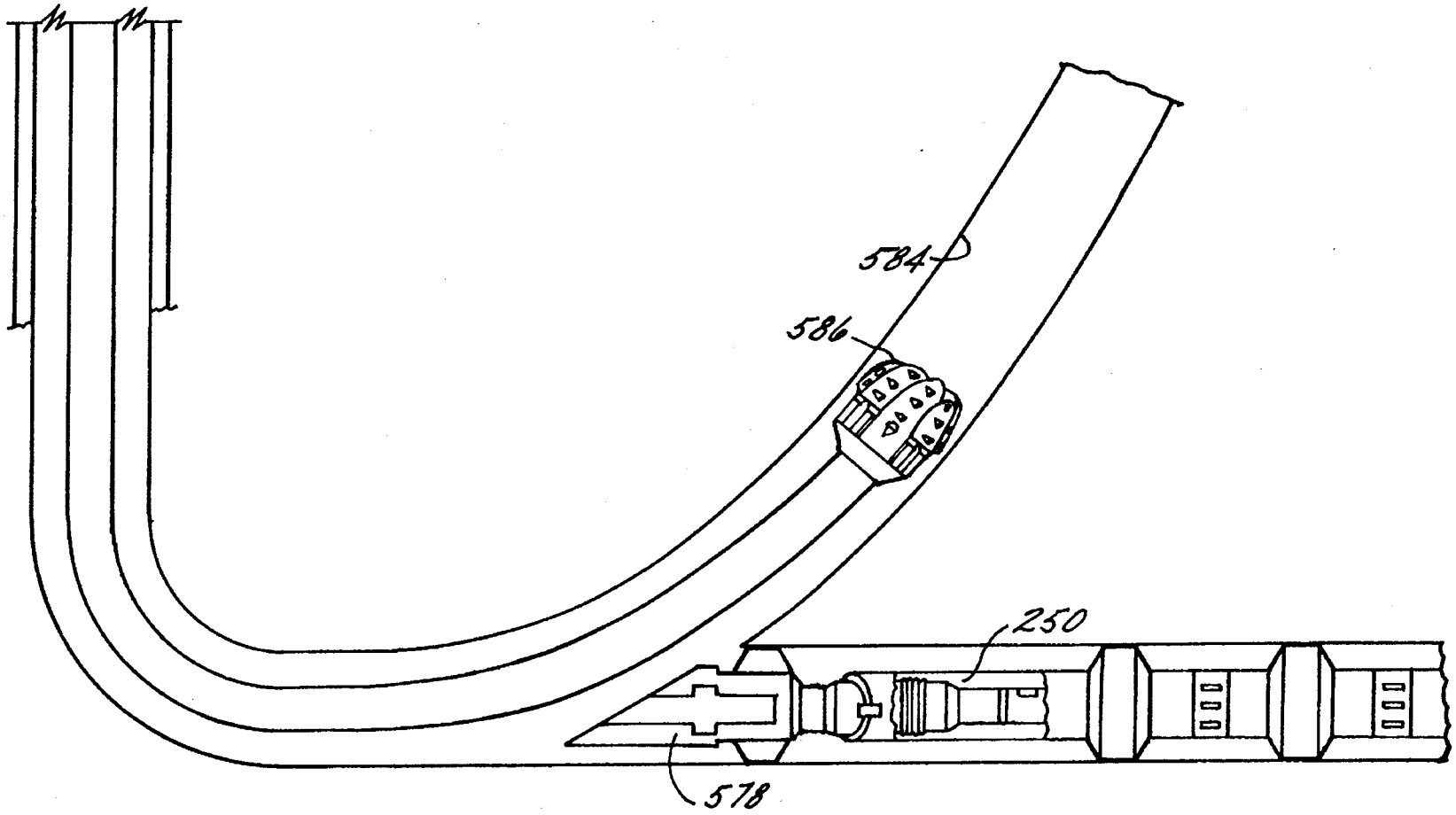
Figure 34G:
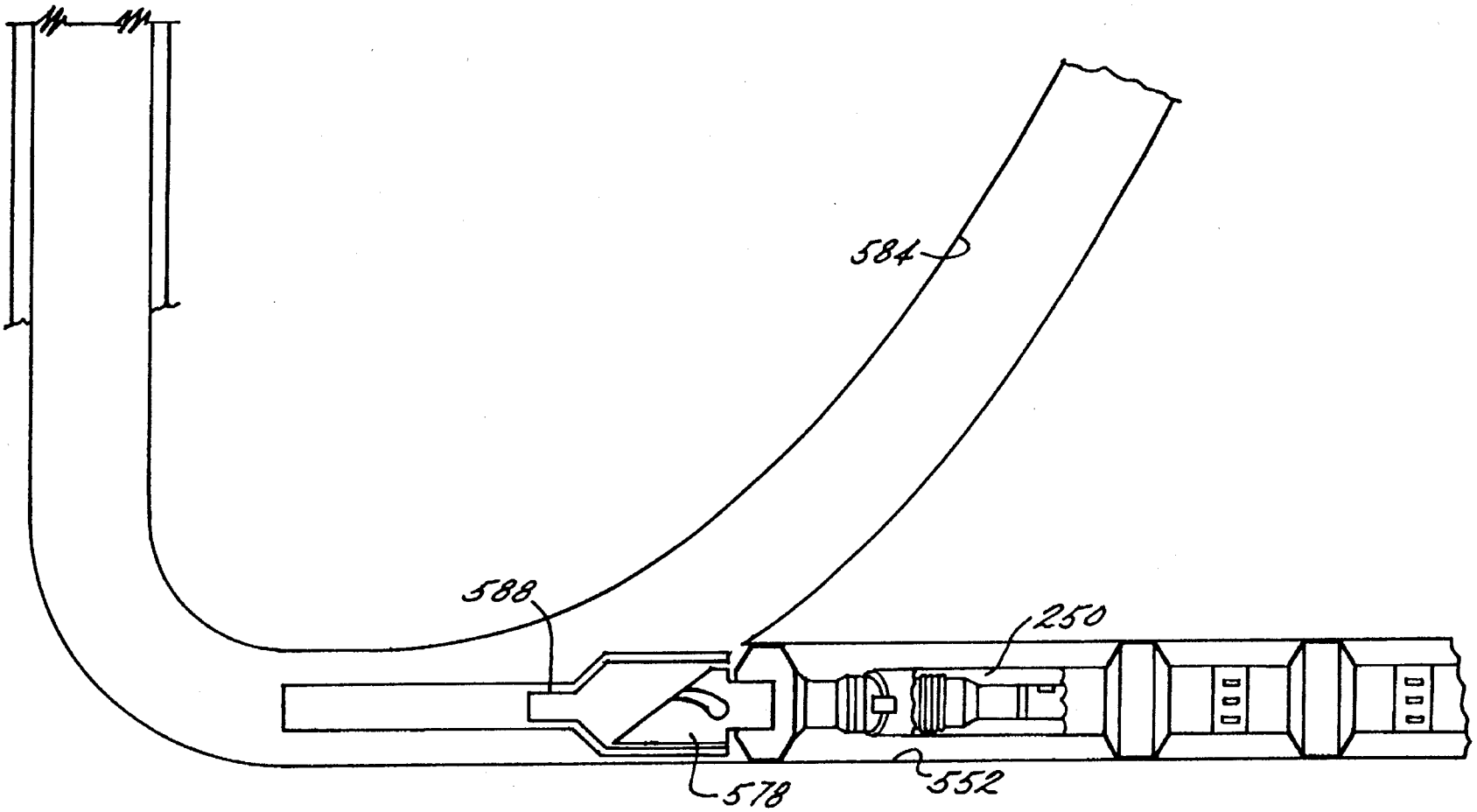

Thereafter, drillpipe 568, MWD sub 570 and circulating sub 572 are disengaged from LCR 250 by tension to shear release orientation anchor 276 and removed from the borehole. A retrievable whipstock system is then stabbed in cased borehole 550 and mated with orientation whipstock anchor (which has been snap latch engaged with (LCR 250). FIG. 34E depicts a preferred retrievable open hole whipstock assembly of the type described in aforementioned U.S. patent application Ser. No. 08/186,267, filed Jan. 25, 1994. Such retrievable whipstock assembly includes a running tool 574 having a protective housing or shroud 576 which engages a whipstock 578. Whipstock 578 includes an inflatable anchor 580 for anchoring to the walls of the open hole 552. Anchor 580 is attached to anchor 276 using a spline expansion joint 582. Thereafter, running tool 574 and housing 576 is removed and, as shown in FIG. 34F, a lateral borehole or branch 584 is drilled in a known manner using drill 586 which is deflected by whipstock 578 in the desired orientation and direction. As shown in FIG. 34G, drill 586 is removed followed by removal of the whipstock 578 using a whipstock removal tool 588.

Figure 34H:
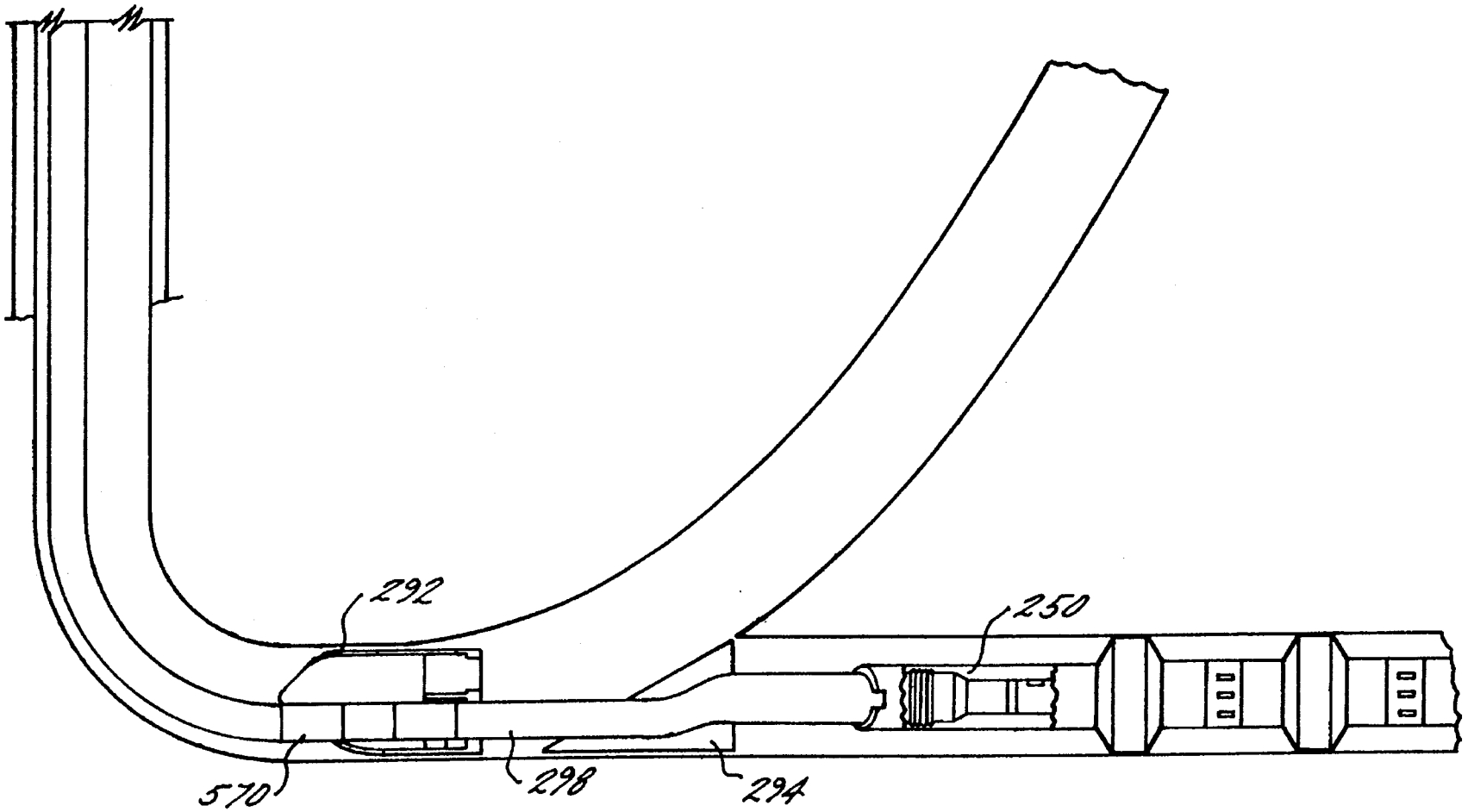
Figure 34I:
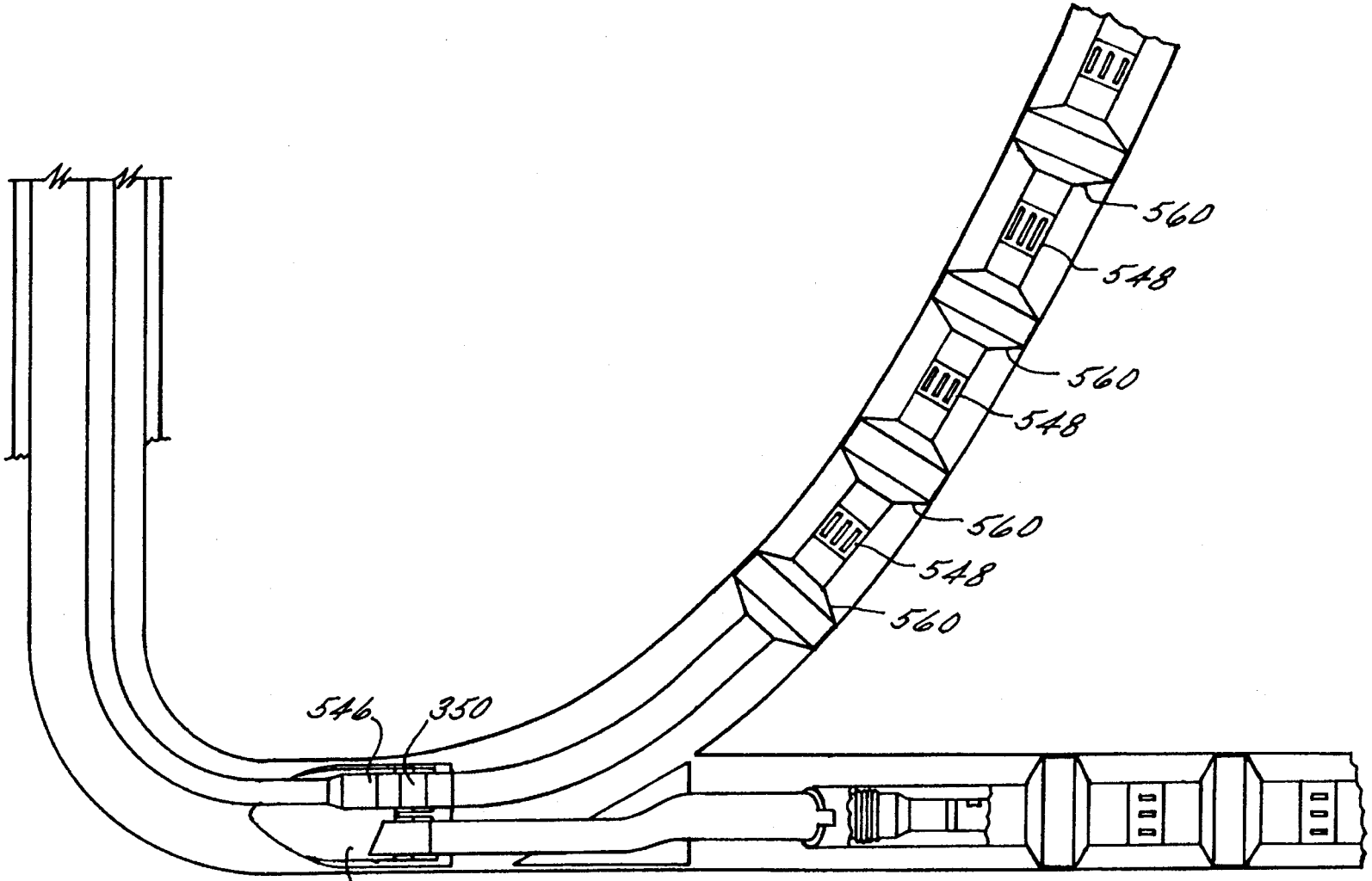
Figure 34J:
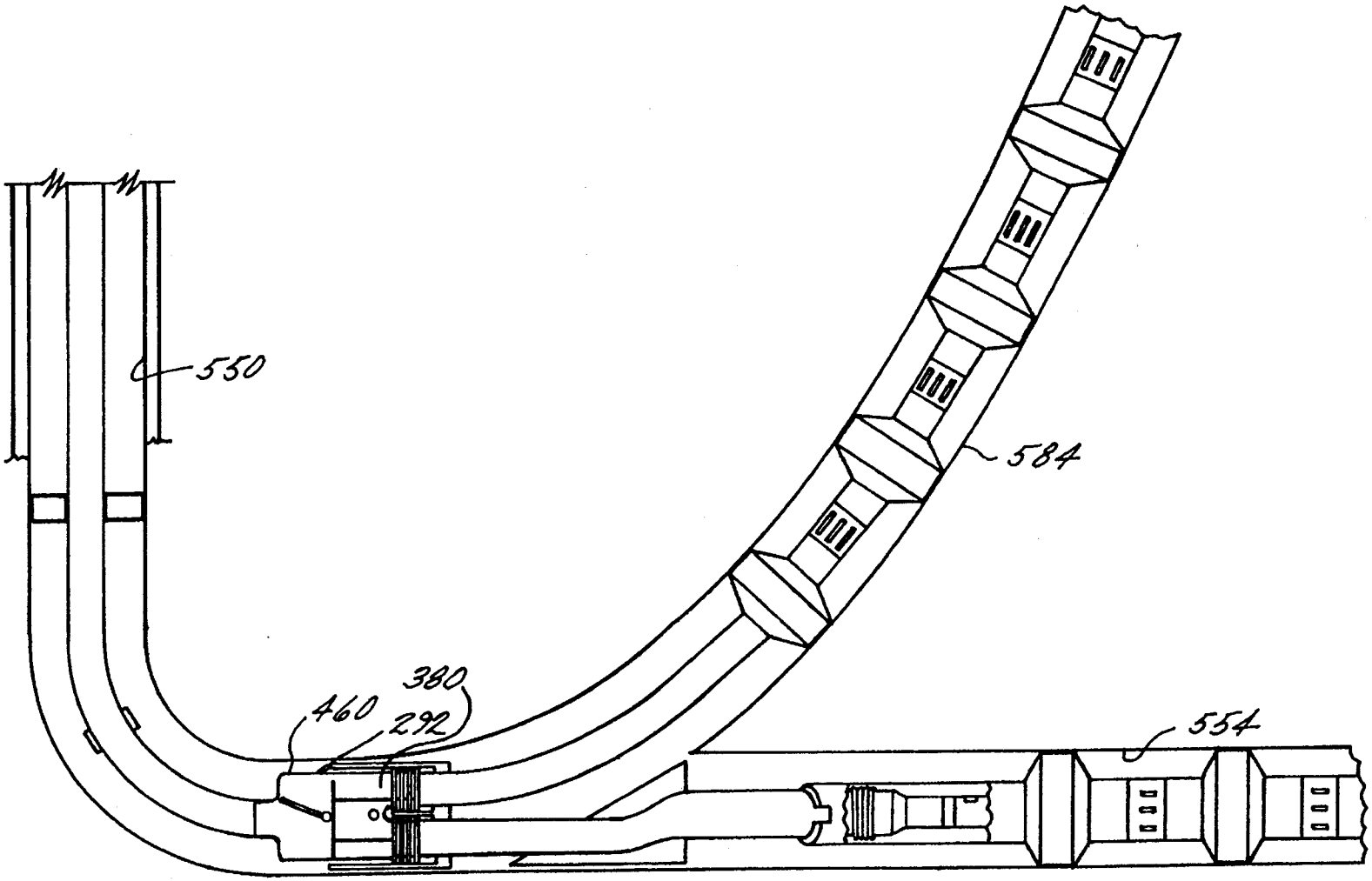

At this point, the assembly of FIG. 33 including the scoophead running tool 510, scoophead 292, tubing joint 298, diverter sub 294 and orientation anchor 276 are stabbed in downhole to mate with LCR 250 as shown in FIG. 34H. Preferably, an MWD sub 570 is used to maintain the proper orientation for ease of mating anchor 276 into LCR 250. As shown in FIG. 34I, a suitable running tool such as HR running tool 556 is then used to run in liner tie back sleeve 350 in a manner described in detail above. Of course, liner tie back sleeve 350 would have been threadably mated to the lateral completion string shown in FIG. 34I which is composed of any desired and known completion components including sliding sleeves 556 and ECP's 560. Finally, as shown in FIG. 34J, the parallel seal assembly 380 is assembled onto selective re-entry tool 460 and run in down hole such that parallel seal assembly engages and seals to the bore receptacle in the small bore of scoophead 292 in the bore receptacle in liner tie back sleeve 350. It will be appreciated that the multilateral completion components shown in the multilateral completion of FIG. 34J are also shown in more detail in FIGS. 13A–C discussed above. As can be seen in FIG. 34J, coil tubing or the like may now be easily stabbed in and using the selective re-entry tool 460, the coil tubing may enter either the main borehole 554 or the lateral borehole 584. Of course, selective re-entry tool 460 may be removed and replaced with a single tubing completion or a dual packer completion as may be desired. It will further be appreciated that the multilateral completion shown in FIG. 34J may be repeated any desired number of times along other sections of borehole 550. Thus, the several multilateral completion components described herein including the lateral connector receptacle, the scoophead/diverter assembly, the liner tie back sleeve, the parallel seal assembly and the selective re-entry tool may all be used as modular components in completions of boreholes having any desired number of lateral or branch borehole completions.

In addition to the aforementioned features and advantages of the method and devices of the present invention, still another important feature of this invention involves the use of a retrievable whipstock as an integral component used in actually completing two or more individual wellbores. Whipstocks have been used historically as a means to drill additional sidetracks within a parent wellbore. In some instances, several sidetracks have been drilled and produced thru open hole. However, it is not believed that prior to the present invention (as well as the related inventions disclosed in parent application Ser. No. 07/926,451 (now U.S. Pat. No. 5,311,936)), that there has been disclosed a method which allows a whipstock to be run in the hole and set above a completion assembly, the whipstock then used to drill a lateral sidetrack and the whipstock then retrieved to allow the lower completion to be connected to the upper lateral completion.

In contrast, an important feature of this invention is the use of a "retrievable" whipstock. The fact that the retrievable whipstock is used in this method is important in that it:

(1) Combines the completion and drilling operations to make them highly dependent upon each other for success. Current oil field practices separates the drilling phase from the completion phase. Use of the retrievable whipstock to drill a lateral above a previously installed completion, then retrieve the whipstock to continue the completion process is an important and advantageous feature; and is believed to be hitherto unknown.

(2) The retrievable whipstock serves as the lateral position to insure the lateral is placed in the desired angular direction. This is done by engaging the whipstock with the lower completion assembly by use of an orientation anchor to achieve the desired lateral direction/position. Once the lateral is drilled, the whipstock is then retrieved and the remainder of the completion installed with a certainty that the lateral can easily be found for re-entry due to the known direction of the whipstock face. The upper lateral completion equipment can now be installed using the same space out and angular settings as from the whipstock.

(3) Conventional whip stock applications do not allow for connecting the lateral completion above the whipstock to the completion below the whipstock once it has been removed.

(4) The whipstock and the completion system of this invention may be in either the cased hole or the open hole situation; and the tools disclosed herein may be used in either application. It will be appreciated however, that the basic completion technique is the same for each condition (e.g., open or cased hole).

Still another important feature of this invention is the use of known measurement-while-drilling (MWD) devices and tools for well completion (including multi-lateral well completion). While MWD techniques have been known for over fifteen years and in that time, have gained wide acceptance, the use of MWD has been limited only to borehole drilling, particularly directional drilling. It is not believed that there has been any suggestion of using MWD techniques in wellbore completions despite the fact that MWD techniques are well known and widely used in borehole drilling. (It will be appreciated that parent application Ser. No. 07/926,451 does disclose in FIG. 14D the use of more time consuming and therefore costlier wire-line orientation sensing devices). It has now been discovered that MWD may be advantageously used in wellbore completions and particularly multi-lateral completions.

It will be appreciated that any commercial MWD system has the ability to work in connection with this novel application. A preferred MWD system comprises a "Positive Pulse" type (i.e., mud pulse telemetry) which requires circulation down the tubing thru the bottom hole assembly. The required circulation may be achieved using the scoophead running tool and scoophead/diverter system. As fluid is circulated, a pressure pulse is generated and conducted thru the fluid media back to the surface. This information is decoded and the angular orientation of the bottom hole assembly is determined. Rotational adjustments are then made at surface. One commercial example of a suitable mud pulse telemetry system would be the DMWD system in commercial use by Baker Hughes INTEQ of Houston, Tex. Another example of a suitable mud pulse telemetry system is described in commonly assigned U.S. Pat. No. 3,958,217, all of the contents of which are incorporated herein by reference.

Examples of successful applications of MWD in completions have been described herein with regard to lateral wellbores which may be installed up to depths of 10,000 ft.

or more, and which range from vertical to horizontal. When running the scoophead/diverter assembly 290, and also when running the parallel seal assembly 380, it is desirable to align the tools at approximately the position at which they will engage the mating equipment. For example, when installing the scoophead/diverter assembly 290, the use of MWD will allow the operator to orientate the diverter face 306 with the previously drilled lateral prior to landing the anchor 276 to minimize the torque that would be induced into the workstring if the tool were required to self-align. In a horizontal application, the workstring may be drillpipe and could be very rigid, thereby preventing self-alignment of the anchor. The use of MWD as a means of pre-aligning the system prior to landing offers increased reliability to the completion. Also, while the parallel seal assembly 380 has been tested and has successfully self-aligned with the scoophead 292 in the horizontal position while being as much as 120° out of phase, it is not desirable to rely solely on the parallel seal assembly to rotate the entire workstring during this self alignment process, and therefore MWD technology for this stage of the completion is also recommended and therefore preferred.

While preferred embodiments have been shown and described, various modifications and substitutions may be made thereto without de:parting from the spirit and scope of the invention. Accordingly, it is to be understood that the present invention has been described by way of illustrations and not limitation.

What is claimed is:

1. A method for completing multilateral wells wherein a primary well communicates with at least a first and a second lateral well extending from said primary well, said first lateral well being downhole from said second lateral well, comprising the steps of:

(a) completing said first lateral with a first completion string, said first completion string including a packer bore receptacle having a first orientation device;

(b) running a scoophead/diverter assembly into said primary well, said scoophead/diverter assembly including a scoophead and a diverter spaced downwardly from and connected to said scoophead, said scoophead/diverter assembly terminating at an orientation anchor having a second orientation device for mating with said first orientation device, said scoophead/diverter assembly further including fluid communications structure for fluid communication with said first completion string; and (c) completing said second lateral well with a second completion string which is passed through said scoophead and diverted by said diverter into said second lateral well.

2. The method of claim 1 including:

running a selective re-entry tool into communication with said scoophead, said selective re-entry tool including a selection device for providing selective mechanical communication from said first lateral well to said second lateral well.

3. The method of claim 2 wherein said selective re-entry tool includes an input bore and a pair of output bores and wherein said selection device comprises:

a diversion flapper for selectively providing communication between said input bore and each of said output bores.

4. The method of claim 1 wherein said second lateral is drilled after step (a) and prior to step (b) using a method including the steps of:

running a retrievable whipstock assembly into said primary well, said retrievable whipstock assembly including a whipstock orientation anchor having a third orientation device for mating with said first orientation device, said second and third orientation devices mating with said first orientation device;

drilling said second lateral well off of said whipstock assembly; and retrieving said whipstock assembly.

5. The method of claim 1 including the step of:

ascertaining the orientation of said first orientation device.

6. The method of claim 5 wherein said ascertaining step includes:

using a measurement-while-drilling sub apparatus connected to a circulating sub for ascertaining the orientation and for delivering encoded information concerning the first orientation device to the surface for orienting said second orientation device.

7. The method of claim 4 including the step of:

ascertaining the orientation of said first orientation device.

8. The method of claim 7 wherein said ascertaining step includes:

using a measurement-while-drilling sub apparatus connected to a circulating sub for ascertaining the orientation and for delivering encoded information concerning the first orientation device to the surface for orienting said third orientation device.

9. The method of claim 1 wherein:

said first orientation device comprises a key slot; and said second orientation device comprises a key sized to mate with said key slot.

10. The method of claim 5 wherein:

said first orientation device comprises a key slot; and said third orientation device comprises a key sized to mate with said key slot.

11. The method of claim 10 wherein:

said second orientation device comprises a key sized to mate with said key slot.

12. The method of claim 1 wherein:

said first orientation device comprises an anchor lug; and said second orientation device comprises a slot sized to mate with said anchor lug.

13. The method of claim 4 wherein:

said first orientation device comprises an anchor lug; and said third orientation device comprises a slot sized to mate with said anchor lug.

14. The method of claim 13 wherein:

said second orientation device comprises a slot sized to mate with said anchor lug.

15. The method of claim 1 wherein:

at least said first or second completion string includes a plurality of external casing packers disposed thereon.

16. The method of claim 1 wherein:

at least said first or second completion string includes a plurality of sliding sleeves disposed thereon and interspersed between a plurality of external casing packers.

17. The method of claim 5 wherein:

said retrievable whipstock assembly includes a production injection packer assembly.

18. The method of claim 4 wherein said whipstock assembly includes a slot and further including:

using a retrieving tool to retrieve said whipstock assembly, said retrieving tool including an elongated nose portion dimensioned to fit within said slot of said whipstock assembly and said retrieving tool including structure for centering said nose portion for engagement with said slot of said whipstock assembly.

19. The method of claim 18 wherein said centering structure includes:

a pair of centralizers having a connector disposed therebetween.

20. The method of claim 19 wherein:

said centralizers each have a central axis and wherein said connector is offset at an acute angle with respect to the central axis of each centralizer.

21. A method for completing multilateral wells wherein a primary well communicates with at least a first lateral well extending from said primary well, comprising the steps of:

(a) completing said first lateral well with a first completion string, said first completion string including a packer bore receptacle having a first orientation device;

(b) running a retrievable whipstock assembly into said primary well, said retrievable whipstock assembly including a whipstock orientation anchor having a second orientation device for mating with said first orientation device, said second orientation device mating with said first orientation device;

(c) drilling a second lateral well off of said whipstock assembly;

(d) retrieving said whipstock assembly; and (e) completing said second lateral well with a second completion string.

22. The method of claim 21 wherein:

said first orientation device comprises a key slot; and said second orientation device comprises a key sized to mate with said key slot.

23. The method of claim 21 wherein:

said first orientation device comprises an anchor lug; and said second orientation device comprises a slot sized to mate with said anchor lug.

24. A method for completing multilateral wells wherein a primary well communicates with at least a first and a second lateral well extending from said primary well, said first well being downhole from said second lateral well, comprising the steps of:

(a) completing said first lateral with a first completion string;

(b) running a scoophead diverter assembly into said primary well, said scoophead diverter assembly comprising;

(1) a scoophead, said scoophead including at least a first and a second longitudinal bore therethrough, said first bore adapted for communication downhole in the primary wellbore and the second bore adapted for communication to a lateral wellbore;

(2) a diverter sub, said diverter sub including at least a first longitudinal opening therethrough and a sloped diverting outer surface for directing an object into a lateral wellbore;

(3) a connecting structure for rigidly connecting said scoophead to said diverter sub at a preselected spaced distance; and (4) tubing communicating between said first bore in said scoophead and said opening of said diverter sub, said connecting structure being spaced from said tubing;

(c) completing said second lateral well with a second completion string which is passed through said scoophead and diverted by said sloped diverting outer surface into said second lateral well.

25. The method of claim 24 including:

an attaching device communicating with said second bore for mating with a liner inserted into said second bore.

26. The method of claim 25 wherein said attaching device comprises:

a spring loaded dog positioned in at least one opening radially extending from said second bore.

27. The method of claim 24 wherein said connecting structure comprises:

at least one strut connected between said scoophead and said diverter sub.

28. The method of claim 24 including:

a profiled section on an outer surface of said scoophead for mating with a running tool.

29. A method for completing multilateral wells wherein a primary well communicates with at least a first and a second lateral well extending from said primary well, said first well being downhole from said second lateral well, comprising the steps of:

(a) completing siad first lateral with a first completion string;

(b) running a scoophead diverter assembly into said primary well, said scoophead diverter assembly comprising:

(1) a scoophead, said scoophead including at least a first and a second longitudinal bore therethrough, said first bore adapted for communication with the first lateral well and the second bore adapted for communication with the seocnd lateral well;

(2) a diverter sub, said diverter sub including at least a first longitudinal opening therethrough and a sloped diverting outer surface for directing an object into the second lateral well;

(3) a connecting structure for rigidly connecting said scoophead to said diverter sub at a preselected spaced distance; and (4) tubing communicating between said first bore in said scoophead and said opening of said diverter sub;

(c) completing said second lateral well with a second completion string which is passed through said scoophead and diverted by said sloped diverting outer surface into said second lateral well; and (d) running a liner tie back sleeve into said second bore of said scoophead, said liner tie back sleeve comprising:

a cylindrical sleeve having opposed first and seocnd ends and having an interior surface and an exterior surface;

threading on said second end of said sleeve for threadably mating with production tubing;

a smooth seal bore along a portion of said interior of said sleeve;

a first attachment along a portion of siad interior of said sleeve for removable attachment of said sleeve to a running tool; and a second attachment along a portion of said exterior of said sleeve for attachment within said second bore of said scoophead.

30. The method of claim 29 including;

a locking device along a portion of said interior of said sleeve for locking to a tool positioned in said sleeve in sealing engagement with said seal bore.

31. The method of claim 30 wherein:

said locking device comprises tapered latching thread.

32. The method of claim 29 wherein said first attachment comprises:

a pair of spaced profiles for cooperatively engaging a mating device from a running tool.

33. The method of claim 29 wherein said second attachment comprises:

a locating shoulder extending outwardly from said exterior surface; and a locking groove associated with said shoulder for cooperatively locking with an attaching means in said second bore of said scoophead device.

34. The method of claim 29 including the step of running a parallel seal assembly into said first and second bores of said scoophead, said parallel seal assembly comprising:

a seal assembly housing;

a first seal assembly extending from said housing, said first seal assembly comprising a first tubing having an exterior cylindrical surface with a first seal disposed along a portion of said surface, said first seal being in sealing engagement with said seal bore in said liner tie back sleeve;

a second seal assembly extending from said housing, said second seal assembly comprising a second tubing having an exterior cylindrical surface with a second seal disposed along a portion of said surface, said second seal being in sealing engagement in said first bore of said scoophead;

35. The method of claim 34 including:

a cooperative latch positioned on the exterior of said first tubing.

36. The method of claim 34 wherein:

said latch includes a cantilevered collet latch having ratchet teeth for interlocking engagement with latching thread on the interior surface of said cylindrical sleeve.

37. The method of claim 36 including:

a shear-out device positioned on the exterior of said first tubing.

38. The method of claim 37 wherein said shear-out device comprises:

a shear block which supports said collet latch when said collet latch is interlocked with latching thread from a receiving tool; and a shear ring received in a groove in said exterior surface of said first tubing, said shear ring heaving a shoulder in abutting contact with said shear block, said shear ring being sheared from said first tubing when subjected to a preselected shearing force wherein said shear block ceases to support said collet latch allowing said collet latch to ratchet out of interlocking engagement with the latching thread.

39. The method of claim 34 wherein:

said first seal assembly is longer than said second seal assembly.

40. The method of claim 39 wherein:

said first and second seal assemblies are disposed across from one another in a parallel configuration.

41. The method of claim 34 wherein:

said first and second seal assembly are disposed across from one another in a parallel configuration.

42. A method for completing multilateral wells wherein a primary well communicates with at least a first and a second lateral well extending from said primary well, said first well being downhole from said second lateral well, comprising the steps of:

(a) completing said first lateral with a first completion string;

(b) running a scoophead diverter assembly into said primary well, said scoophead diverter assembly comprising:

(1) a scoophead, said scoophead including at least a first and a second longitudinal bore therethrough, said first bore adapted for communication with the first lateral well and the second bore adapted for communication with the second lateral well;

(2) a diverter sub, said diverter sub including at least a first longitudinal opening therethrough and a sloped diverting outer surface for directing an object into the second lateral well;

(3) a connecting structure for rigidly connecting said scoophead to said diverter sub at a preselected spaced distance; and (4) tubing communicating between said first bore in said scoophead and said opening of said diverter sub;

(c) completing said second lateral well with a second completion string which is passed through said scoophead and diverted by said sloped diverting outer surface into said second lateral well; and (d) running a parallel seal assembly into said first and second bores of said scoophead, said parallel seal assembly comprising:

a seal assembly housing;

a first seal assembly extending from said housing, said first seal assembly comprising a first tubing having an exterior cylindrical surface with a first seal disposed along a portion of said surface, said first seal being in sealing engagement with said second bore of said scoophead means; and a second seal assembly extending from said housing, said second seal assembly comprising a second tubing having an exterior cylindrical surface with a second seal disposed along a portion of said surface, said second seal being in sealing engagement within said first bore of said scoophead means.

43. The method of claim 42 wherein:

said first seal assembly is longer than said second seal assembly.

44. The method of claim 43 wherein:

said first and second seal assemblies are disposed across from one another in a parallel configuration.

45. The method of claim 42 wherein:

said first and second seal assemblies are disposed across from one another in a parallel configuration.

46. A method for completing multilateral wells wherein a primary well communicates with at least a first and a second lateral well extending from said primary well, said first well being downhole from said second lateral well, comprising the steps of:

(a) completing said first lateral with a first completion string:

(b) running a scoophead diverter assembly into said primary well, said scoophead diverter assembly comprising:

(1) a scoophead, said scoophead including at least a first and a second longitudinal bore therethrough, said first bore adapted for communication with the first lateral well and the second bore adapted for communication with the second lateral well;

(2) a diverter sub, said diverter sub including at least a first longitudinal opening therethrough and a sloped diverting outer surface for directing an object into the second lateral well;

(3) a connecting structure for rigidly connecting said scoophead to said diverter sub at a preselected spaced distance; and (4) tubing communicating between said first bore in said scoophead and said opening of said diverter sub:

(c) completing said second lateral well with a second completion string which is passed through said scoophead and diverted by said sloped diverting outer surface into said second lateral well; and (d) running the scoophead into the primary well using a running tool, the running tool comprising:

running the scoophead means into the primary well using a running tool, the running tool comprising:

a mounting head having an opening passing longitudinally therethrough, said mounting head having a first end and an opposed second end;

a running stump extending outwardly from said second end and being positioned in said second bore of said scoophead; and a housing extending outwardly from said first end and communicating with said opening through said mounting head, said housing being parallel to said running stump, said housing and running stump being axially offset with respect to the longitudinal axis of said mounting head;

an internal mandrel in said housing having an outer surface and an interior longitudinal opening, said internal mandrel being longitudinally movable within said housing in response to a selected force; and a displaceable connector cooperating with said housing and internal mandrel to selectively engage or disengage from a mating connector in said first bore of said scoophead in response to the movement of said internal mandrel.

47. The method of claim 40 wherein said displaceable connector comprises:

at least one window through said housing;

a dog in said window, said dog being supported by said internal mandrel; and a raised surface on said outer surface of said internal mandrel and an associated recessed surface on said outer surface of said internal mandrel wherein as said internal mandrel longitudinally moves, said dog is urged outwardly of said window when said dog is supported by said raised surface and is urged inwardly of said window when said dog is supported by said recessed surface.

48. A method for completing multilateral wells wherein a primary well communicates with at least a first and a second lateral well extending from said primary well, said first well being downhole from said second lateral well, comprising: the steps of:

(a) completing said first lateral with a first completion string;

(b) running a scoophead diverter assembly into said primary well, said scoophead diverter assembly comprising;

(1) a scoophead, said scoophead including at least a first and a second longitudinal bore therethrough, said first bore adapted for communication with the first lateral well and the second bore adapted for communication with the second lateral well;

(2) a diverter sub, said diverter sub including at least a first longitudinal opening therethrough and a sloped diverting outer surface for directing an object into the second lateral well;

(3) a connecting structure for rigidly connecting said scoophead to said diverter sub at a preselected spaced distance; and (4) tubing communicating between said first bore in said scoophead and said opening of said diverter sub;

(c) completing said second lateral well with a second completion string which is passed through said scoophead and diverted by said sloped diverting outer surface into said second lateral well; and (d) running a device for selective re-entry of multi-lateral wells into said scoophead, the device being remotely controlled by an actuator from a surface operator

49. The method of claim 48 wherein said device for selective reentry of multi-entry wells comprises:

a housing including a central bore, said central bore including an input bore and a plurality of output bores, said output bores being respectively in fluid communication with said first and second bores of said scoophead;

a sliding device disposed within said central bore of said housing, said sliding device being longitudinally shiftable with respect to said housing;

a selecting device for selectively providing mechanical communication between said input bore and one of said plurality of output bores in response to longitudinal movement of said sliding device; and an engaging device for engaging said selecting device wherein said sliding device is remotely controlled by the surface operator.

50. The method of claim 49 wherein said sliding device comprises:

an inner sleeve; and a rectangular box attached to said inner sleeve.

51. The method of claim 50 wherein said box includes a pair of oppositely disposed ramped guide slots and wherein said selecting device comprises:

a flapper having a pair of laterally disposed ears, one each of said ears mating with one each of said guide slots wherein said ears are movable along said guide slots in response to longitudinal movement of said inner sleeve and said box.

52. The method of claim 51 wherein said output bores are located in an exit sub and wherein:

said flapper terminates and is pivotable at an intersection between said output bores wherein said flapper radially moves about said intersection in response to said ears moving along said guide grooves and wherein the flapper blocks one of said output bores such that an object passing through said sleeve and said box is directed by said flapper into only one of said output bores.

53. A method for completing multilateral wells wherein a primary well communicates with at least a first and second lateral well extending from said primary well, said first lateral well being downhole from said second lateral well, comprising the steps of:

(a) completing said first lateral with a first completion string;

(b) running a scoophead diverter assembly into said primary well, said scoophead diverter assembly comprising;

(1) a scoophead, said scoophead including at least a first and a second longitudinal bore therethrough, said first bore adapted for communication with the first lateral well and the second bore adapted for communication with the second lateral well, said scoophead means including a top surface having a selected configuration for urging a selected object into one of said first or second bores;

(2) a diverter sub, said diverter sub means including at least a first longitudinal opening therethrough and a sloped diverting outer surface for directing an object into a lateral wellbore; and (3) tubing communicating between said first bore in said scoophead and said opening of said diverter sub;

(c) completing said second lateral well with a second completion string which is passed through said scoophead and diverted by said sloped diverting outer surface into said second lateral well.

54. The method of claim 53 wherein said selected configuration of said top surface comprises:

a sloped surface surrounding said second bore;

a slotted surface extending from said second bore and surrounding said first bore; and a pair of opposed compound angled surfaces along longitudinal edges of said slotted surface.

* * * * *